US007963429B2

(12) United States Patent
Zolentroff

(10) Patent No.: US 7,963,429 B2
(45) Date of Patent: Jun. 21, 2011

(54) MID-ZONE STAPLER OR PRESSING TOOL

(76) Inventor: William Carlton Zolentroff, New York, NY (US)

( * ) Notice: Subject to any disclaimer, the term of this patent is extended or adjusted under 35 U.S.C. 154(b) by 20 days.

(21) Appl. No.: 11/748,780

(22) Filed: Aug. 21, 2007

(65) Prior Publication Data

US 2009/0050669 A1 Feb. 26, 2009

(51) Int. Cl.
*B25C 5/10* (2006.01)

(52) U.S. Cl. ..... 227/120; 227/132; 227/134; 227/128; 227/156

(58) Field of Classification Search ..... 227/120, 227/132, 134, 128, 156
See application file for complete search history.

(56) References Cited

U.S. PATENT DOCUMENTS

| | | | | |
|---|---|---|---|---|
| 3,103,012 | A | 9/1963 | Kohen | |
| 4,113,164 | A | 9/1978 | Muthenthaler | |
| 4,981,245 | A | 1/1991 | Sato | |
| 4,984,729 | A | 1/1991 | Balma | |
| 5,183,196 | A | 2/1993 | Miyashita | |
| 5,704,533 | A | 1/1998 | Chang | |
| 5,758,813 | A * | 6/1998 | Kikuchi et al. | 227/155 |
| 5,890,642 | A | 4/1999 | Sato | |
| 6,152,347 | A | 11/2000 | Wilson | |
| 6,179,193 | B1 * | 1/2001 | Nagai | 227/123 |
| 6,550,661 | B2 * | 4/2003 | Aoki | 227/134 |
| 6,776,321 | B2 | 8/2004 | Jairam | |
| 6,942,136 | B2 | 9/2005 | Tsai | |
| 6,966,479 | B2 | 11/2005 | Tanaka | |
| 7,021,515 | B2 * | 4/2006 | Elonsson et al. | 227/134 |
| 7,097,088 | B2 * | 8/2006 | Shor | 227/132 |
| 7,124,926 | B1 * | 10/2006 | Tsai | 227/155 |
| 7,140,526 | B2 * | 11/2006 | Matsukawa | 227/132 |
| 7,159,749 | B2 * | 1/2007 | Tsai | 227/155 |
| 7,195,141 | B2 * | 3/2007 | Elonsson et al. | 227/79 |
| 7,290,692 | B2 | 11/2007 | Marks | |
| 7,431,186 | B2 * | 10/2008 | Hsu | 227/120 |
| 7,621,432 | B2 * | 11/2009 | Chiang et al. | 227/120 |
| 7,661,571 | B2 * | 2/2010 | Tsai | 227/134 |
| 7,665,643 | B2 * | 2/2010 | Huang | 227/128 |
| 7,757,923 | B2 * | 7/2010 | Huang et al. | 227/132 |
| 2007/0199971 | A1 | 8/2007 | Chen | |
| 2007/0227286 | A1 | 10/2007 | Kandasamy | |
| 2009/0120992 | A1 | 5/2009 | Kandasamy | |
| 2009/0120993 | A1 | 5/2009 | Kandasamy | |
| 2009/0159637 | A1 | 6/2009 | Maemori | |

FOREIGN PATENT DOCUMENTS

| | | |
|---|---|---|
| GB | 792108 | 3/1958 |
| GB | 83556 A | 10/1960 |
| JP | 2002001679 | 1/2002 |
| JP | 2004209619 | 7/2004 |
| JP | 2005138247 | 6/2005 |
| JP | 2005138248 | 6/2005 |
| WO | 2007055298 | 5/2007 |

* cited by examiner

*Primary Examiner* — Rinaldi I. Rada
*Assistant Examiner* — Michelle Lopez

(57) ABSTRACT

The mid-zone pressing tool has a base and a pressing assembly, which are pivotally connected at the rear by a transverse shaft. A pair of cantilevers extends forward from each side of an uppermost rear portion of the base. A pair of arms is connected on the distal ends by a common handle. A first coupling connects a middle portion of each arm to the pressing assembly by an axle, cam or link. A second coupling connects the proximal ends of each arm to the cantilever by an axle, cam or link. Pushing the handle down pivots the arms, engages the couplings, and transmits a concentrated downward force to the front of the pressing assembly. The cantilevers allow a range of coupling placements, including near the middle of the pressing tool. The couplings are optionally releasable.

23 Claims, 36 Drawing Sheets

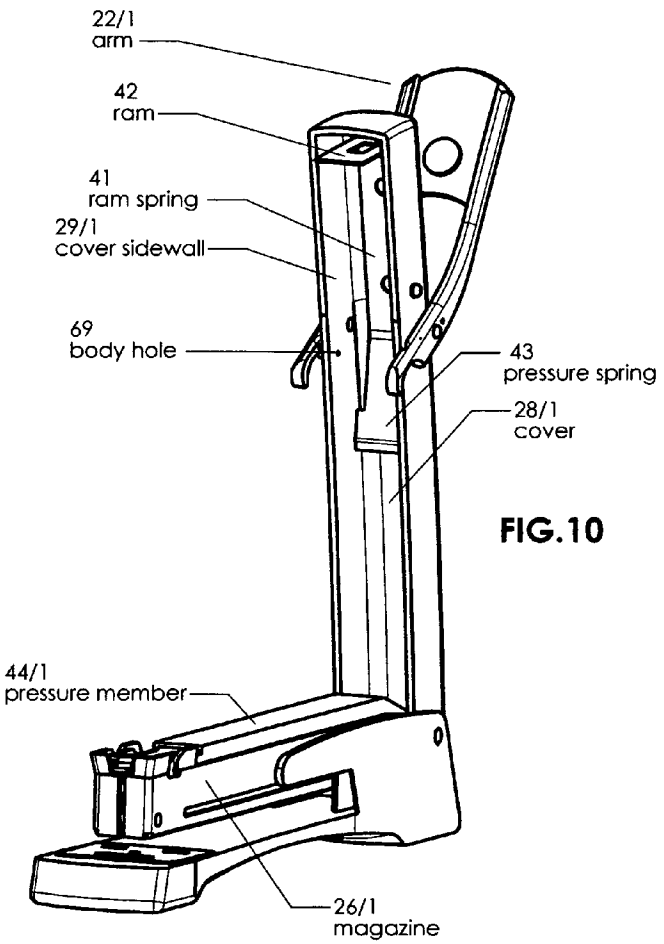
FIG.10
FIG.8
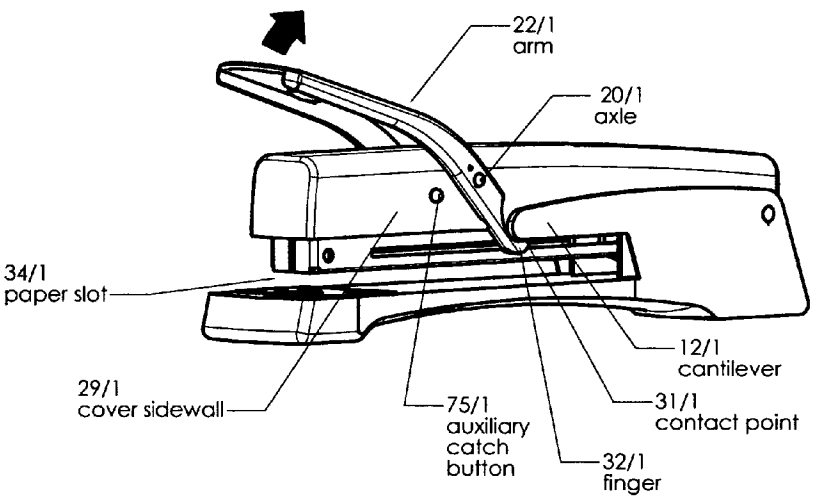
FIG.9
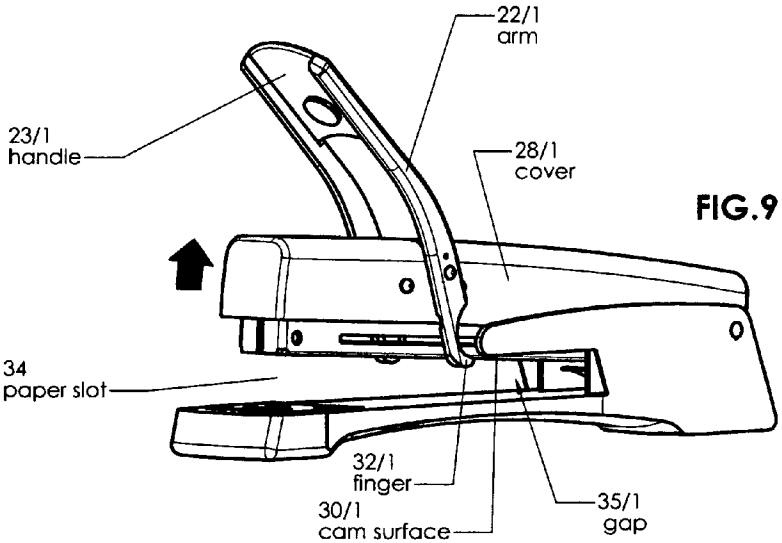

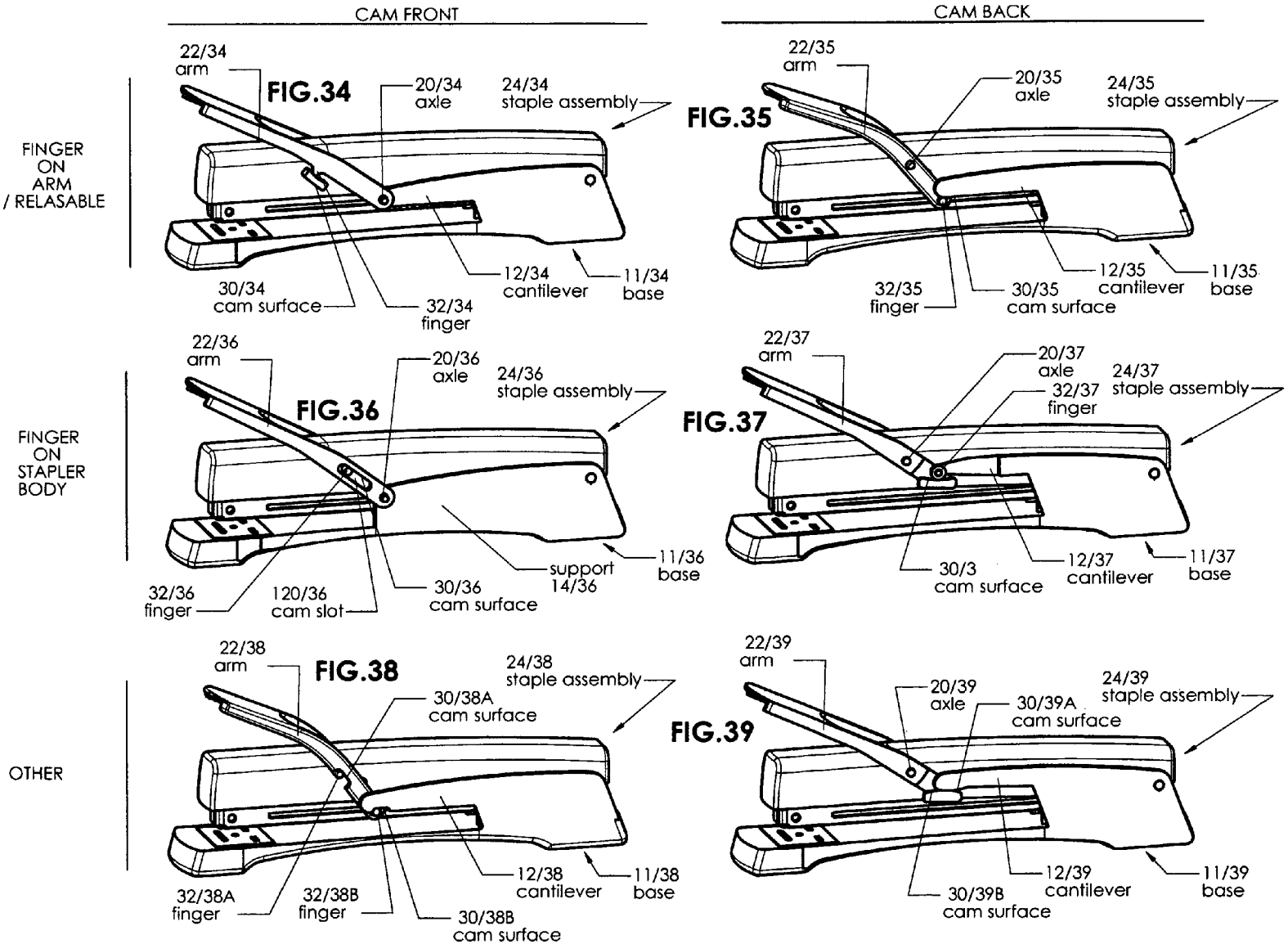
CAM BACK
CAM FRONT
FIG.35
22/35 arm
20/35 axle
24/35 staple assembly
11/35 base
12/35 cantilever
30/35 cam surface
32/35 finger
FIG.37
22/37 arm
20/37 axle
32/37 finger
24/37 staple assembly
11/37 base
12/37 cantilever
30/3 cam surface
FIG.39
22/39 arm
20/39 axle
30/39A cam surface
24/39 staple assembly
11/39 base
12/39 cantilever
30/39B cam surface
FIG.34
22/34 arm
20/34 axle
24/34 staple assembly
11/34 base
12/34 cantilever
32/34 finger
30/34 cam surface
FIG.36
22/36 arm
20/36 axle
24/36 staple assembly
11/36 base
support 14/36
30/36 cam surface
120/36 cam slot
32/36 finger
FIG.38
22/38 arm
30/38A cam surface
24/38 staple assembly
11/38 base
12/38 cantilever
30/38B cam surface
32/38B finger
32/38A finger
FINGER ON ARM / RELASABLE
FINGER ON STAPLER BODY
OTHER 74/46
auxiliary
catch
button
28/46
cover
22/46
arm
32/46
finger 28/46
cover
shaft 46
26/46
magazine 26/46
magazine
28/46
cover
30/46
cam surface
16/46
platform
11/46
base
10/46
base assembly cover 28/63
punch body 98
18/63 anvil
cylinder 100/63
hole 109/63
base 16/63 cylinder 100/63
punch body 98 slot 106
punch block 110
cylinder 100/63
punch body 98
hole punch 96
bridge 102
backer 104 cover 28E
notch 108
hole punch 96 stapler block 112
punch block 110
hole 109/63 punch block 110
magazine 26/63
stapler block 112
cylinder 100/63

DETAIL C
SCALE 2 : 1

DETAIL D
SCALE 2 : 1

DETAIL G
SCALE 1.5 : 1

MID-ZONE STAPLER OR PRESSING TOOL

FIELD OF THE INVENTION

This invention relates to manually powered pressing tools that reduce the force necessary for operation by using compound leverage to create mechanical advantage. It includes pressing tools such as staplers, hole punches, and embossing tools that modify sheet material.

BACKGROUND OF THE INVENTION

The basic problem with most pressing tools is the amount of force required for operation. For staplers, the problem is pushing the stapler down and stapling papers together. When using a standard stapler on a tabletop, users typically must reorient their arms to accomplish this task. While ergonomically flawed, this force is needed to push the staple through multiple sheets of paper and to cinch the staple shut. Many users address this problem by using the stapler in a handheld manner, using forearm muscles to actuate the stapler. This method is somewhat adequate for a few sheets of paper. But when more sheets are stapled together, the force required is too great and users typically return the stapler to the table, stands up and pushes down the stapler using full body weight. Considering the stapler is such a ubiquitous device, a better, more ergonomic solution is long overdue.

There are three general categories of solutions to this problem. First are electric staplers, second are staple-gun-style desktop staplers, and third are leverage-type staplers.

The first solution, the electric stapler, provides power so strength is no longer an issue. Foremost among the drawbacks of the electric stapler are higher costs, the need for electricity, and the cord.

The second solution, the staple-gun-style desktop stapler, patent U.S. Pat. No. 5,356,063, is manually powered. This eliminates the need for cord or power source. It uses the staple gun approach of loading and suddenly releasing a spring to drive in a staple. This is a time-proven approach, but it has five shortcomings.

A) Like the electric stapler, it fires a staple. This means it has the same problem of being loud and very sudden.

B) The second problem is that maximum spring loading force is required whether two pages or twenty pages are being stapled. This requires users to input the maximum force every time and gives no control over the impact level on the staple.

C) Another problem is that its spring mechanism makes it taller than an ordinary stapler.

D) The mechanism is not as scalable, preventing the staple gun from being made into a small, inexpensive stapler. For example, standard existing staplers come in inexpensive small-scale versions that are only about three inches long and an inch tall.

E) The last problem is that the spring mechanism tends to weaken over time.

Leverage

The third solution, using leverage to improve a stapler, comes in two basic forms. One is simple leverage; the other is compound leverage.

The simple leverage stapler just extends a handle beyond the point where the staple exits. This would be considered a second class lever because the input of force is at the end of the lever while the output is in the middle of the lever. A common variation has an extending handle that pivots off a different axle than the stapler's axle. The problem with these solutions is that the stapler must be quite large in order to get a substantial increase in leverage. The simple lever staplers are suitable for copy room or specialized uses, but are too large to be used as desktop staplers.

Simple Leverage

The patent, U.S. Pat. No. 6,179,193 by Mikio Nagai, is a good example of the simple lever stapler. It's worth noting that the handle on the Nagai patent almost looks like a compound lever, but it's not. It pushes down directly onto the staple it's firing and not onto the top of the stapler. Accordingly, the frontmost of the two lever pivots must be located directly above the staple to be fired. Hence a substantial portion of the lever must stick out in front of the stapler.

Because it sticks out beyond the point of stapling, the simple lever has another disadvantage: it blocks visibility of the area being stapled. This is particularly problematic in staplers that are not tall. The less vertical distance between the simple lever and the staple cinching anvil, the more the view is blocked. The Swingline model 3786x stapler by Acco Brands Inc. is a prime example of this problem. {No patent number}

Compound Leverage

The second method of improved leverage is the compound leverage stapler, which involves two levers interacting with each other. The first lever is the stapler assembly itself, a third class lever with the output and fulcrum on each end and the input in between.

The second lever is a second class lever with the input and fulcrum on each end and the output in between. The output from the second lever becomes the input into the first lever, creating a compound lever. The fulcrums of both levers connect to the stapler's base.

Compactness is a major advantage of using a compound lever. It allows the second lever to stay within the length footprint of the stapler, by putting its output behind the point of stapling.

There are four relevant patents disclosing the use of compound leverage for stapler operation: GB853,556, GB792,108, U.S. Pat. No. 6,550,661, and JP2004,209,619.

GB853,556 & GB792,108

The first two, GB853,556 and GB792,108 are holders designed to hold an existing stapler. The most significant flaw with these two patents is that the push levers pushes to the back of the stapler, causing three problems: 1) The activation forces are away from the actual stapling operation, making the stapling operation more awkward and unstable; 2) Users, expecting to push down on the front of the stapler, must rehabituate themselves; and 3) The back is more difficult to reach. Additionally, the holders cost nearly as much to make as the staplers, must be stapler specific, and result in a larger and bulkier solution. Furthermore, both staplers confine the lever pivot point to the front of the stapler, in order to in order to open the holders and remove the staplers. This limits the design potential.

Aoki U.S. Pat. No. 6,550,661

The Aoki U.S. Pat. No. 6,550,661 patent shows improvement over the previous patents in that the compound leverage system is a permanently integrated part of the stapler and has a push lever that pushes down in front. However, it has a very serious flaw, a rotationally supporting shaft 16 and a pin 17 are too close to the axle 8 at the rear of the stapler. Because of Aoki's use of compound leverage, this creates a huge concentration of force on shaft 16 and pin 17. This large force creates two problems.

The first problem is that the concentration of force causes disfigurement of the pivot points and cam surfaces. A second problem is a significant increase in friction. The third problem is that smaller movements require greater precision and higher tolerance manufacturing.

The catastrophic combination of increased force with smaller, more precise movement, means the mechanism does not run smoothly; is much more difficult and expensive to manufacture; is more prone to malfunction, and wears out sooner.

Another problem with the Aoki stapler is opening it. Because the pin 17 is permanently trapped in the elongated hole 18, Aoki has created an engaging groove 15 that allows the handle member 5 to release from the rotational supporting shaft 16. However, this increases the mechanical complexity, costs, and increases the chances of mechanical failure. It also makes access more difficult for users because the driver arm 3 has to be in the proper angular orientation for the rotation supporting shaft 16 to disengage and reengage with the engaging groove 15.

Finally, the stapler can be opened to insert new staples but it appears that it cannot be used to staple in the opened-up tacking configuration used, e.g., to staple at a sheet of paper to the wall. The rotational supporting shaft 16 would interfere with the upward rotation of the magazine member 2.

Patent JP2004,209,619

Patent JP2004,209,619 is the fourth example of compound leverage staplers. It suffers the same problem as the Aoki patent U.S. Pat. No. 6,550,661. It does not move the lever's axle far enough forward, away from the staple axle.

However, it is attempting a somewhat different objective: it wants to center the pushing force in the middle of the stapler. Thus the handle has to be near the center, putting the lever fulcrum and pivot at the rear of the stapler. Rather than focusing on the reduction of operating force, this design creates a dome shape to accommodate the palm of the hand. This allows users to push harder, i.e. increase the operating force.

The problems with the JP2004,209,619 patent are many. It does not achieve significant, if any, mechanical advantage. There is considerable stress on the lever fulcrum and pivot. It's much bulkier and has a larger footprint. Its support walls on each side of the base are long and, accordingly, its paper access slot is very short. It does not adapt well to being used as a hand-held stapler.

The following is a brief overview of the patent application disclosure for the mid-zone stapler.

SUMMARY INTRODUTION

The MID-ZONE STAPLER has four major components. The first two, a base and a stapling assembly, are typical of existing staplers and are pivotally connected at the rear, or second end, by a common transverse shaft. The staple is ejected at the front, or first end, of the stapling assembly.

The remaining two major components are an arm and a pair of cantilevers. The pair of cantilevers extends forward from each side of an uppermost rear portion of the base. Each arm has a handle on the distal end, has a proximal end, and a middle portion in between. A first coupling connects each middle portion to the stapler assembly by an axle, cam or link. A second coupling connects each proximal end to the cantilever by an axle, cam or link.

When the handle is pushed down, both arms pivot using both couplings, and force is transmitted from the arms to the stapler assembly; moving the front of the stapler assembly downward.

A gap between each cantilever and the lower portion of the base allows the two couplings to be placed near the middle of the stapler. The mid-zone stapler components, and their arrangement, provide a smooth, reliable, and inexpensive stapling action with an approximately 300% gain in leverage.

One of the two couplings is optionally releasable, allowing the handle to rotate up and back, in turn allowing the stapler assembly to open.

ALTERNATE EMBODIMENTS

This is a very brief description of the mid-zone stapler. Later in this text, significant aspects of the mid-zone stapler will be added to, detailed, clarified and altered. This will include disclosing that the mid-zone stapler's leverage mechanism can also be applied to a variety of manually operated pressing tools and that the mid-zone stapler can accommodate a second, independently operating, pressing tool. Also as part of disclosing alternatives, a coupling table, shown in table 1, is provided organizing and specific outlining thousands of combinations of alternative arm couplings to the stapler assembly and base using a variety of pivots, cams, and links.

Note: for simplicity, when referring to bilaterally paired symmetric parts, they will sometimes be referred to in this text and in the claims in the singular (E.g. "pair of cantilevers"="cantilever.")

BRIEF DESCRIPTION OF THE DRAWINGS

FIG. 8 shows cover pivot stapler in a ready configuration.

FIG. 9 shows cover pivot stapler in a disengaged configuration.

FIG. 10 shows cover pivot stapler in a partially open configuration.

FIG. 20 is a perspective view of a link type stapler in a stapled configuration.

FIG. 34 is a perspective view of an alternate embodiment of a cam type stapler, shown in a ready configuration.

FIG. 35 is a perspective view of an alternate embodiment of a cam type stapler, shown in a ready configuration.

FIG. 36 is a perspective view of an alternate embodiment of a cam type stapler, shown in a ready configuration.

FIG. 37 is a perspective view of an alternate embodiment of a cam type stapler, shown in a ready configuration.

FIG. 38 is a perspective view of an alternate embodiment of a cam type stapler, shown in a ready configuration.

FIG. 39 is a perspective view of an alternate embodiment of a cam type stapler, shown in a ready configuration.

FIG. 40 is a perspective view of an alternate embodiment of a cam slide type stapler, shown in a ready configuration.

Figure 57:
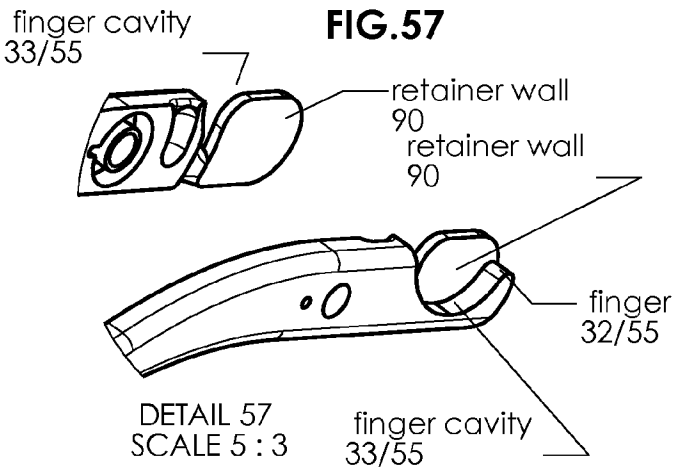

No FIG. 57

Figure 58:
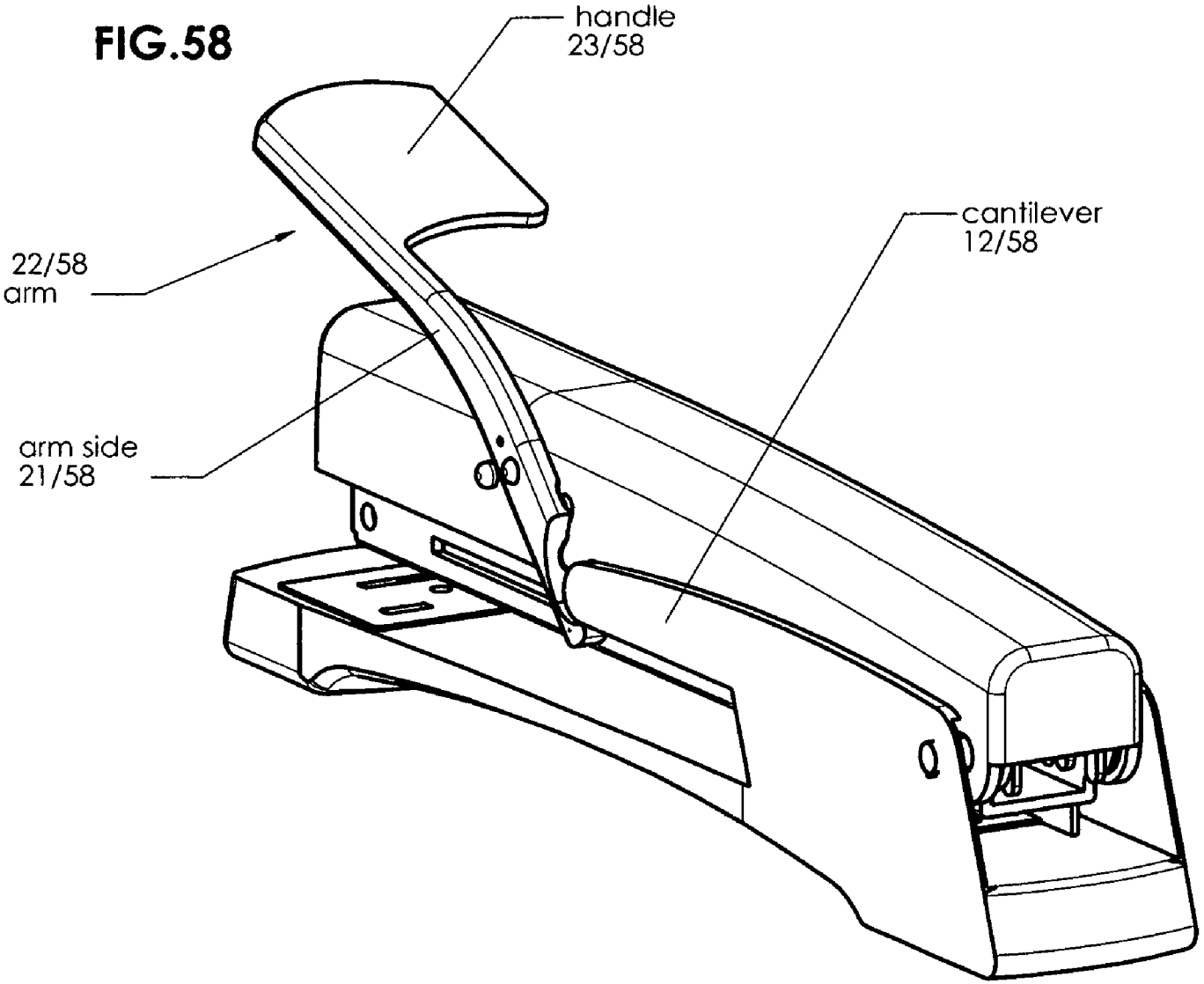

FIG. 58 is a rear perspective view of the FIG. 58 stapler in a ready configuration.

Figures 59, 60:
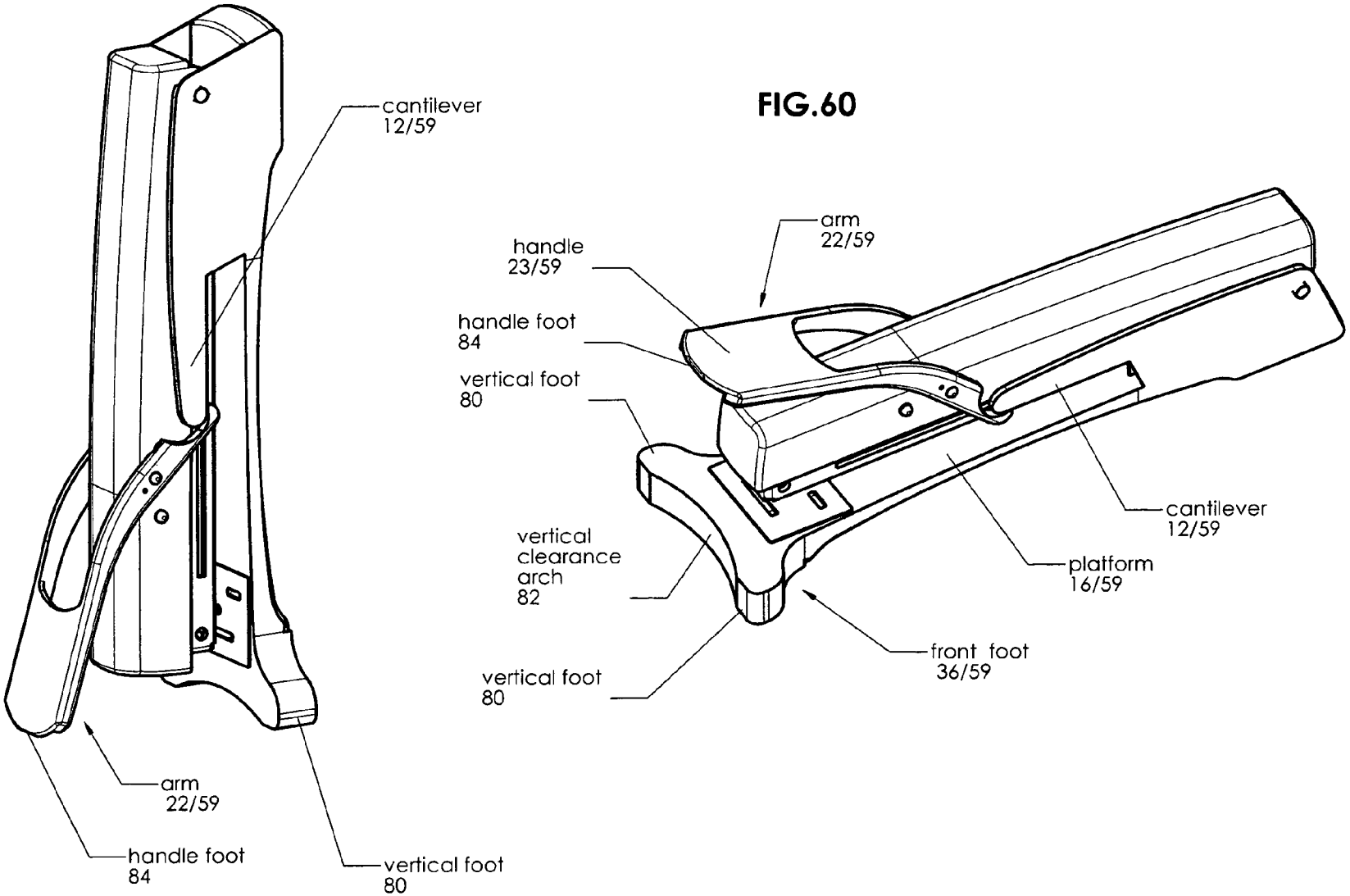

FIG. 59 is a perspective view of an alternate embodiment of a mid-zone stapler, vertically oriented, in ready configuration.

FIG. 60

FIG. 60 is a perspective view of the FIG. 59 stapler, horizontally oriented, in ready configuration.

Figure 61:
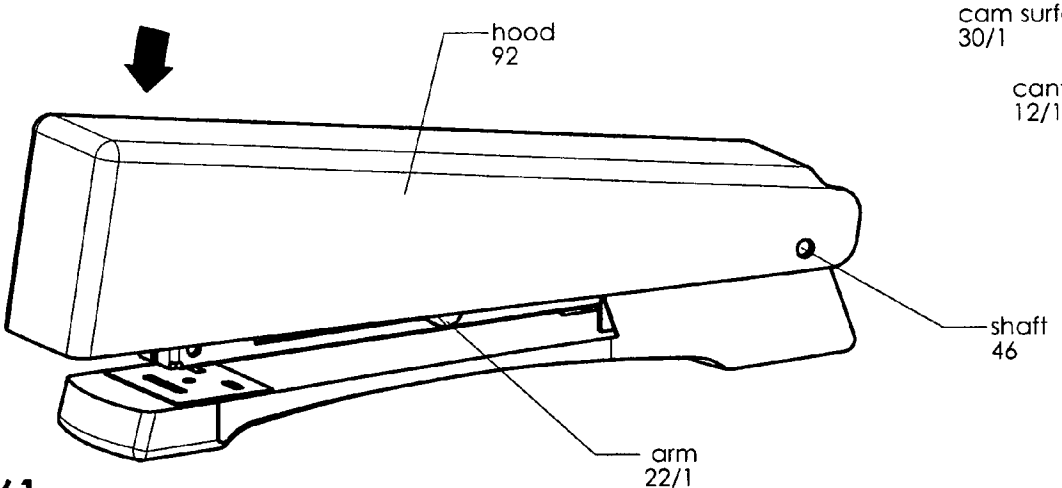

FIG. 61 is a perspective view of an alternate embodiment of a mid-zone stapler in a ready configuration.

Figure 62:
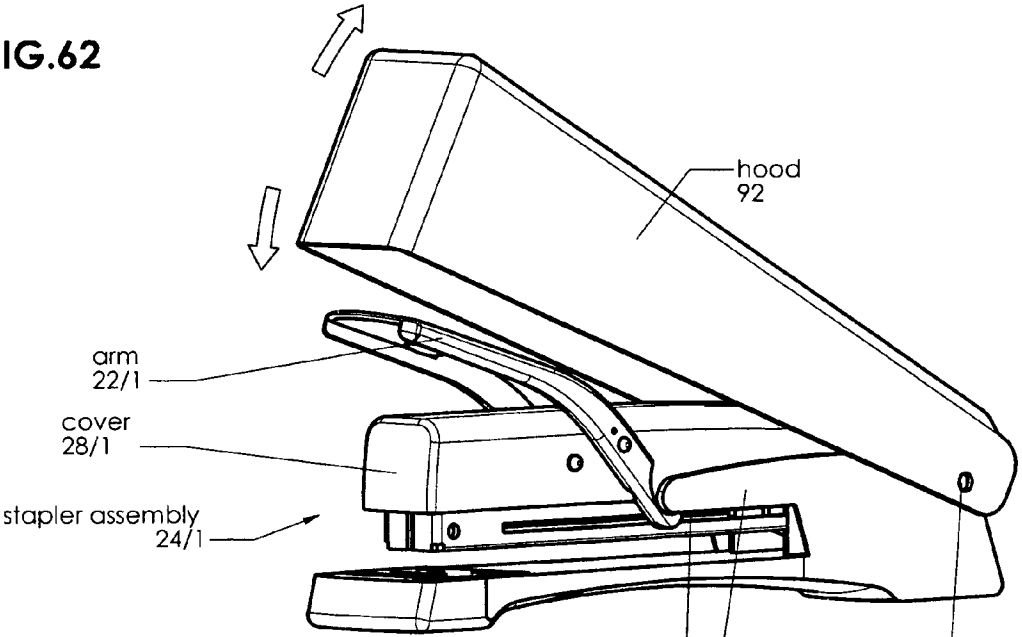

FIG. 62 is a perspective view of the FIG. 61 stapler with hood 92 raised.

Figures 63, 64, 65, 66, 67, 68:
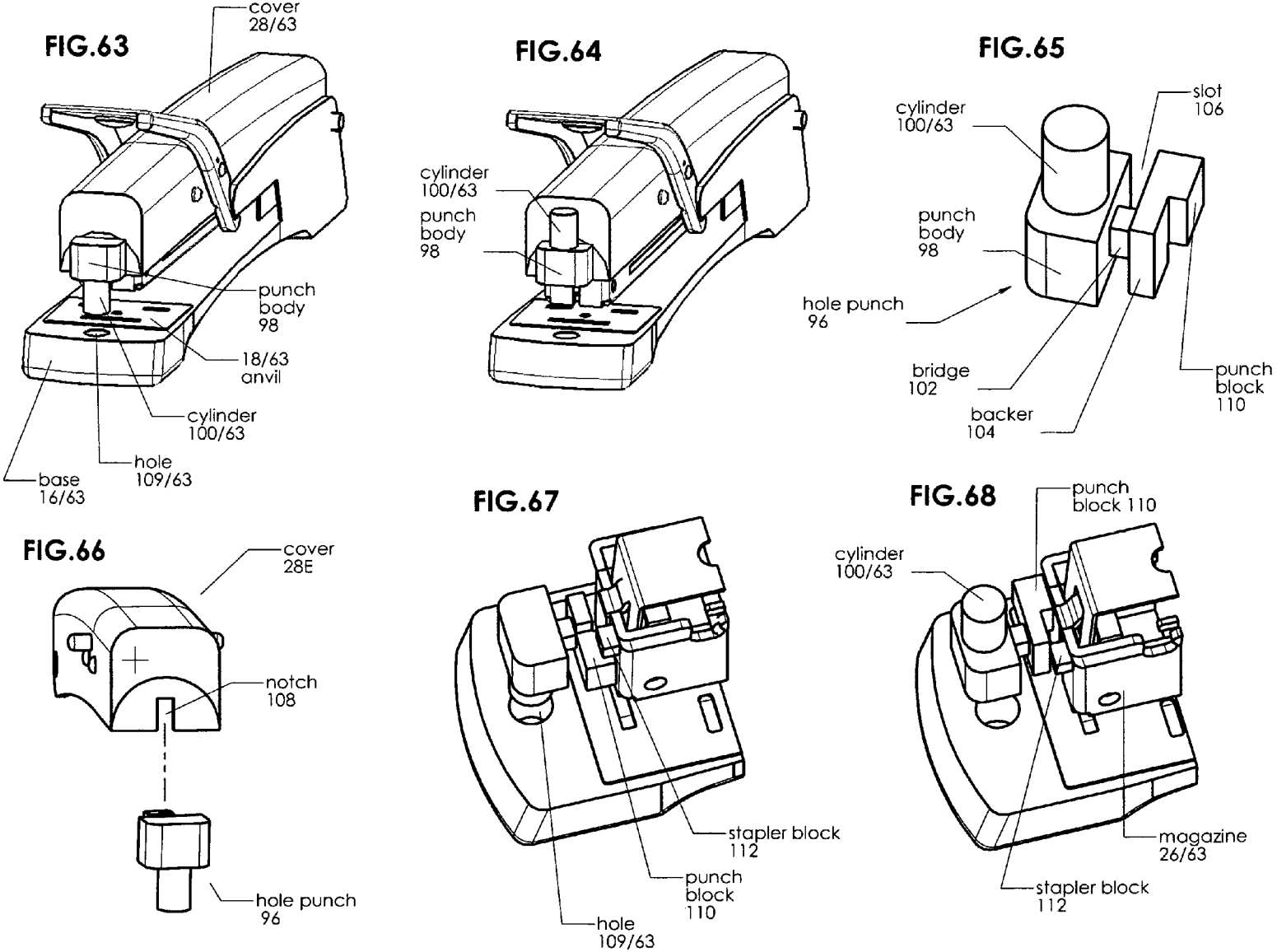

FIG. 63 is a perspective view of an alternate embodiment of a mid-zone stapler in a ready-to-punch configuration.

FIG. 64 is a perspective view of the FIG. 63 stapler in a ready-to-staple configuration.

FIG. 65 is a perspective view of hole punch 96.

FIG. 66 is a perspective view of hole punch 96 attachment and removal.

FIG. 67 is a detail view of hole punch interaction in ready-to-punch configuration.

FIG. 68 is a detail view of hole punch interaction in ready-to-staple configuration.

Figure 69:
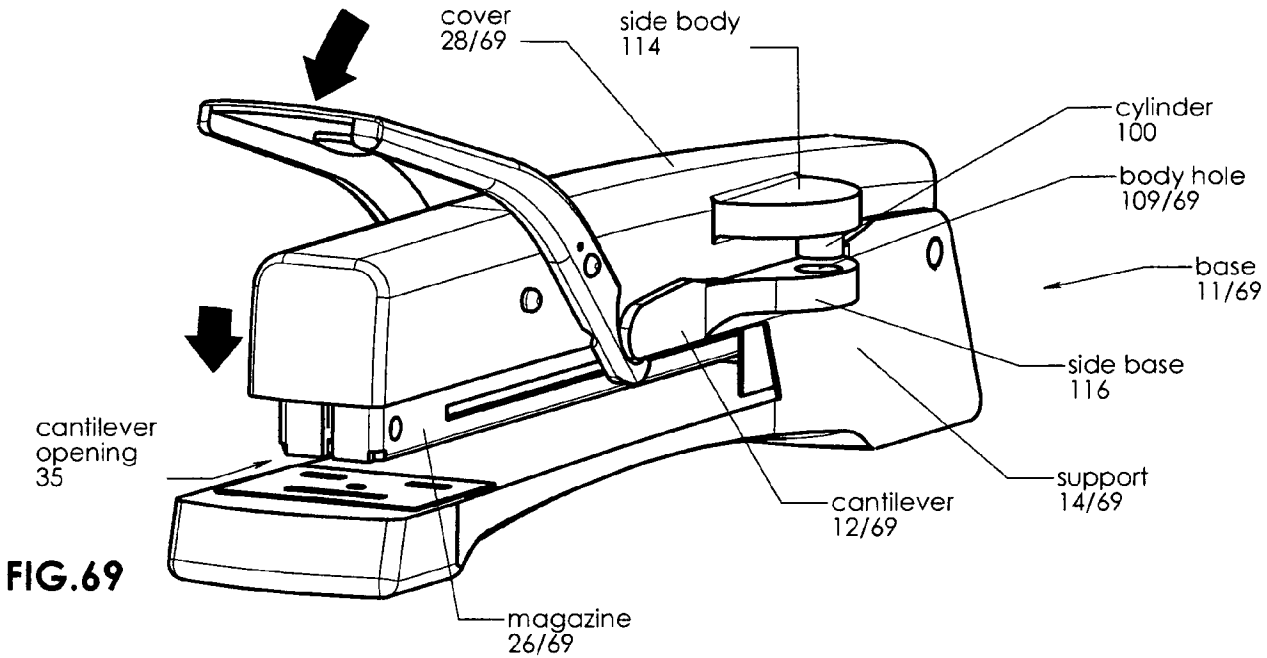
Figure 70:
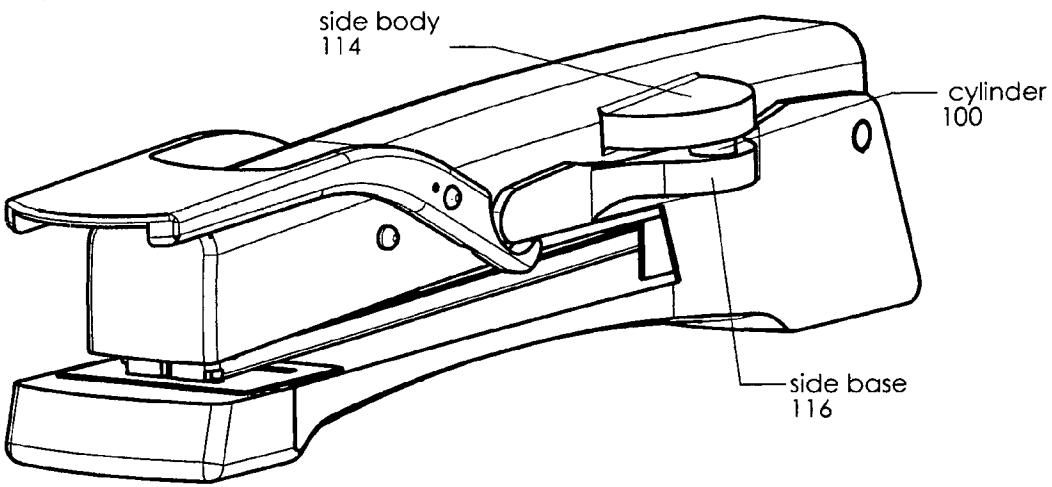
Figure 71:
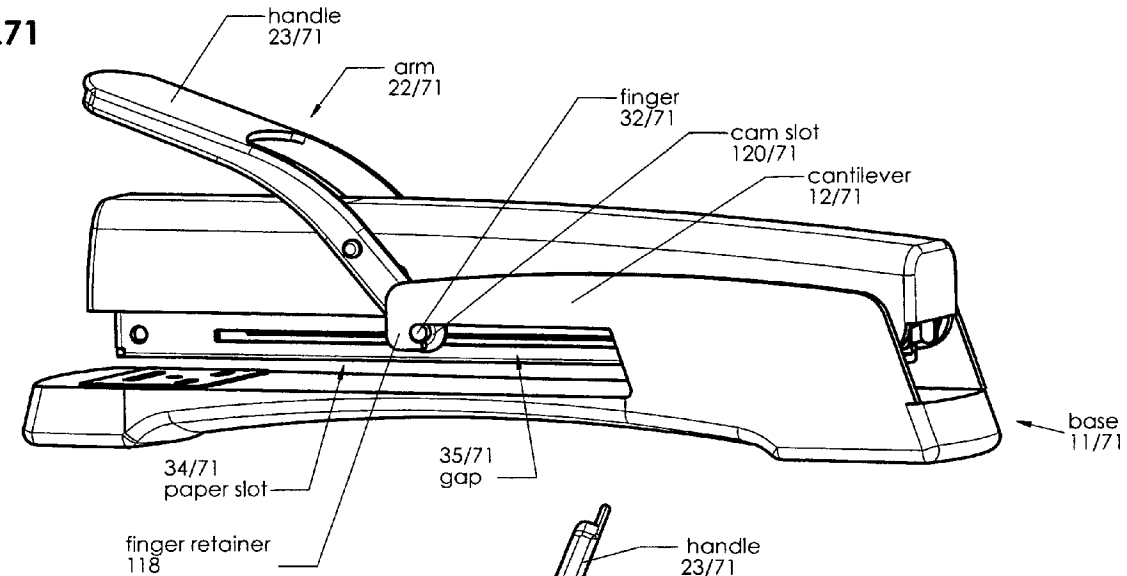

FIG. 69 is a perspective view of an alternate embodiment of a mid-zone stapler in a ready configuration FIG. 70 is a perspective view of the FIG. 69 stapler in a stapled configuration FIG. 71 is a perspective view of an alternate embodiment of a mid-zone stapler in a ready configuration, with a finger retainer 118.

Figure 72:
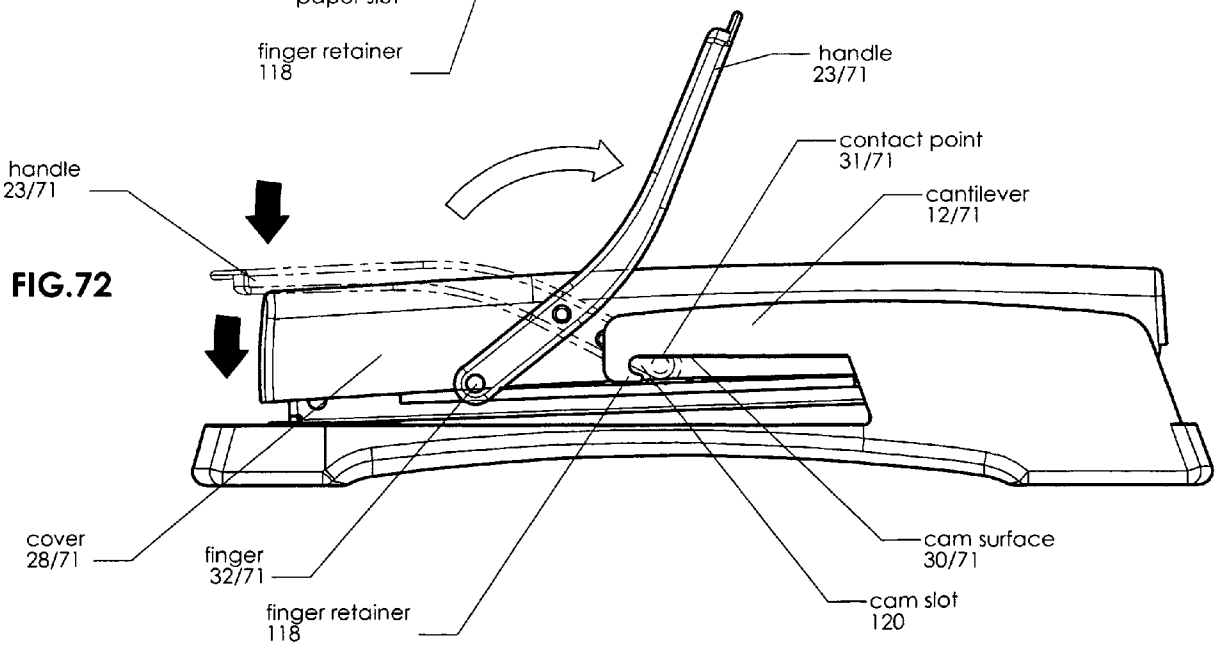

FIG. 72 side view of the FIG. 71 stapler in a stapled configuration, showing arm 22 rotation.

Figures 73, 74, 75:
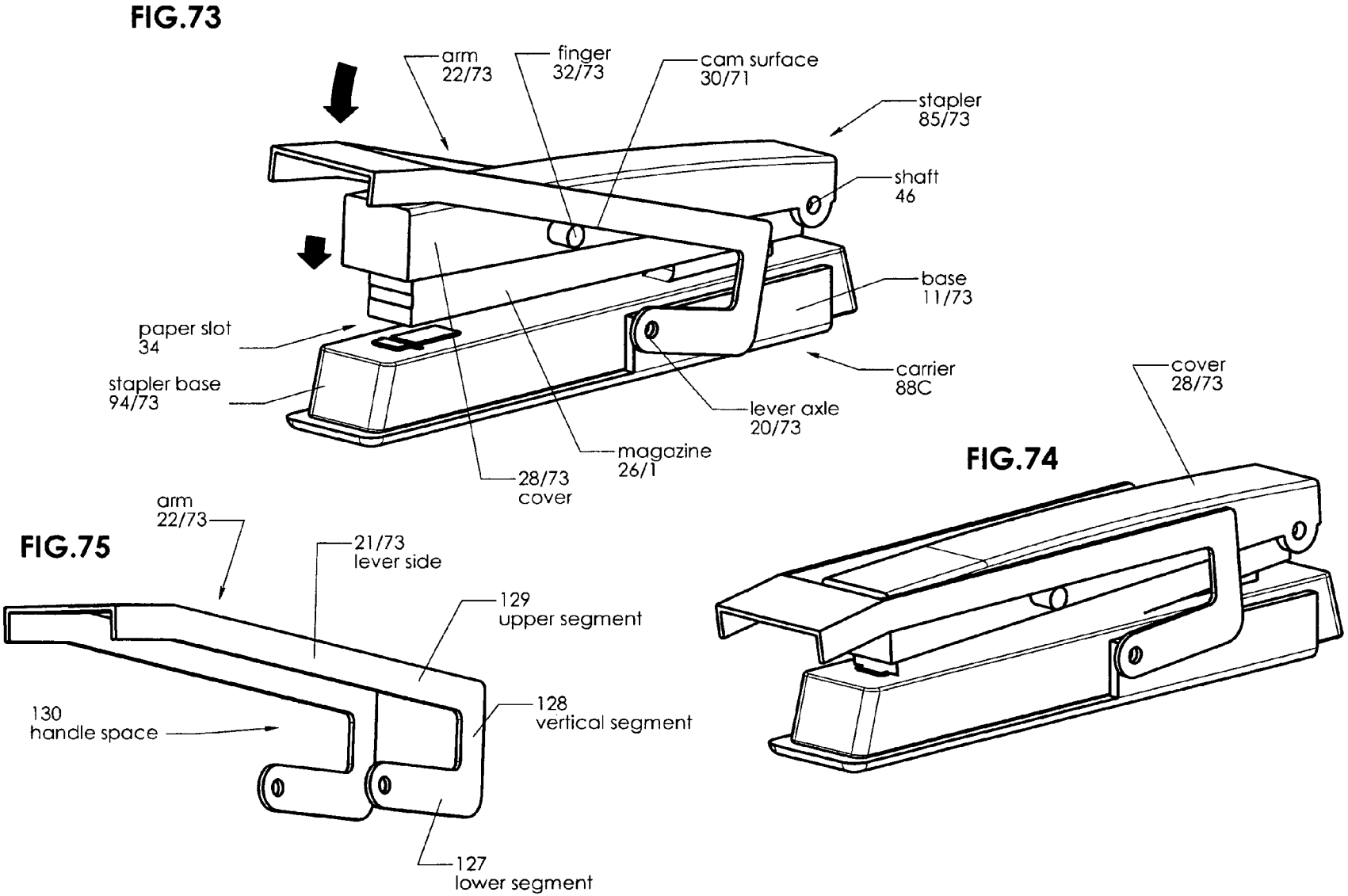

FIG. 73 is a perspective view of an alternate embodiment of a mid-zone stapler in a ready configuration, with a cantilever style arm 22.

FIG. 74 is a perspective view of the FIG. 73 stapler in a stapled configuration.

FIG. 75 is a perspective view of cantilever style arm 22.

Figure 76:
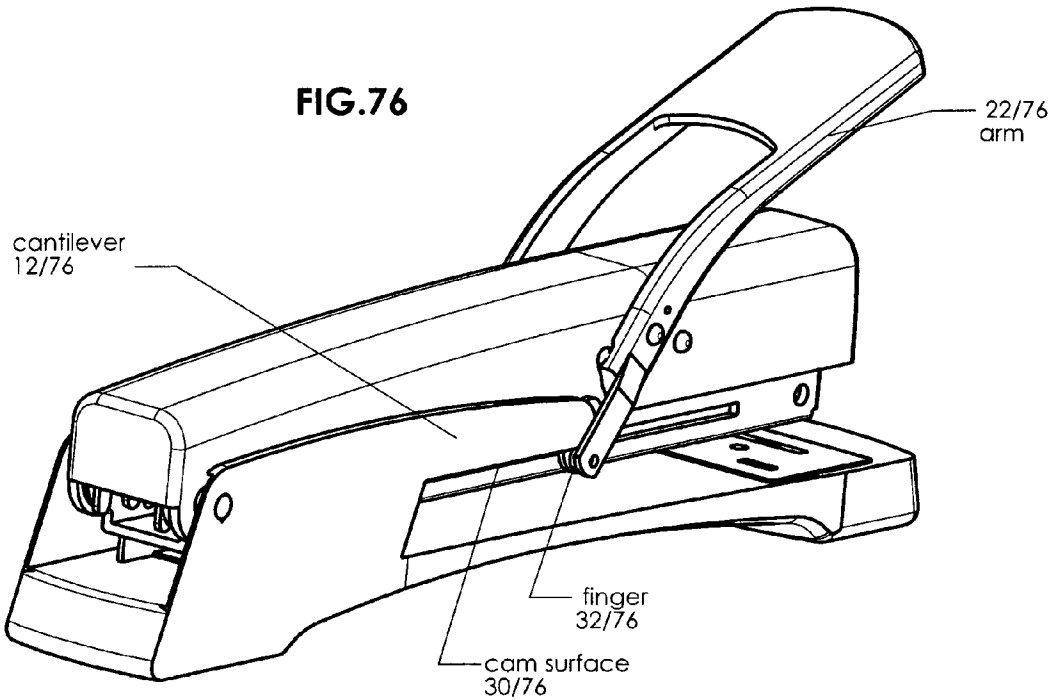

FIG. 76 is a perspective view of an alternate embodiment of a mid-zone stapler in a ready configuration, with an alternative embodiment of finger 32.

Figure 77A:
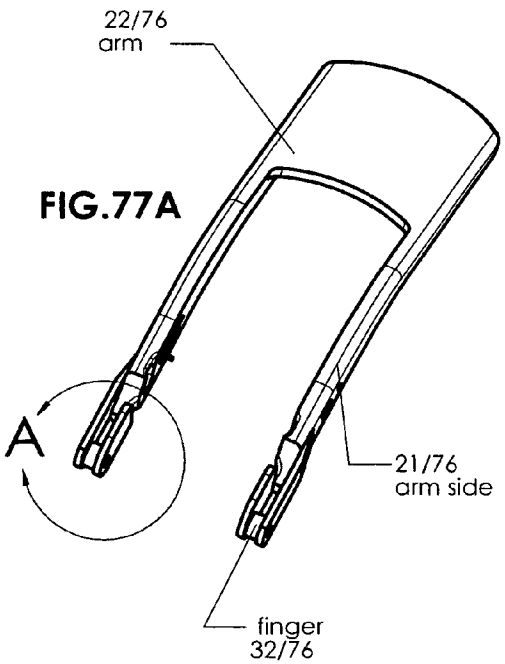

FIG. 77A is a perspective view of arm 22, with the alternative embodiment of finger 32.

Figure 77B:
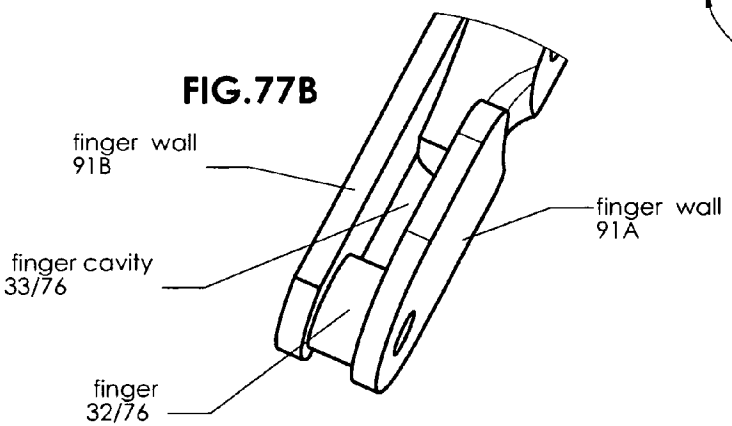

FIG. 77B is a detail view of the alternative embodiment finger 32.

Figure 78:
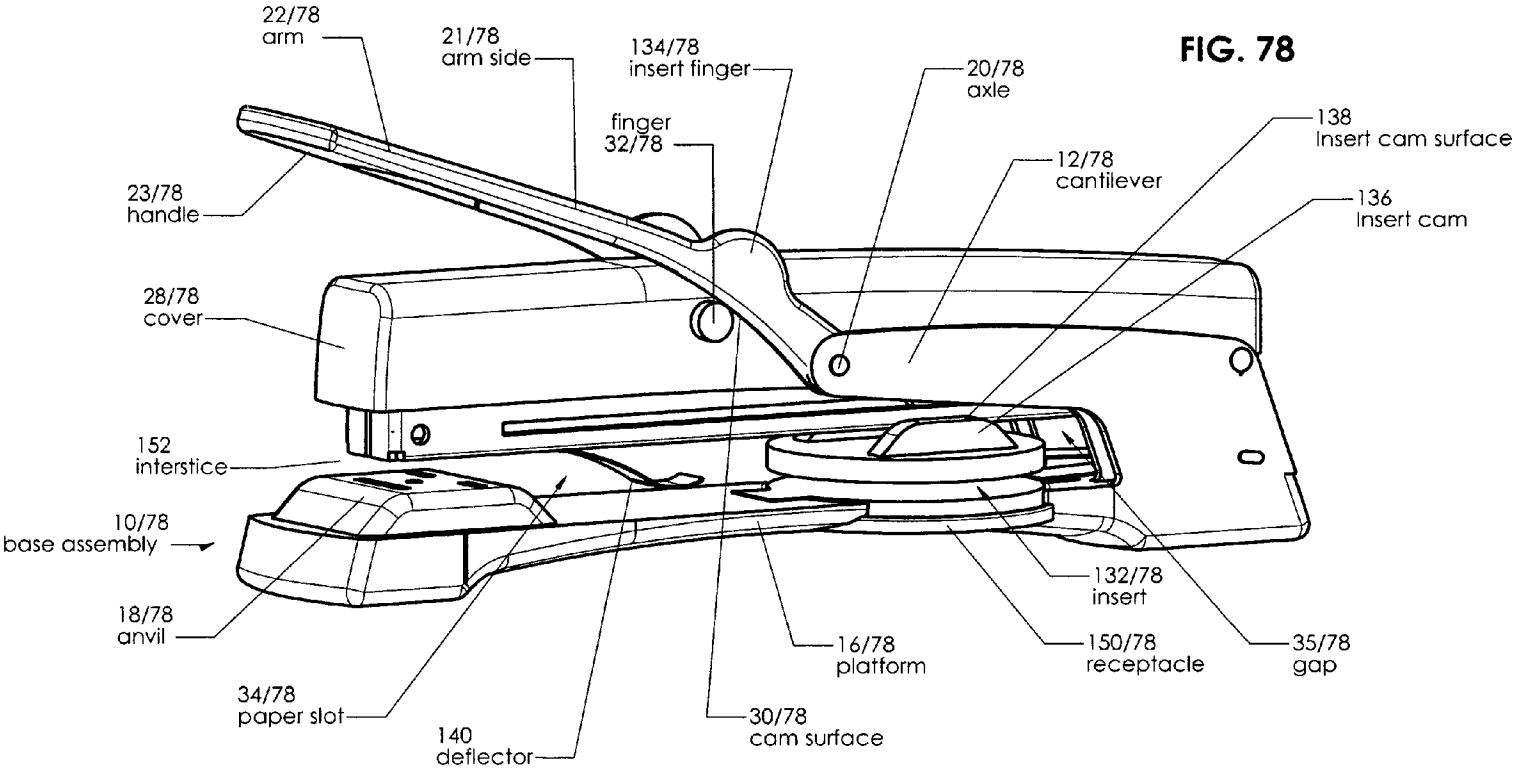

FIG. 78 is a perspective view of a tool stapler as an alternate embodiment of a mid-zone stapler, in a ready configuration.

Figure 79:
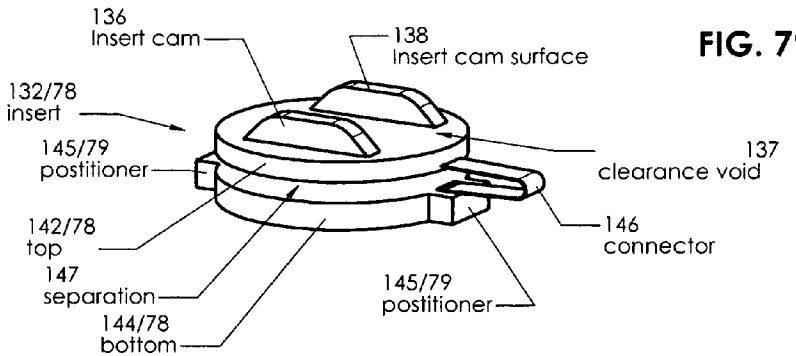

FIG. 79 is a perspective view of insert 132.

FIG. 80

Figure 80:
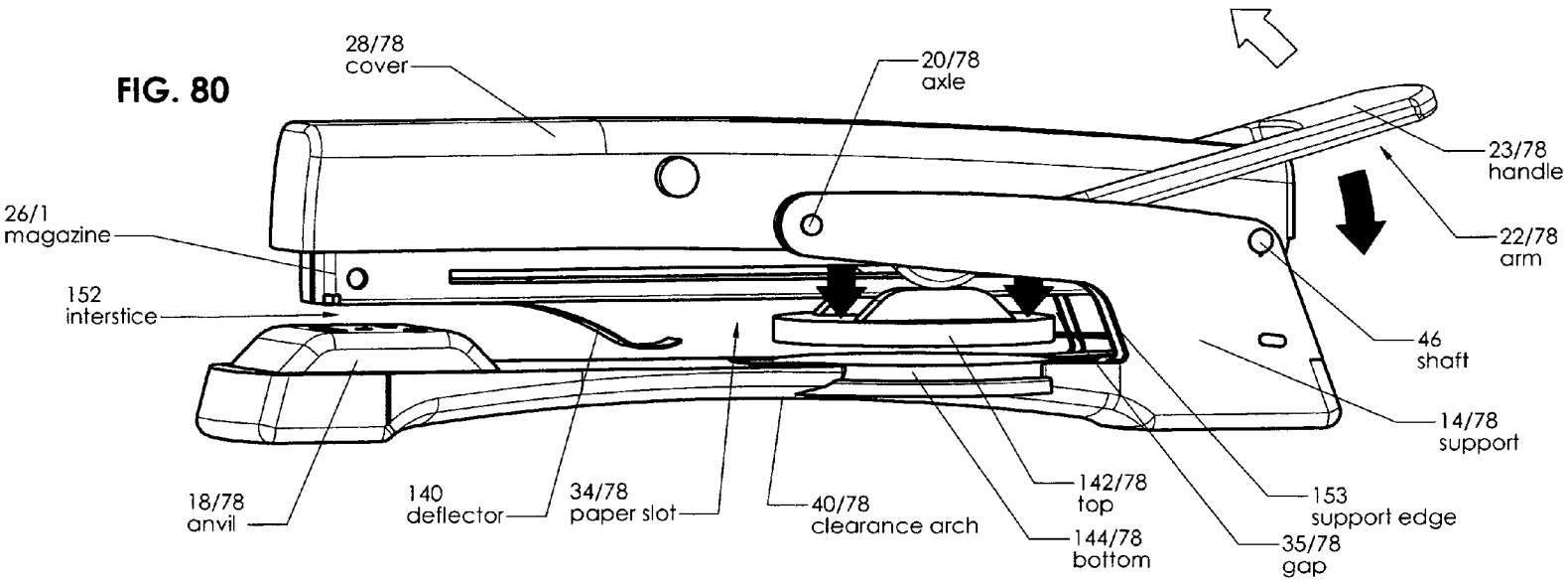

FIG. 80 is a perspective view of FIG. 78 stapler in a initiating configuration.

Figure 81:
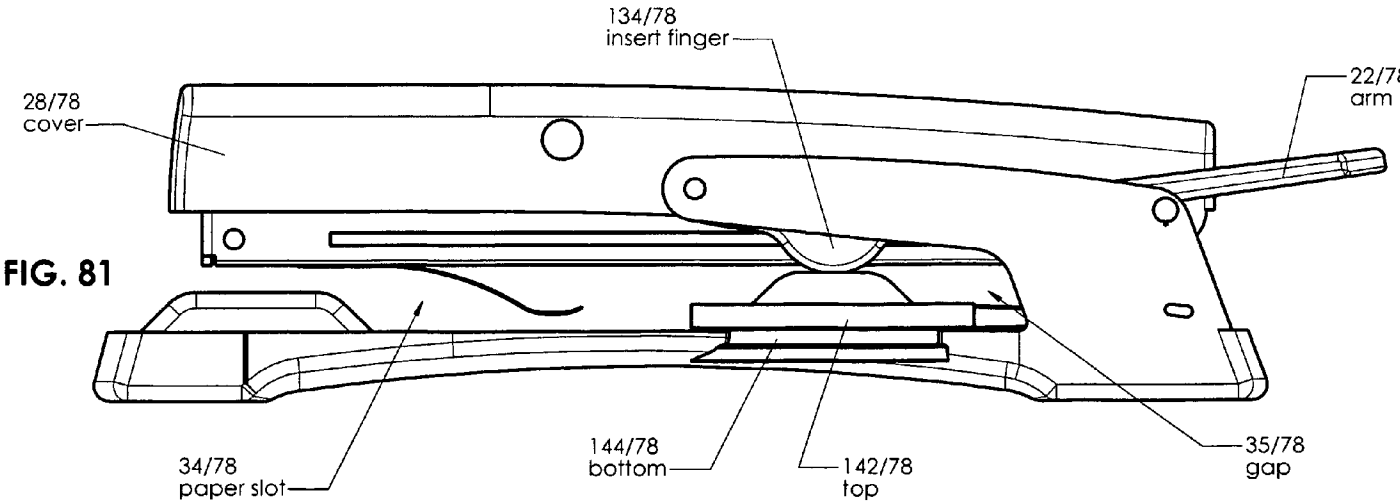

FIG. 81 is a perspective view of FIG. 78 stapler in a pressed configuration.

Figures 82, 83:
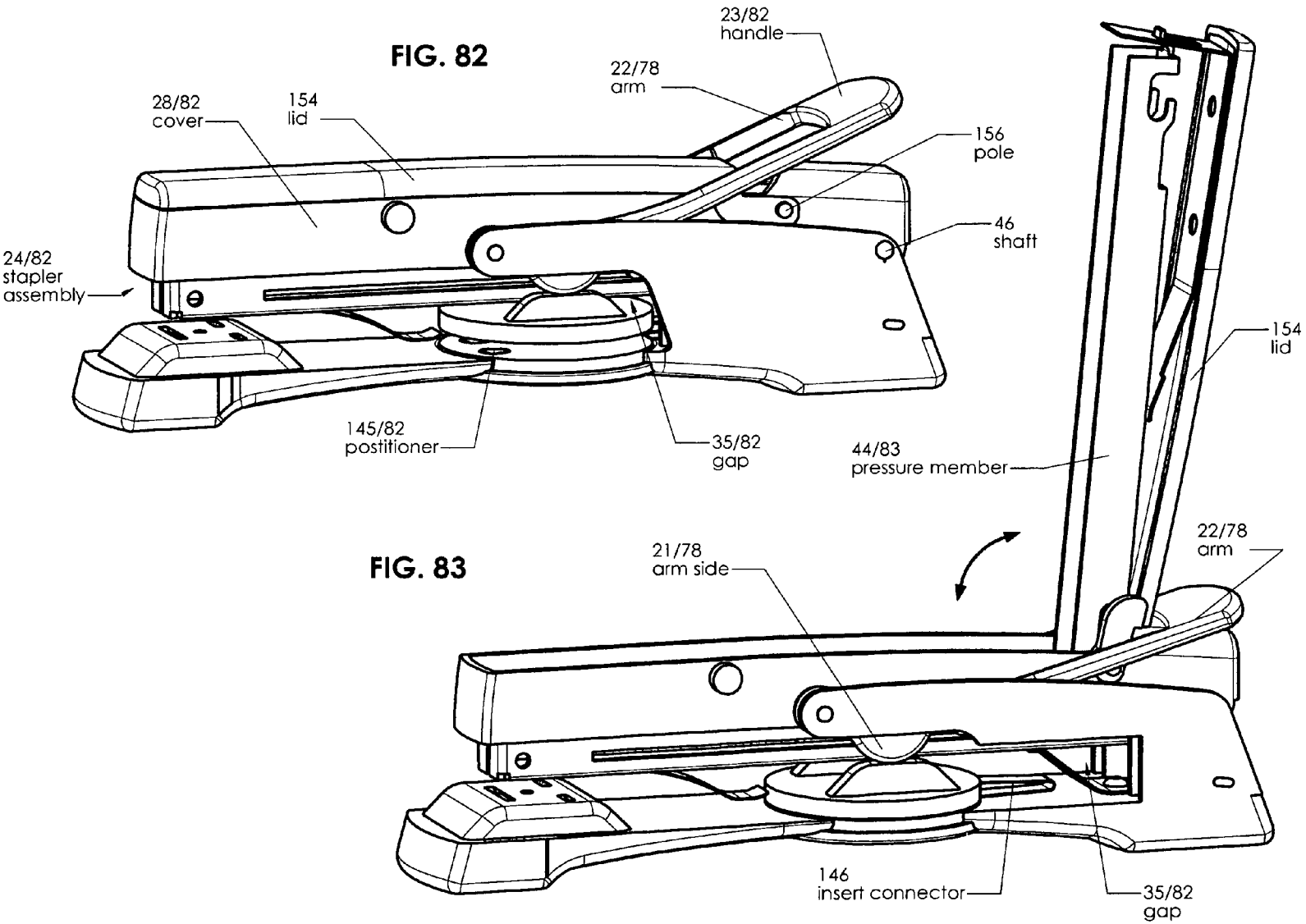

FIG. 82 is a perspective view of an alternate embodiment of a tool type stapler, with an alternate staple access mechanism, shown in a initiating configuration.

FIG. 83 is a perspective view of FIG. 82 stapler in a open configuration.

Figure 84:
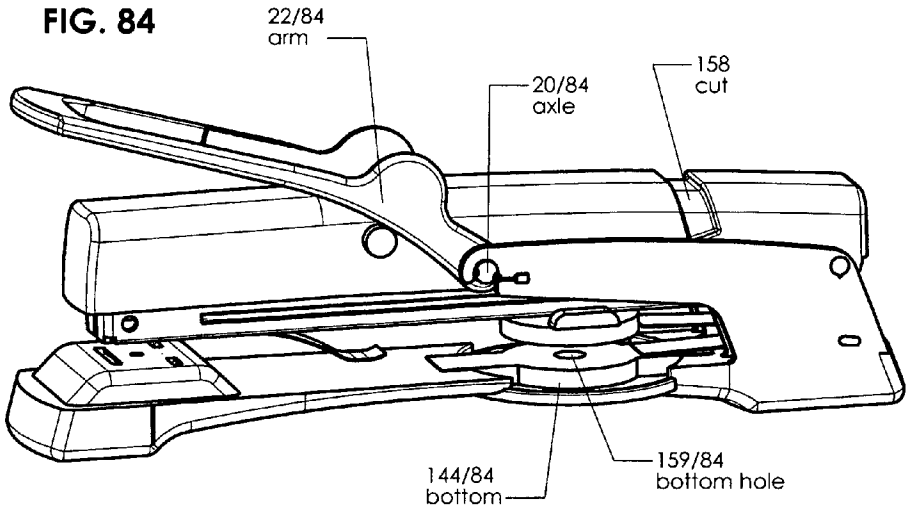

FIG. 84 is a perspective view of an alternate embodiment of a tool type stapler, with an alternate staple access mechanism and arm retention mechanism, shown in a ready configuration.

Figure 85:
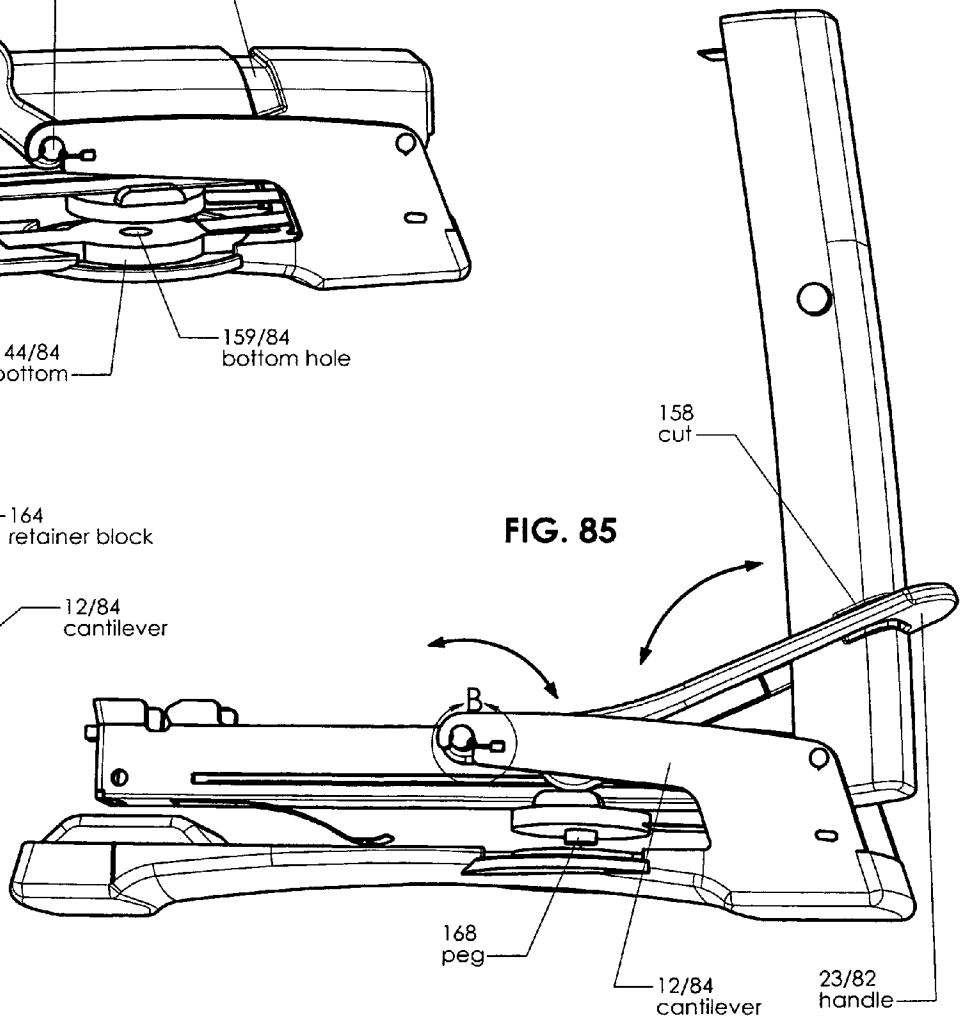

FIG. 85 is a perspective view of FIG. 84 stapler in a open configuration.

Figure 86:
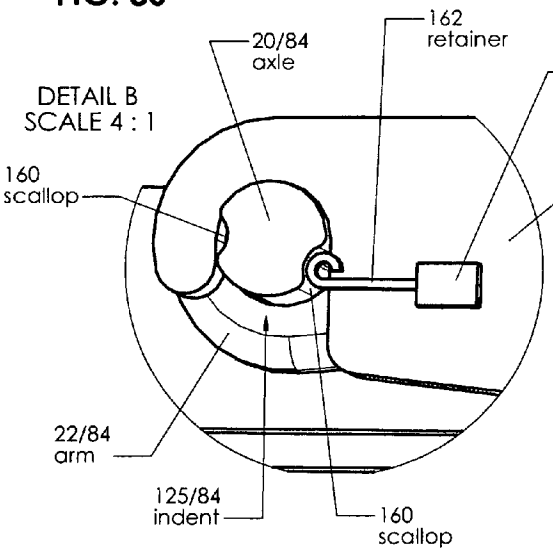

FIG. 86 is a detail view of arm retention mechanism.

Figure 87:
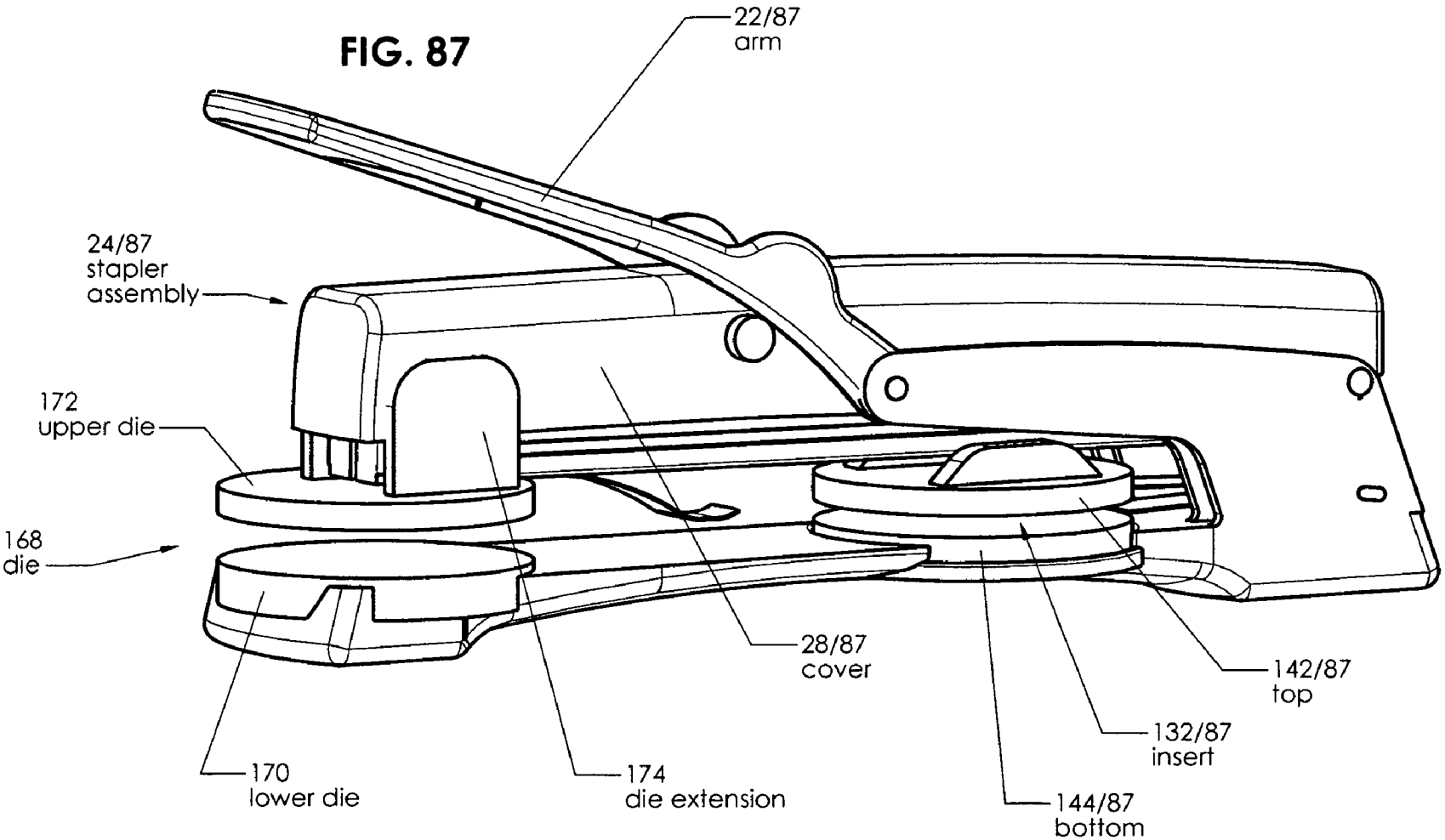

FIG. 87 is a perspective view of an alternate embodiment of a tool type stapler, shown in a ready configuration.

Figure 88:
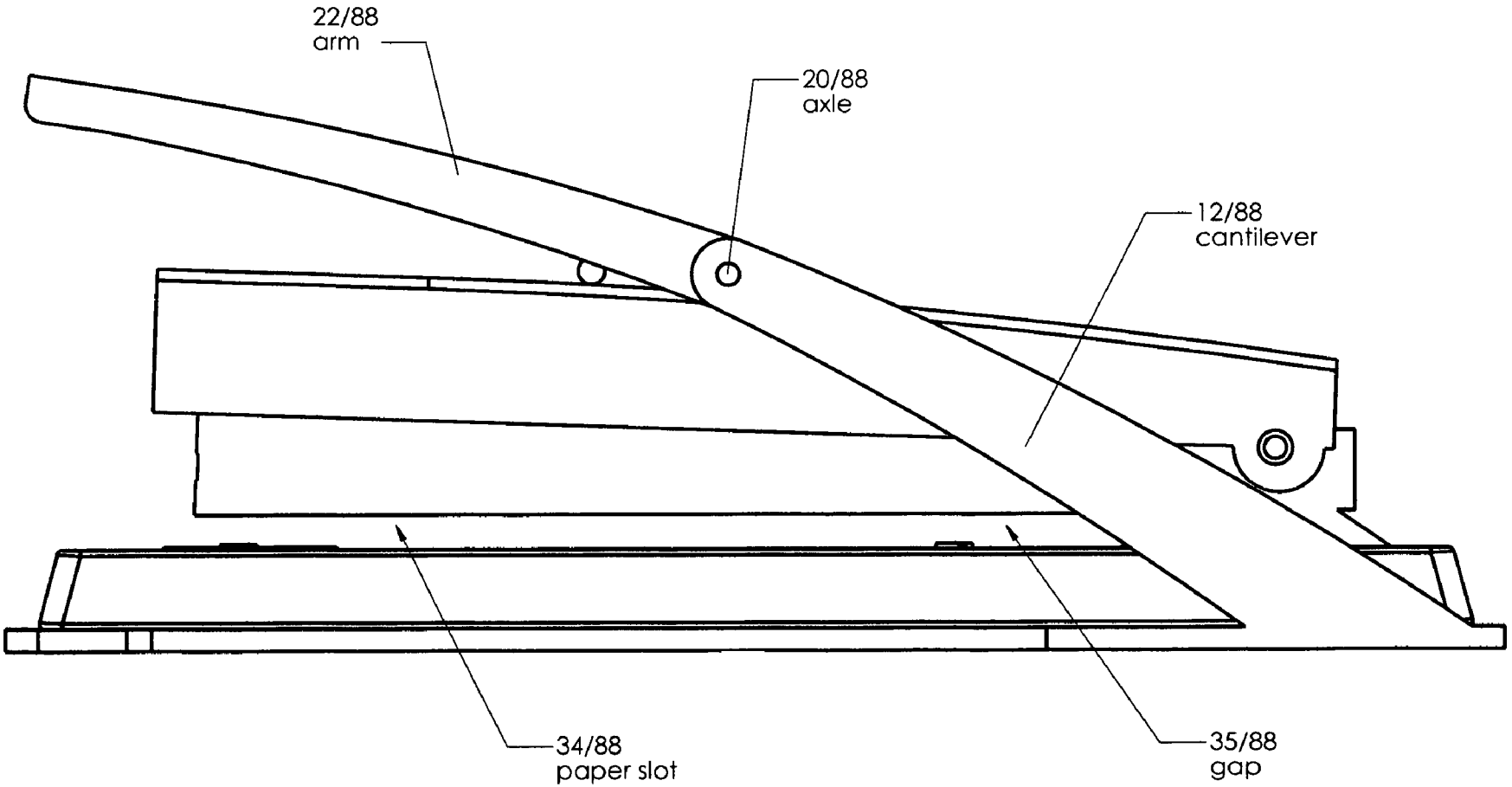

FIG. 88 side view of an alternate embodiment of a tool type stapler, with die 168 and insert 132, shown in a ready configuration.

Figure 89A:
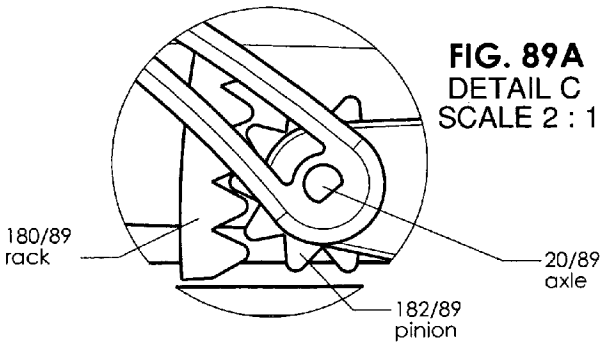
Figure 89:
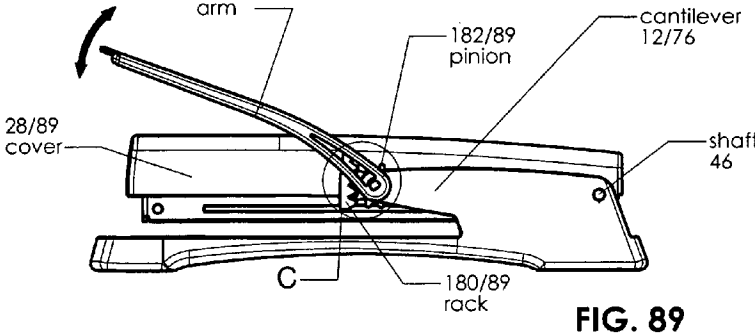

FIG. 89 is a side view of a rack and pinion stapler.

FIG. 89A is a detail view of the FIG. 89 rack and pinion.

Figure 90:
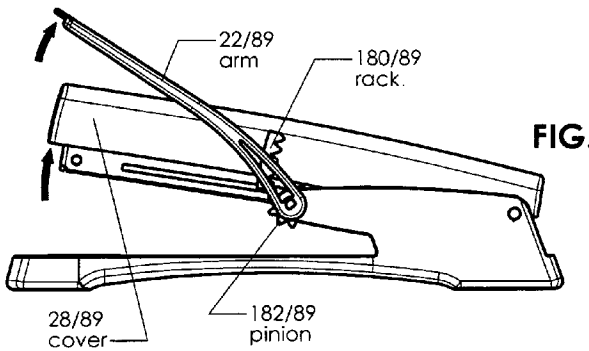

FIG. 90 is a side view of the FIG. 89 rack and pinion stapler in an initial engagement configuration.

Figure 91:
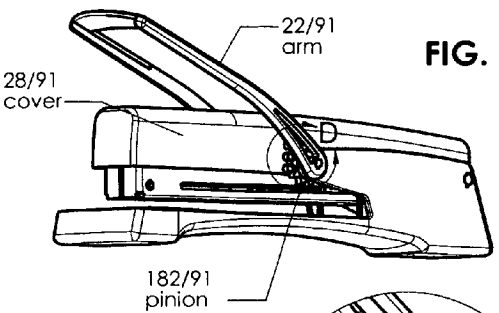

FIG. 91 is a perspective view of a alternate an embodiment of a rack and pinion stapler, introducing the use of rack posts.

Figure 91A:
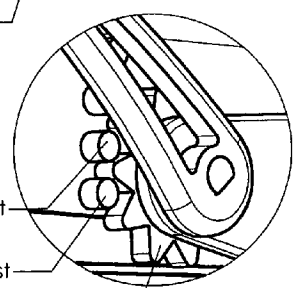

FIG. 91A is a detail view of the FIG. 91 rack and pinion.

Figure 92A:
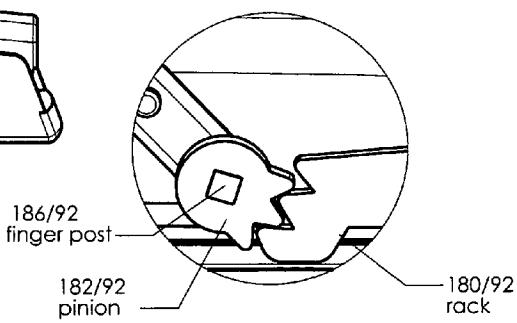
Figure 92:
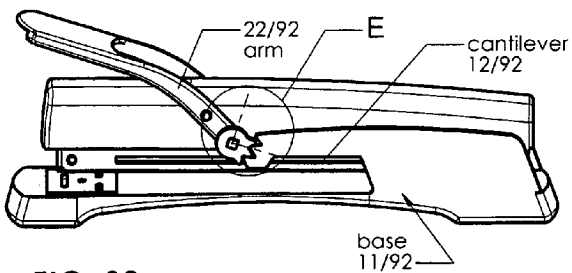

FIG. 92 is a perspective view of a alternate an embodiment of a rack and pinion stapler, introducing the use 1$^{st}$ pivot type rack and pinion.

FIG. 92A is a detail view of the FIG. 92 rack and pinion.

DRAWING NAME—REFERENCE NUMBERALS

Nomenclature

Figures 18, 19, 20:
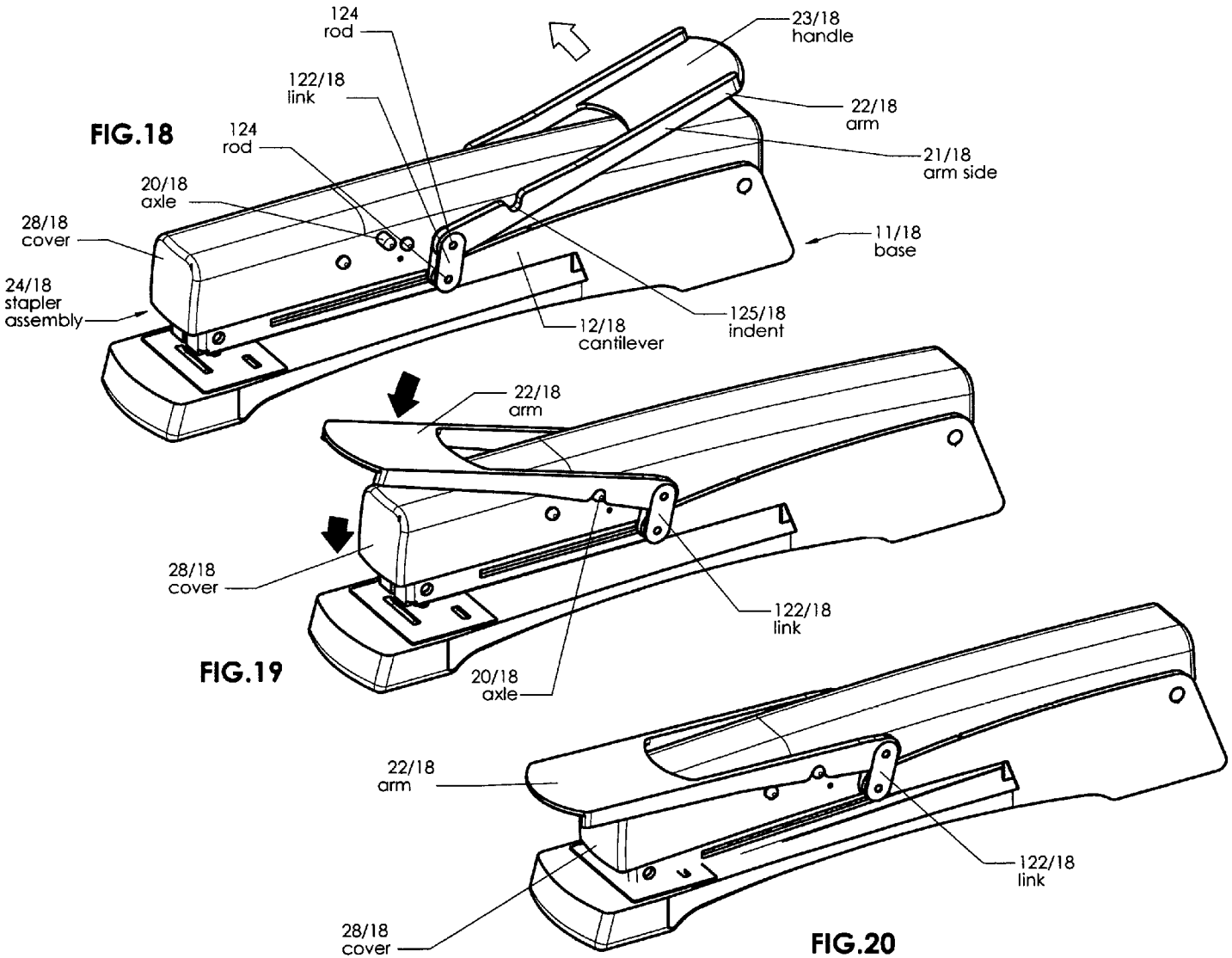
FIG. 18 is a perspective view of a link type stapler in a disengaged configuration.
FIG. 19 is a perspective view of a link type stapler in a ready configuration.
FIG. 20

For clarity's sake, the basic nomenclature of the staplers is disclosed as follows: The largest category, compound leverage staplers, refers to a class of staplers larger than the disclosure's category. It is the category that the disclosures fit within. The mid-zone stapler refers generally to a class of staplers comprising the staplers disclosed in this patent. A 1$^{st}$ pivot stapler and a 2$^{nd}$ pivot stapler reference two classes of staplers with two different pivot placements. A cover pivot stapler refers to a specific 1$^{st}$ pivot stapler first introduced in FIG. 1. A base pivot stapler refers to a specific 2$^{nd}$ pivot stapler first introduced in FIG. 46. Because there are so many, all other staplers will be referred to by the figure number in which they were first introduced. For example, the stapler introduced in FIG. 18 is referred to as a FIG. 18 stapler. There are also five other classes of staplers: a link stapler, a cam stapler, a slide cam stapler, a tool stapler, and a rack and pinion stapler. The meaning of the stapler nomenclature and class nomenclature will be clarified in later text.

The typical nomenclature for alternate embodiments of the same subcomponent is to add a letter to the existing numerical nomenclature. For example, cantilever 12 becomes cantilever 12A and cantilever 12B.

Because there are so many disclosures and subsequent alternate embodiments of subcomponents, this disclosure will use a different system. The figure number of the stapler is used to delineate alternate embodiments of subcomponents. A forward slash mark is followed by a numeral representing the number of the figure where the particular component is first shown. For example, cantilever 12/1 is used for cantilever 12 which is first shown in FIG. 1. In FIG. 18, the alternate embodiment stapler is referred to as the FIG. 18 stapler and the cantilever is referred to as cantilever 12/18.

Figure 1:
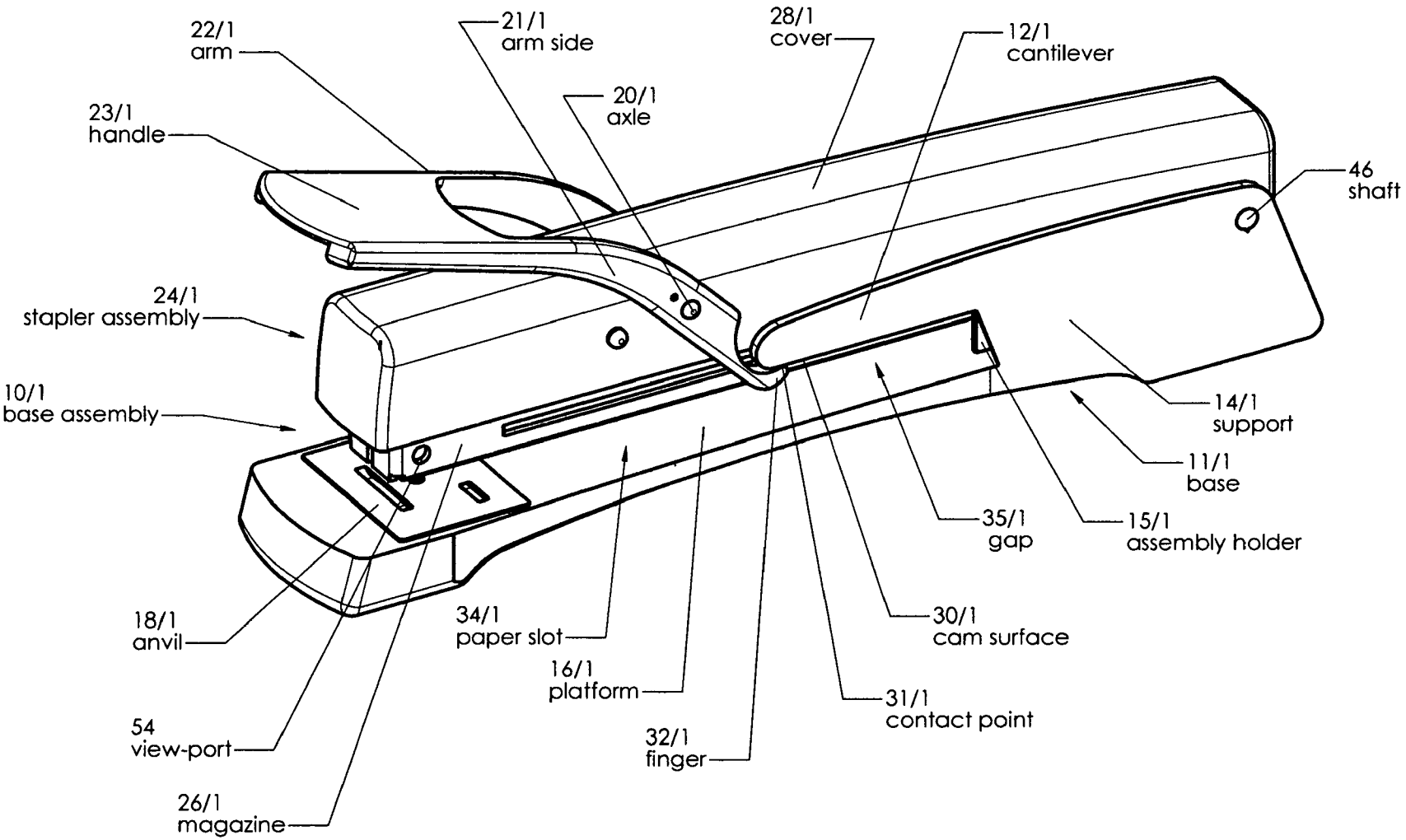
FIG. 1 shows high-angle perspective view of cover pivot stapler in a ready configuration.

When referring more broadly to a subcomponent as representing all or many of the variations of the part, or in a more generic context, a number sign "#" is used instead of the figure number. For example, cantilever 12/1 is a component of the cover pivot stapler shown in FIG. 1, and cantilever 12/46 is a component of the base pivot stapler shown in FIG. 46. Cantilever 12/# would be used to refer to both of them and the design features that they have in common. Cantilever 12, without a forward slash, would be used if there were only one example of this component and no figures of alternative components. An example of this from FIG. 1 is view-port 54, which doesn't have any disclosed alternatives. Note: in the following list of reference numerals, the ones followed by a slash mark and # indicate there are multiple embodiments of it.

Figures 21, 22, 23, 24, 25, 26, 27, 28, 29, 30, 31, 32, 33:
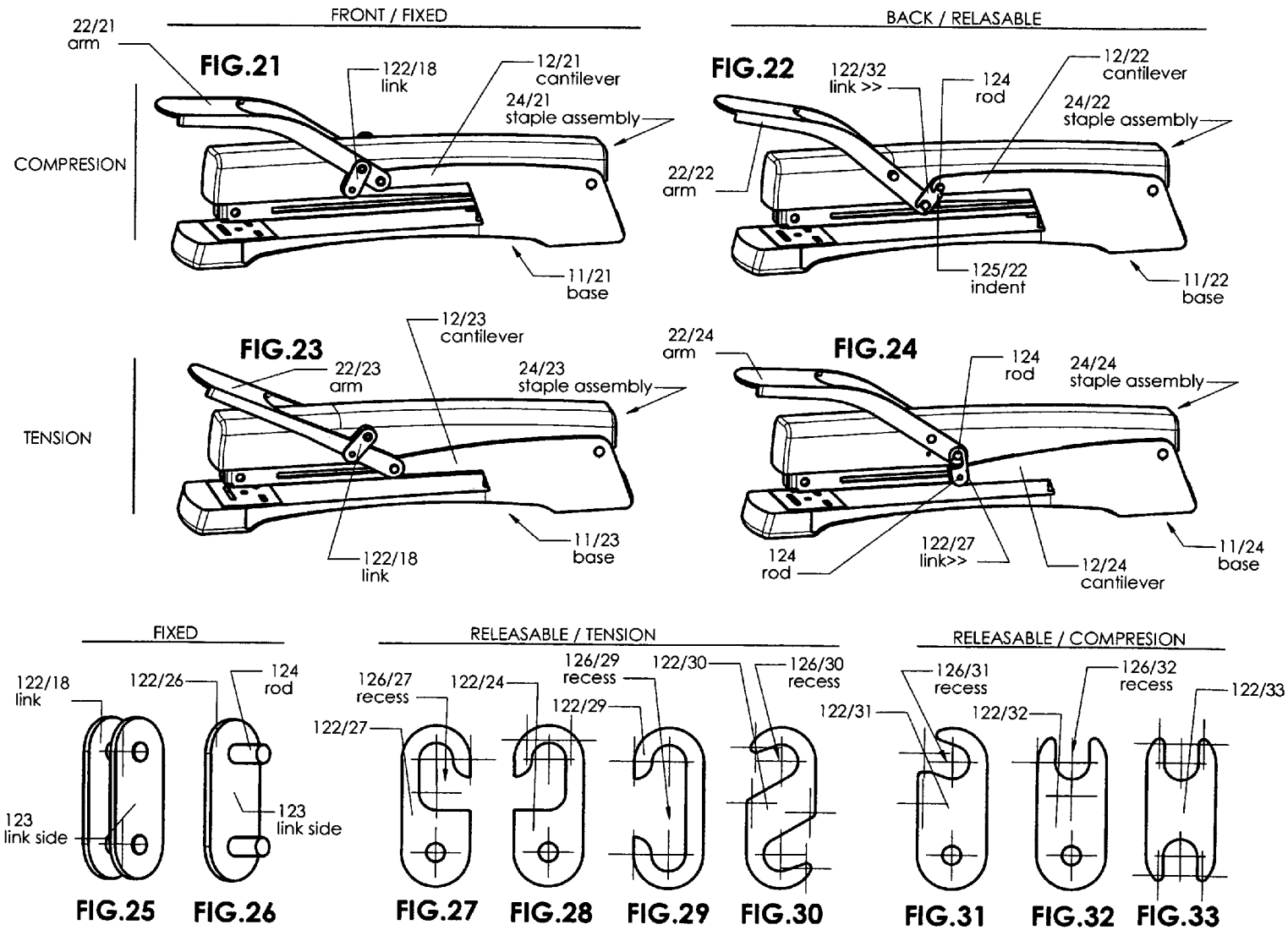
FIG. 21 is a perspective view of an alternate embodiment of a link type stapler, shown in a ready configuration.
FIG. 22 is a perspective view of an alternate embodiment of a link type stapler, shown in a ready configuration.
FIG. 23 is a perspective view of an alternate embodiment of a link type stapler, shown in a ready configuration.
FIG. 24 is a perspective view of an alternate embodiment of a link type stapler, shown in a ready configuration.
FIGS. 25 and 26 are perspective views of a link.
FIG. 27 is a perspective view of an alternate embodiment of a link.
FIG. 28 is a perspective view of an alternate embodiment of a link.
FIG. 29 is a perspective view of an alternate embodiment of a link.
FIG. 30 is a perspective view of an alternate embodiment of a link.
FIG. 31 is a perspective view of an alternate embodiment of a link.
FIG. 32 is a perspective view of an alternate embodiment of a link.
FIG. 33 is a perspective view of an alternate embodiment of a link.

FIG. 10
- 10/# base assembly
- 11/# base
- 12/# cantilever
- 14/# support
- 15 assembly holder 15/1
- 16/# platform
- 18/# anvil
- 19 arm axle hole
- 20/# axle
- 21/# arm side
- 22/# arm
- 23/# handle
- 24/# stapler assembly FIG. 25
- 25 stapler body
- 26/# magazine
- 27/# slide
- 28/# cover
- 29/# cover sidewall
- 30/# cam surface
- 31/# contact point
- 32/# finger
- 33/# finger cavity
- 34/# paper slot
- 35/# gap
- 36/# front foot
- 38 back foot
- 40 clearance arch
- 41 ram spring
- 42 ram
- 43 pressure spring
- 44/# pressure member
- 45 pressure member catch
- 46 shaft
- 48 advancer
- 49 advancer guide FIG. 50
- 50 advancer track
- 51 advancer spring, not shown
- 54 view-port
- 55 exit
- 56 strip of staples
- 57/# bushing
- 58/# hub
- 59 spring pin
- 60 arm spring
- 61 bumper
- 62 strike surface
- 64 spring cavity
- 65 arm spring end
- 66 body spring end
- 68 spring hole
- 69 body hole
- 70 catch
- 72 catch spring
- 73 catch body
- 74 catch button FIG. 75
- 75/# auxiliary catch button
- 76 catch hole
- 77 auxiliary catch hole
- 78 catch groove
- 79 auxiliary catch groove
- 80 vertical foot
- 82 vertical clearance arch
- 84 handle foot

85/# stapler
86 OEM stapler
88/# carrier
90 retainer wall
91A finger wall
91B finger wall
92 hood
94/# stapler substructure
96 hole punch
98 punch body

FIG. 100

100/# cylinder/63
102 bridge
104 backer
106 slot
108 notch
109/# hole
110 punch block
112 stapler block
114 side body
116 side base
118 finger retainer
120/# cam slot
122/# link
123 link side
124 rod

FIG. 125

125 indent
126 recess
127 lower segment
128 vertical segment
129 upper segment
130 handle space
132/# insert
134/# insert finger
136 ridge
137 clearance void
138 cam surface
140 deflector
142/# top
144/# bottom
145 postitioner
146 connector
147 separation

FIG. 150

150/# receptacle
152 interstice
154 lid
156 pole
158 cut
159/# bottom hole
160 scallop
162 retainer
164 retainer block
166 peg
168 die
170 lower die
172 upper die
174 die extension
180 rack
182 pinion
184 rack post

DETAILED DESCRIPTION OF THE COVER PIVOT STAPLER

Figure 3:
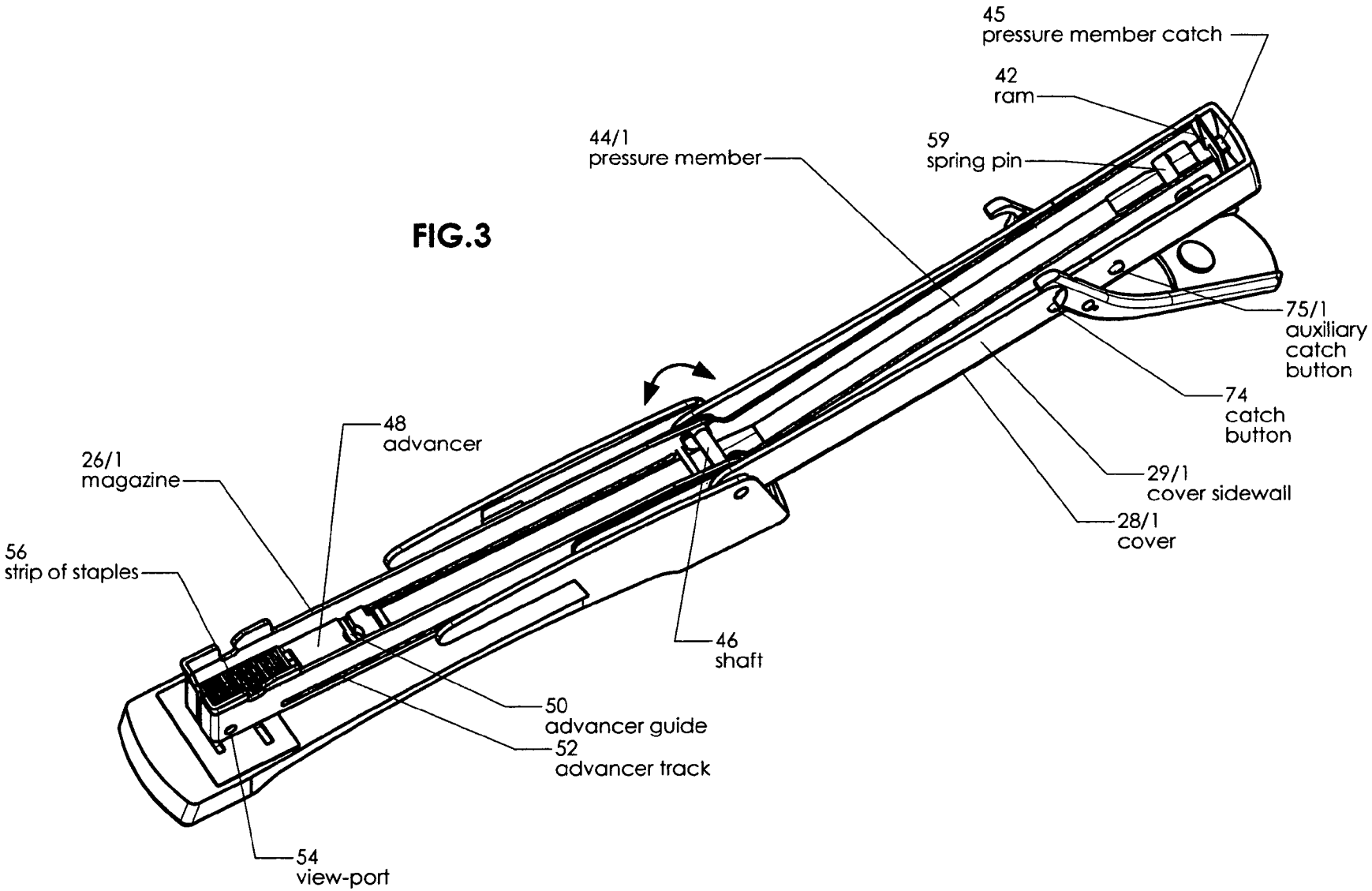
FIG. 3 shows cover pivot stapler in a staple access configuration.

FIG. 1 shows a perspective view of a FIG. 1 stapler, also called a cover pivot stapler. The cover pivot stapler, like most existing staplers, has two main assemblies: a base assembly 10/1 and a stapler assembly 24/1. As shown in FIGS. 1 and 3, these two assemblies are pivotally connected by a common shaft 46, which is a metal rod. The two main assemblies are oriented longitudinally, while shaft 46 is aligned in the transverse direction. It can also be said that shaft 46 is orthogonally oriented to the two main assemblies. The front of the cover pivot stapler is also referred to as the first end, while the rear is referred to as the second end. Base assembly 10/# and stapler assembly 24/# are collectively called a stapler body 25.

As shown in FIG. 1, base assembly 10/1, is made of two subcomponents, a base 11/1 and an anvil 18/1. Base 11/1 is one piece of cast metal, but is functionally comprised of three portions: a platform 16/1, a pair of assembly holders 15/1, a pair of supports 14/1, and a pair of cantilevers 12/1.

Figure 2:
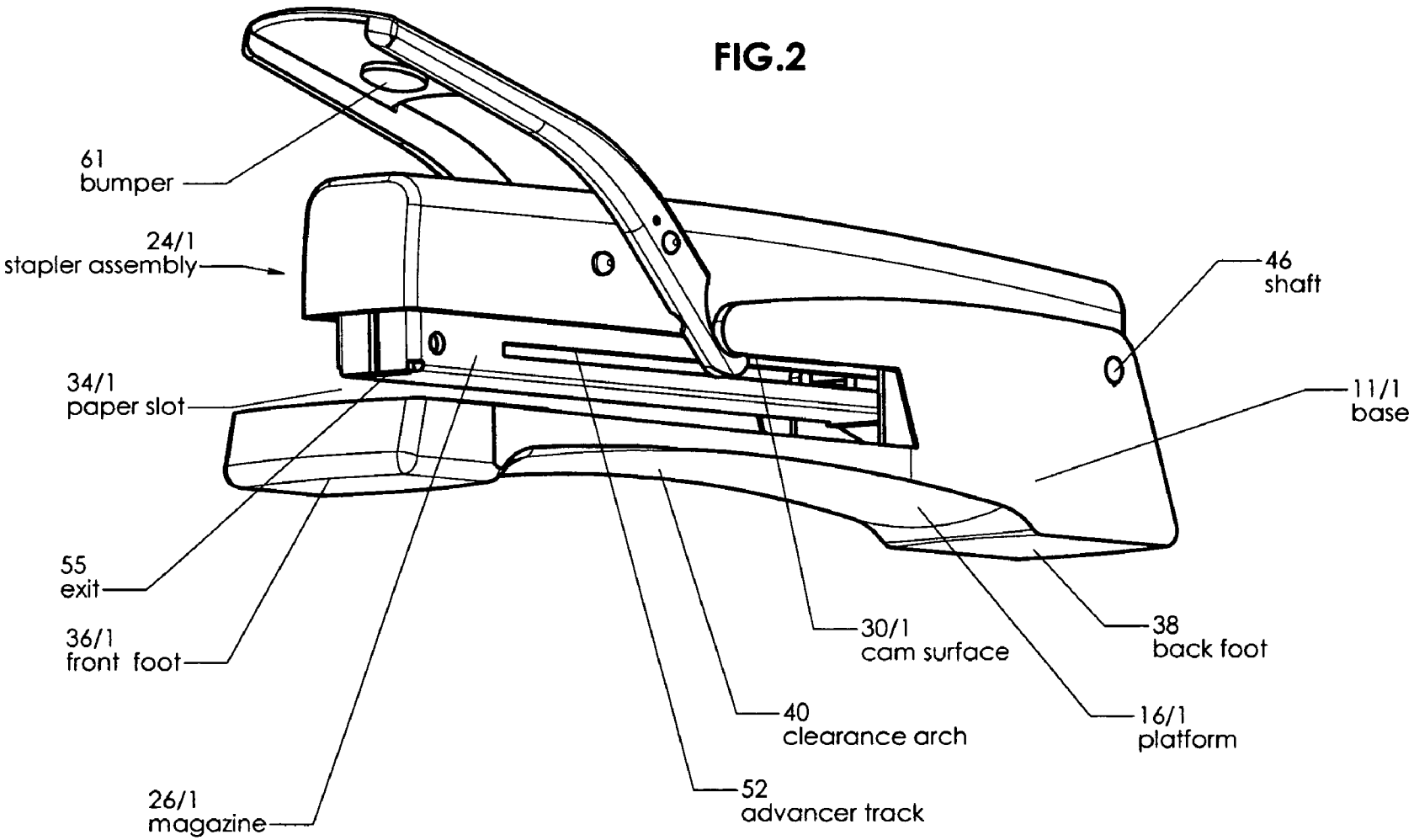
FIG. 2 shows low-angle perspective view of cover pivot stapler in a configuration.
Figure 13:
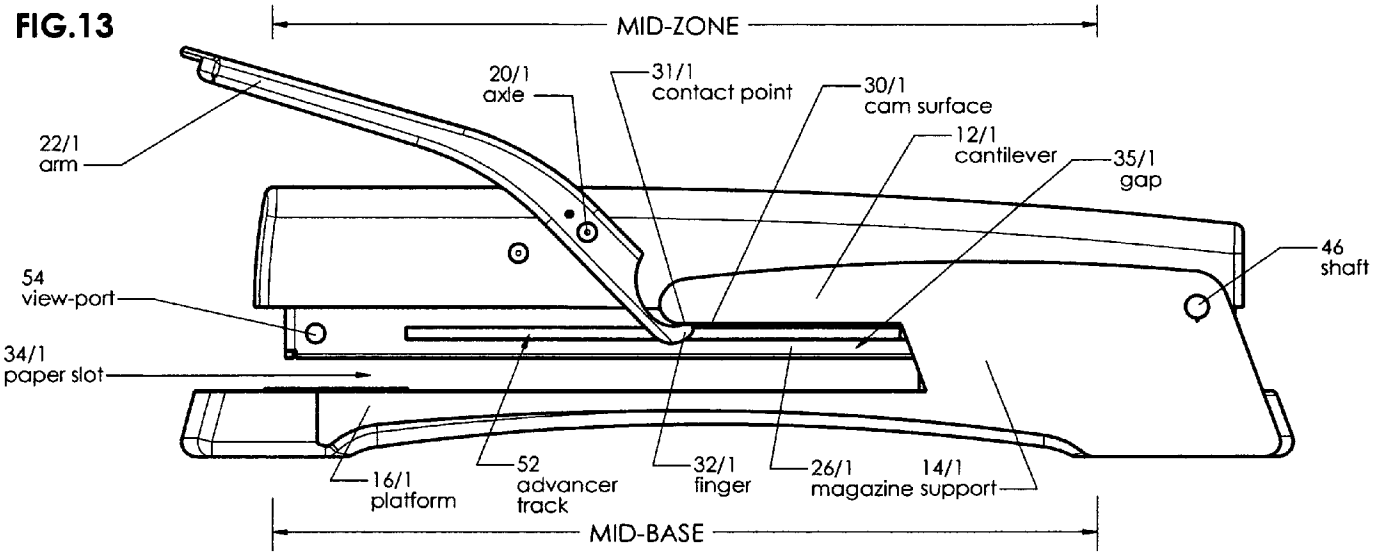
FIG. 13 shows side view of cover pivot stapler.

As shown in FIGS. 1 and 2, platform 16/1 is the bottom portion of Base 11/1. It has an essentially elongated rectangular cubic form, similar to many staplers. Platform 16/1 is longitudinally oriented, and has a front foot 36/1 at its front or first end, a back foot 38 at its rear or second end, and a clearance arch 40 in between. As shown in FIGS. 1, 2 and 13, a longitudinally extending space between stapler assembly 24/1 and platform 16/1 is a paper slot 34/1. Or to be more precise, paper slot 34/1 is the area between the lower surface of magazine 26/1 and the upper surface of platform 16/1.

Figure 12:
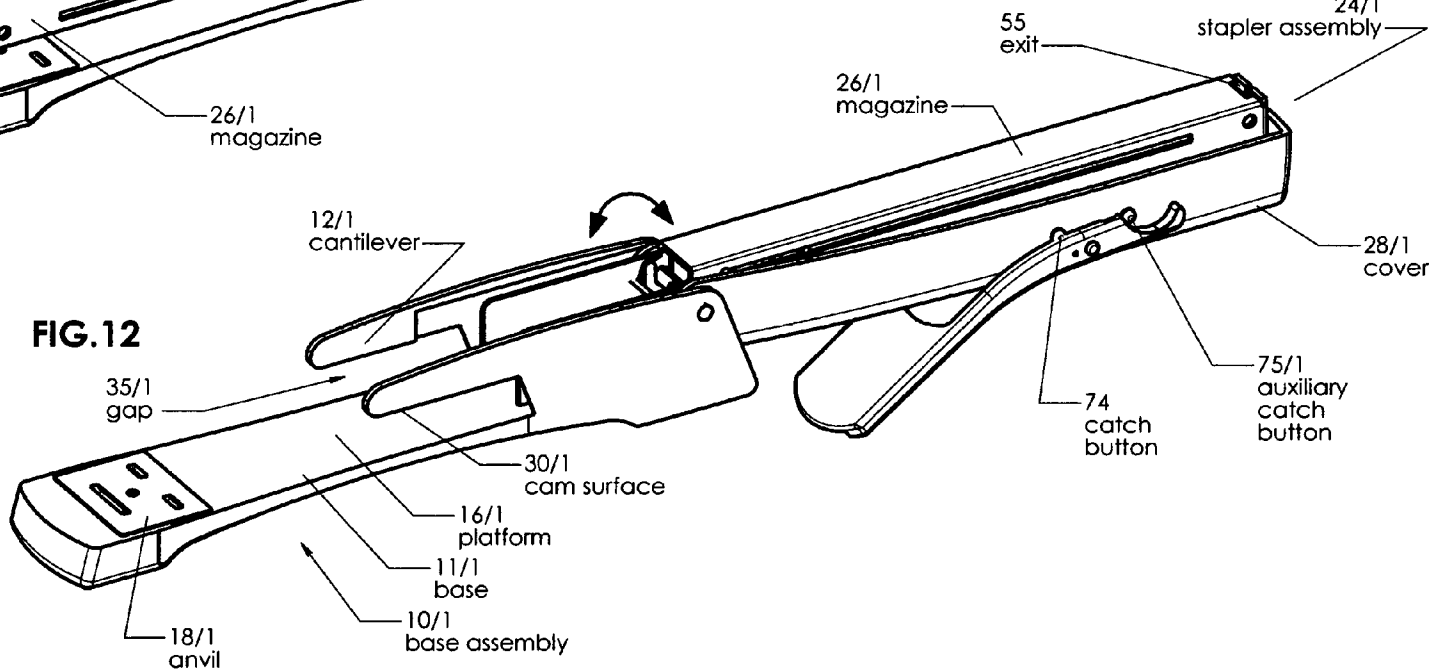
FIG. 12 shows cover pivot stapler opened to tacking configuration.

Also seen in FIGS. 2 and 12 is a rectangular hole, an exit 55, in the lower front portion of magazine 26/1, for the passage of a staple being ejected.

Supports & Assembly Holders

As shown in FIG. 1, two supports 14/1 extend vertically, one from each side, of the rearward portion of platform 16/1. Each support 14/1 is a transversely flat planar shape, whose outside and back surfaces are continuous with the outside and back surfaces of platform 16/1.

As shown in FIG. 1, two assembly holders 15/1 extend vertically, from the rearward portion of platform 16/1. Assembly holders 15/1 are somewhat similar to supports 14/1 in shape, size, bilateral symmetry, and general position. The exception being that assembly holders 15/1 are transversely positioned further inboard from supports 14/1. More specifically, the pair of assembly holders 15/1 are transversely positioned inboard from cover 28/1 and outboard from magazine 26/1. This allows assembly holder 15/1 to limit the transverse movement of magazine 26/1 and also to support shaft 46.

Cantilevers

The cantilevers 12/1, shown in FIG. 1, are longitudinal forward projections from the upper front portions of each support 14/1. In the cover pivot stapler, each cantilever 12/1 is a planar shape and is in the same plane as support 14/1 sharing the same top, inside and outside surfaces. Cantilever 12/1 defines a longitudinally extending gap in between itself and platform 16/1, which is a gap 35/1. As shown in FIGS. 1 and 12, gap 35/1 has an opening facing towards the front of the stapler. A portion of the bottom surface of cantilever 12/1 that faces platform 16/1 is a cam surface 30/1.

Overlap

Note that the vertical dimension of gap 35/1 remains static, while the vertical dimension, or angle, of paper slot 34/1 changes depending on the rotational position of stapler assembly 24/1, as shown in FIGS. 8 and 9. Also note, paper slot 34/1 and gap 35/1 overlap each other, meaning paper slot 34/1 extends longitudinally from assembly holder 15/1 to the front of magazine 26/1. As such, it crosses through the open area of gap 35/1. Gap 35/1 is limited to the length of cantilever 12/1. The purpose of gap 35/1 is providing deep access to sheets of material. Note, as shown in FIG. 8, the vertical dimension of 35/1 is larger than the paper slot's 34/1 vertical dimension, when the cover pivot stapler is in a ready configuration.

Anvil

Figure 7B:
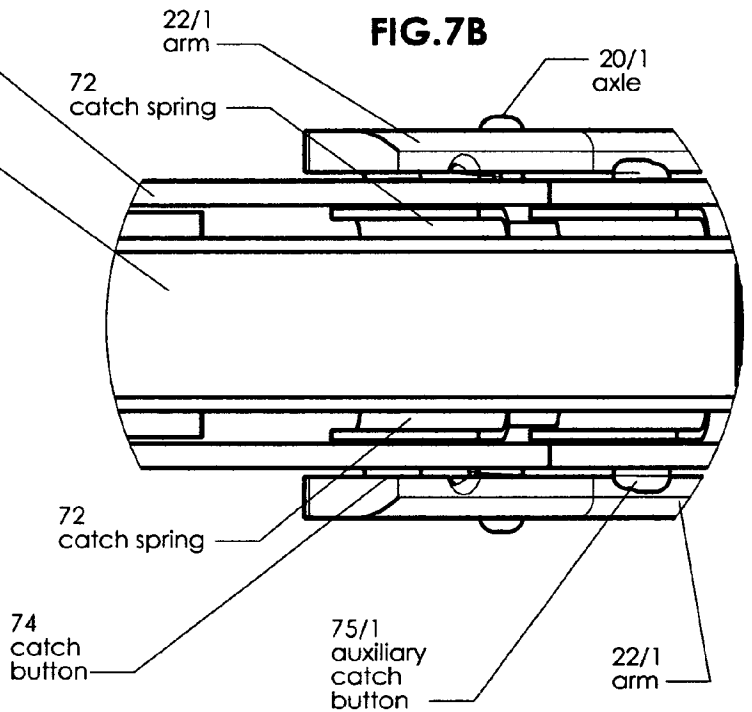
FIG. 7B is a detail view of FIG. 7A showing catch 70 attached to cover sidewall 29/1.
Figure 7A:
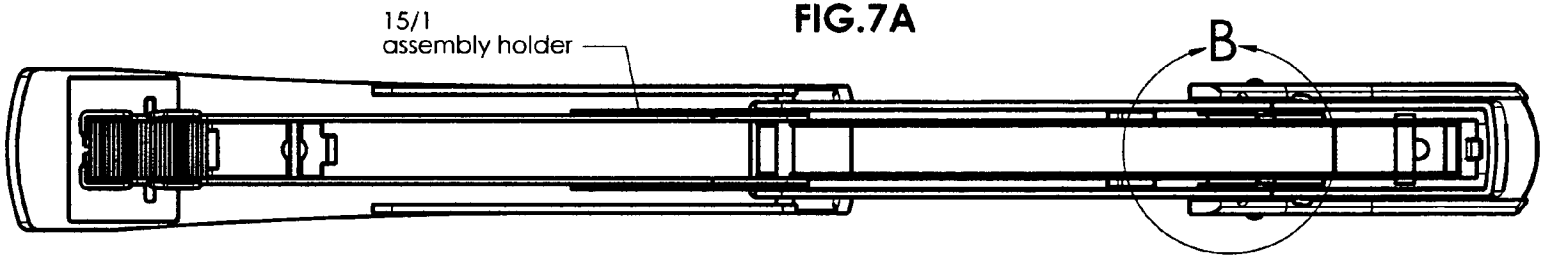
FIG. 7A is a top view of cover pivot stapler, in staple access configuration.

Shown in FIGS. 1 and 7A, the other subcomponent of base assembly 10/1 is anvil 18/1. Common to most staplers, anvil 18/1 has a curving inset portion that bends the rammed staple upon contact. Anvil 18/1 is a stamped metal part. Anvil 18/1, again typical of many staplers, sits in a cavity in platform 16/1. It is attached to platform 16/1 by a cylindrical rod extending from the bottom of anvil 18/1. The cylindrical rod goes through a hole in platform 16/1. A concentric spring around the cylindrical rod pulls anvil 18/1 down into the cavity in platform 16/1. All this allows anvil 18/1 to be raised up out of the cavity and rotated 180° so that a different portion of anvil 18/1 bends the staple into a bent open configuration instead of bent closed configuration.

3 Major Components

Assembly 24 has three major components with a common pivot: shaft 46. As shown in FIG. 1, the first, a magazine 26/1, is the bottom component. Second is a cover 28/1, which is the top component of the three and acts as a cover and a force transmitter. The third is a pressure member 44/1 that lies between cover 28/1 and magazine 26/1, shown in FIG. 3. Magazine 26/1 holds a staples 56, which is a strip of staples. Pressure member 44/1 holds staples 56 down against magazine 26/1.

Arm

Another key component of the cover pivot stapler, as shown in FIG. 1, is arm 22/1. It is comprised primarily of a set of two mirror-image arm sides 21/1 connected to each other on their distal ends by a handle 23/1. Each arm side 21/1 is generally flat and transversely thin with a long gently curved shaped outline or perimeter that narrows at as it approaches handle 23/1. Handle's 23/1 two largest sides are generally planar and parallel to each other. Handle 23/1 is transversely sized to allow the set of arm sides 21/1 to span cover 28/1. Also, in the cover pivot stapler, handle 23/1's transverse span is sized such that arm sides 21/1 are coplanar with cantilever 12/1.

As shown in FIG. 1, a pair of mirror-image cylindrical metal pins, axles 20/1, extend transversely from each cover sidewall 29/1; pivotally connecting each arm 22/1 to each cover sidewall 29/1. This connection is also known as the first coupling. As shown in FIG. 1, the proximal end, or tip, of each arm side 21/1 has protrusion called a finger 32/1. Finger 32/1 contacts cam surface 30/1 creating a contact point 31/1. This connection is also known as the second coupling. It could more broadly stated to say that the first coupling provides contact between arm 22/1 and stapler assembly 24/1, and that the second coupling provides contact between arm 22/1 and base 11/1.

As seen in FIGS. 1 and 13, there is also a view-port 54, a hole in magazine 26/1 that enables the viewing of the staples to determine when they have been depleted. Also shown in FIG. 2, is a bumper 61 attached to the underside surface of handle 23/1, to soften the impact between handle 23/1 and stapler assembly 24/1.

3 Major Components Detailed

As shown in FIG. 3, stapler assembly 24/1 is the operative part of the stapler and is typical of many staplers in present use. Nevertheless, to be thorough, the components and subcomponents of stapler assembly 24/1 will be detailed as follows.

Magazine 26/1 is essentially a longitudinally extending u-channel with the front of the channel closed off to form a rectangular open box shape. Its opening faces vertically upward, away from base assembly 10/1, or put another way, faces outside relative to the overall stapler. This component is made of bent sheet metal.

Cover 28/1 is made of cast metal; however injection molded plastic or bent sheet metal are also common options. Cover 28/1 is essentially a long rectangular box shape with the opening facing vertically downward, toward base assembly 10/1, or put another way, facing inside relative to the overall stapler. Cover 28/1 is somewhat wider and longer than magazine 26/1, and accordingly fits over it. A cover sidewall 29/1 denotes each longitudinally extending side of the box shape of cover 28/1.

Pressure member 44/1 is essentially a longitudinally extending u-channel with the largest opening facing downward toward base assembly 10/1. Pressure member 44/1 is made of bent sheet metal. Pressure member 44/1 is narrower and shorter than magazine 26/1, and accordingly fits within it in order to make contact with the staples.

3 Other Components

There are three other semi-major components in stapler assembly 24/1 shown in FIG. 3 that are typical of many staplers.

The first is an advancer 48, which pushes the staples to the front. Advancer 48 is an injection-molded rectilinear block of plastic. Advancer 48 fits snugly inside magazine 26/1 and is held in place by an advancer guide 49. Advancer guide 49 is a metal pin running transversely through advancer 48 and travels longitudinally in an advancer track 50. Advancer track 50 is a longitudinally oriented opening in each sidewall of magazine 26/1.

The second component is an advancer spring 51, not shown. One of its ends is attached to advancer guide 49. The other end is attached to a hook on the rear of pressure member 44/1. Advancer spring 51 travels behind and around a metal pin, a spring pin 59, which is transversely attached to the front portion of pressure member 44/1.

As shown in FIGS. 3 and 10, the third component is a ram spring 41, a piece of spring metal bent in two places, creating an approximately 90° extension in front, called a ram 42, and an approximately 15° extension in the rear, called a pressure spring 43. Ram spring 41 is attached to the upper inside surface of cover 28/1, by two posts extending from that surface. Ram 42 is adjacent to, and approximately parallel to, the front of pressure member 44/1. The lowermost edge of ram 42 is the part of the stapler that contacts the top of the staple being ejected. Pressure spring 43 acts as a leaf spring providing pressure from cover 28/1 to keep pressure member 44/1 pressed against the staples.

Catches

As shown in FIG. 3, a longitudinally extended portion of pressure member 44/1, a pressure member catch 45, fits into an open portion of ram 42, which limits the distance that pressure member 44/1 can move away from cover 28/1.

As shown in FIGS. 3 and 8, there are buttons or detents protruding through each cover sidewall 29/1. The more rearward button is a catch button 74. The more forward button is an auxiliary catch button 75/1. The catch buttons help position arm 22/1. Before explaining this, the details of arm 22/1 will be disclosed more fully using FIGS. 4, 5A, and 5B.

Arm Detail

A transversely oriented hole, known as an arm axle hole 19, is located between the distal and proximal ends. The area between arm 22/1's distal and proximal ends is also referred to as a mid-arm. To restate, arm axle hole 19 is placed in the mid-arm portion of arm side 21/46.

Figures 4, 5A, 5B:
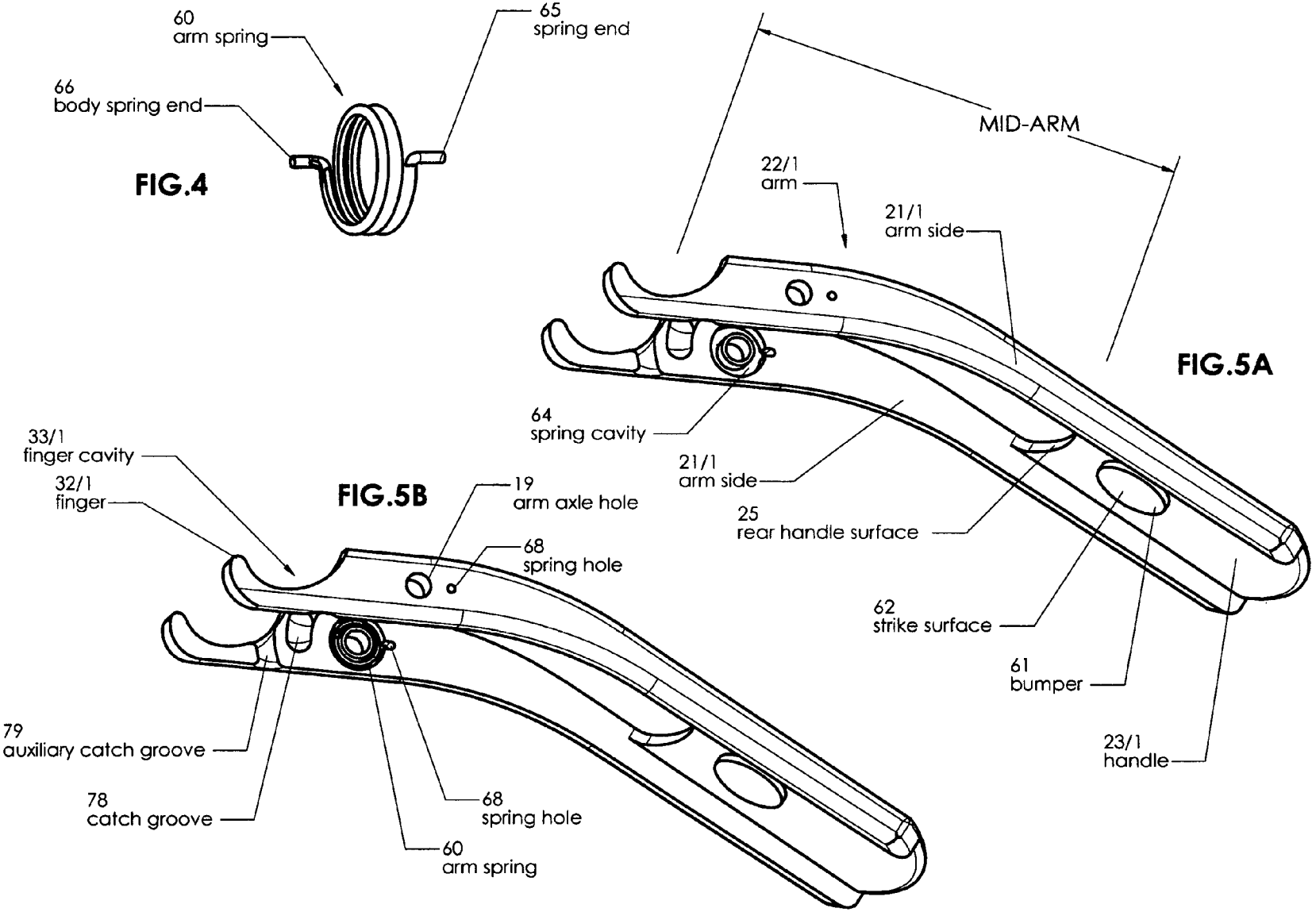
FIG. 4 shows arm spring 60.
FIG. 5A shows arm 22 without arm spring 60.
FIG. 5B shows arm 22 with arm spring 60.

Finger 32/1, in FIG. 5B, is an upward curving, and vertically narrower, portion of the proximal end of arm side 21/1.

As such, it shares common inner, outer, and lower surfaces with, and is made of the same material as, arm side 21/1. The vertical narrowing and most of the upward curving shape of finger 32/1 is due to a concave contoured recess, a finger cavity 33/1. The shape and size of finger cavity 33/1 is adapted to receive the distal end of cantilever 12/1 when finger 32/1 contacts cam surface 30/1. Note that finger cavity 33/1 is needed to prevent interference from the rounded tip of cantilever 12/1 during arm 22/1's stapling operation rotation, allowing finger 32/1 to maintain contact. As an alternative, note that a finger shape and contour recess could be on cantilever 12/1 instead of arm side 21/1, or some amount of shaping could be imparted to cantilever 12/1 and arm side 21/1, creating mutual areas of noninterference.

Finger 32/1, arm side 21/1, and cantilever 12/1 are all generally in the same plane as each other. One advantage of this is that it reduces the overall width of the cover pivot stapler.

A low-friction powder-coat paint is used to coat finger 32/1 because it slides along the surface of cam surface 30/1. If greater durability is required, an injection molded nylon sleeve will be molded over finger 32/1, not shown.

Arm Detail: Spring Cavity

As shown in FIG. 5A, each arm side 21/1 has an essentially cylindrical cavity: a spring cavity 64, which is concentric to arm axle hole 19. Spring cavity 64 has a larger diameter than arm axle hole 19, and they share a common wall. A portion of the exterior wall of arm axle hole 19 being the interior wall of spring cavity 64. As shown in FIG. 5B, a spring hole 68 is a transverse hole in lever side 21/1, proximate to the exterior wall of spring cavity 64.

As shown in FIG. 4, an arm spring 60 is a cylindrical spirally biased spring with its ends bent at 90°. As shown in FIG. 5B, the body of arm spring 60 fits concentrically into spring cavity 64. Relative to arm 22/1, both the spring's axis and its ends are transversely oriented. One end, a arm spring end 65, is inserted into spring hole 68. The other spring end, a body spring end 66, is inserted into a body hole 69, a transverse hole in cover 28/1. Body hole 69, as shown in FIG. 10, is sized and located to accommodate body spring end 66.

The attachment of arm 22/1 to cover 28/1 is achieved by placing each of an axle 20/1 into a hole in its respective cover sidewall 29/1 and then spot-welded it in place. This arrangement allows arm 22/1 to rotate about axle 20/1. As arm spring 60 pushes on arm 22/1, it rotates handle 23/1 downward and forward about axle 20/1 until finger 32/1 encounters cam surface 30/1 on the underside of cantilever 12/1.

Arm Detail: Bumper

As shown in FIG. 5B, handle 23/1 has a rear handle surface 25 facing arm axle hole 19, which closer to axle 20/1 than the front surface of cover 28/1 is to axle 20/1. Accordingly, handle 23/1 cannot rotate below cover 28/1. In other words, the underside surface of handle 23/1 overlaps with, and collides into, the outer surface of cover 28/1.

Bumper 61 mitigates the collision's impact. Bumper 61 is a short cylindrical elastomeric injection molded unit. Bumper 61 is flat on one side to match the underside surface of handle 23/1, where it is attached by adhesive. The surface on the opposite side of bumper 61, a strike surface 62, is a raised semi hemispheric surface. Bumper 61 is positioned so that it lies close to the front of cover 28/1 and in between the underside surface of handle 23/1 and the outer surface of cover 28/1. Note that bumper 61 could just as easily be attached to cover 28/1.

As seen in FIG. 5B, a catch groove 78 and an auxiliary catch groove 79 are on the inside of each arm side 21/1. Both grooves are concentric with arm axle hole 19 and are modifications of the inside surface of arm side 21/1. Auxiliary catch groove 79 is a simple groove that has openings at both of its ends, above and below arm side 21/1. Catch groove 78 is a more complex groove with an opening at the upper end of the groove, but a closed-end at the bottom end. Additionally, a bottom portion of catch groove 78 sinks deeper into the material than the rest of the groove. Catch groove 78 matches the position of catch button 74, while auxiliary catch groove 79 matches the position of auxiliary catch button 75/1.

Figure 6:
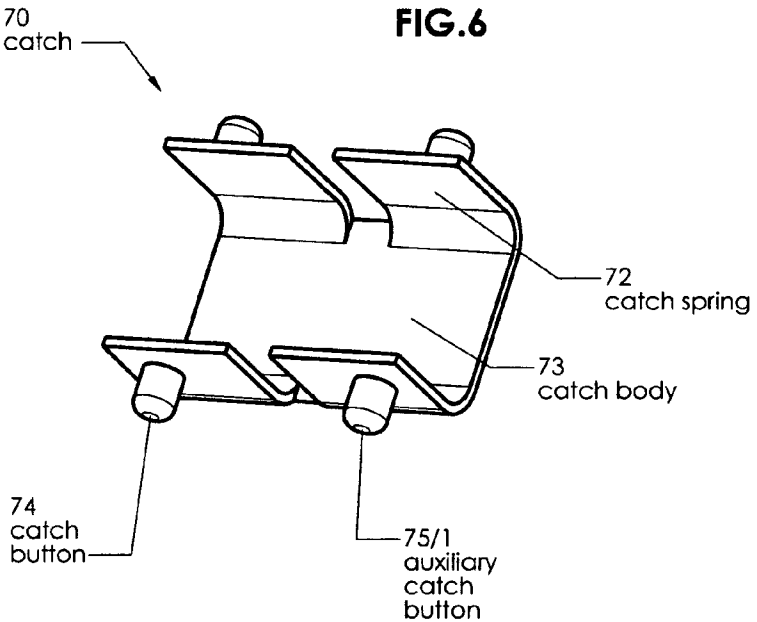
FIG. 6 is a perspective view of catch 70.

The more forward button is auxiliary catch button 75/1. As shown in FIG. 6, catch buttons 74 and auxiliary catch buttons 75/1 are each attached to a catch spring 72, which is a thin vertical wall. Catch spring 72 is attached orthogonally to a catch body 73, which is horizontally oriented. Together, the two catch buttons 74, two auxiliary catch buttons 75, four catch springs 72, and one catcher body 73 form a complete unit: a catch 70. Catch 70 has an overall u-channel shape and is longitudinally symmetric. There is a slot between the forward and rear catch springs 72 that allows them to spring independently from each other. Catch 70 is an injected molded nylon part.

Figure 11:
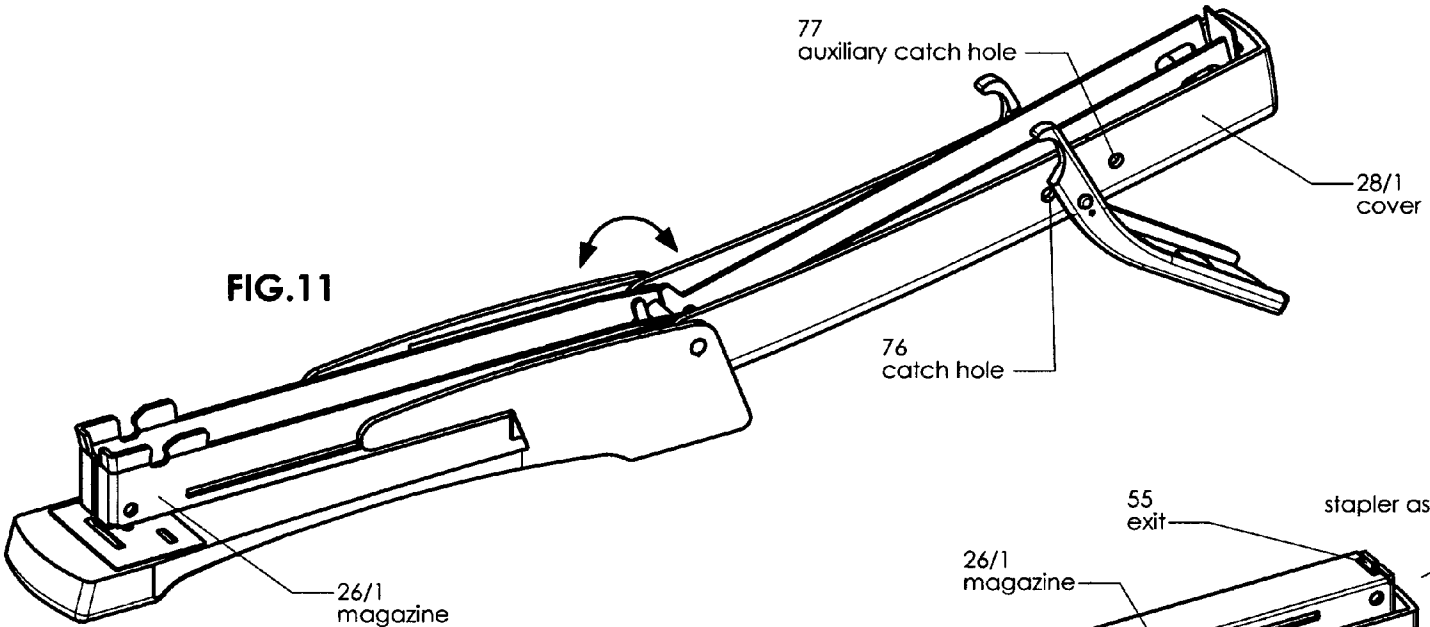
FIG. 11 shows cover pivot stapler opened to staple access configuration.

As shown in FIGS. 7*b* and 11, there are two holes, sized to accommodate catch button 74 and auxiliary catch button 75/1 in each cover sidewall 29/1. The more rearward hole is a catch hole 76. The more forward hole is an auxiliary catch hole 77. Catch buttons 74 and 75/1 fit into their respective catch holes 76 and 77, holding catch 70 in place.

Mid-Zone & Mid-Base

In this cover pivot stapler, contact point 31/1 is positioned, in a mid-zone. As shown in FIG. 13, the mid-zone is most of the length of the stapler assembly 24/1 in the longitudinal direction. More precisely, the mid-zone covers from 12.5% to 99% of assembly 24/1's length from the rear end of stapler assembly 24/1 towards the front. Restated, the mid-zone is the portion of assembly 24/1 that starts 12.5% from the rear of assembly 24/1 and ends 1% from the front of assembly 24/1 where 100% is the full-length of assembly 24/1. In this embodiment of the cover pivot stapler, contact point 31/1 is slightly forward from the center of stapler assembly 24/1.

As shown in FIG. 13, a mid-base is the term used to refer to the mid-zone when referring to base 11/1 mid-base. To restate, the mid-base constitutes a longitudinal portion of base 11/1 measured as 12.5% to 99% of the assembly 24/1's length from the rear end of the stapler assembly 24/1 when the stapler is in the ready configuration.

Operation

Standard Stapler Vs. Cover Pivot Stapler

The basic operation of the cover pivot stapler is similar, in many ways, to most manually operated standard staplers. Manual pressure is applied to the top of the stapler, which results in ramming a staple through exit 55. The staple then passes through the items intended to be stapled together, typically sheets of paper. The rammed staple is forced into anvil 18/1 and, as a result, is crimped closed.

Lever

Figure 15:
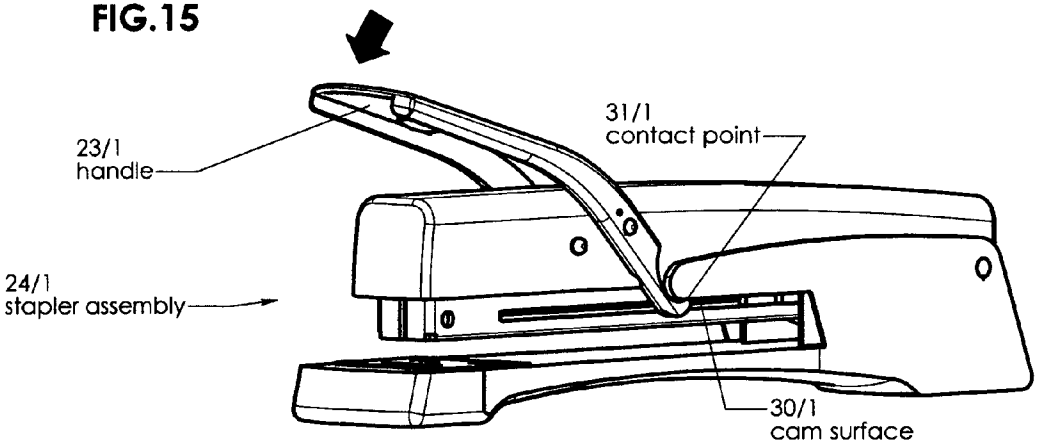
FIG. 15 shows cover pivot stapler in a ready configuration, just before stapling operation begins.
Figure 16:
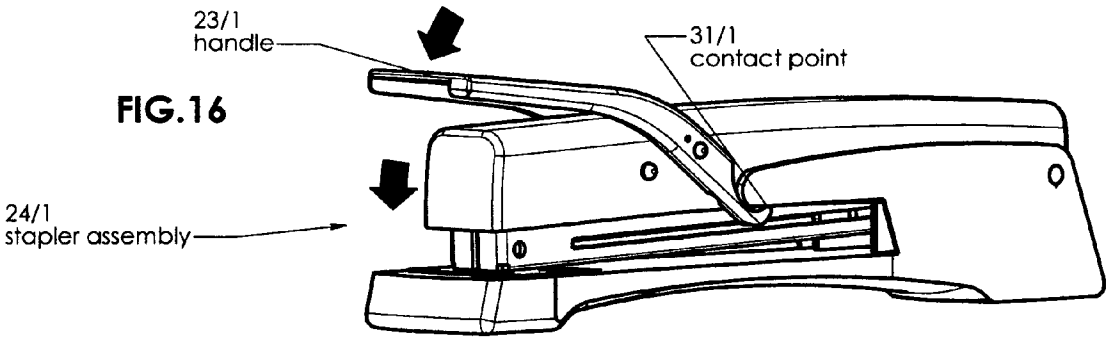
FIG. 16 shows cover pivot stapler in a stapling configuration, halfway through stapling operation.
Figure 17:
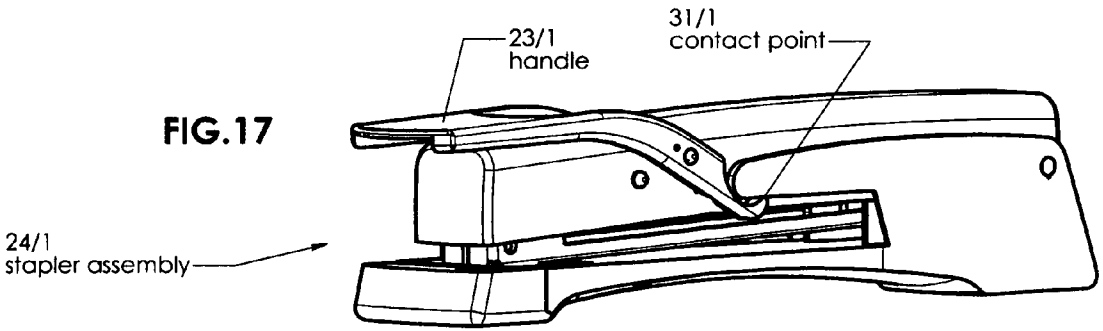
FIG. 17 shows cover pivot stapler in a stapled configuration, the final step of stapling operation.

The difference between a standard stapler and the cover pivot stapler is that it receives the manual pressure on handle 23/1 instead of directly on cover 28/1. The downward motion of handle 23/1 during the stapling operation is also referred to as a first end input. So called because the manual force is being input into the cover pivot stapler's compound lever system near the front, or first end, of the cover pivot stapler. As shown in FIGS. 15-17, the manual pressure from handle 23/1 is transmitted by arm 22/1, to cover 28/1 through axle 20/1. The downward motion of cover 28/1, and resulting downward motion of the entire stapler assembly 24/1, results in the ejection and crimping of a staple. This is also referred to as a stapling assembly output or an operative assembly output. FIG. 15 shows the cover pivot stapler in a ready configuration. FIG. 16 shows the cover pivot stapler in a stapling configuration. FIG. 17 shows the cover pivot stapler in a stapled configuration.

Cam

As shown in FIGS. 15-17, the progressive downward motion of handle 23/1 pivots arm 22/1 on axle 20/1. The resulting upward motion of finger 32/1 is impeded by cam surface 30/1, creating contact point 31/1 that allows arm 22/1 to work as a lever. Additionally, the distance between the two pivot points of arm 22/1 and cover 28/1 creates a sliding cam action between cam surface 30/1 and finger 32/1.

3 Phases

There are three phases of the stapling operation: 1—closing the gap, 2—piercing the sheets of material, and 3—crimping the staple. Phase 1, closing gap, starts with FIG. 15, with the cover pivot stapler in the ready configuration and ends with FIG. 16, with the cover pivot stapler in the stapling configuration. At this point, the bottom of the magazine 26/1 has just contacted the top of the sheets of material. Phases 2 and 3, piercing and crimping, start with FIG. 16, with the cover pivot stapler in the stapling position and end with FIG. 17, with the cover pivot stapler in the stapled configuration. Contact point 31/1 moves rearward along cam surface 30/1 during the stapling operation.

Disengage

The cover pivot stapler's primary resting position is the ready configuration as shown in FIG. 8 and also FIGS. 1 and 15. From this position finger 32/1 can be selectively pivoted into and out of engagement with cam surface 30/1, as shown in FIGS. 8 and 9. That is to say, handle 23/1 is ready either to operate by rotating down into the stapled configuration as shown in FIG. 17, or to disengage by rotating up into a disengaged configuration as shown in FIGS. 9-11. Once handle 23/1 and finger 32/1 have moved into the disengage configuration, the cover pivot stapler can be opened into either a staple access configuration as shown in FIG. 11, or a tacking configuration as shown in FIG. 12.

Tacking

The tacking configuration shown in FIG. 12 has stapler assembly 24/1 rotated 180°, up and back, behind base assembly 10/1. Exit 55 can now be placed directly on the surface of an item to be stapled. When fired, the staple will not be crimped. A typical use of the tacking configuration is stapling sheets of material to a wall. In this configuration, the cover pivot stapler acts like an ordinary stapler and does not provide any improved leverage. This is because the manual pressure is applied directly to the top of cover 28/1 and arm 22/1 is disengaged from cam surface 30/1.

Handle Back

In the tacking configuration, arm 22/1 rotates all the way up and back until rear surface of handle 23/1 contacts cover 28/1. As shown in FIG. 12, this allows better access to the front portion of cover 28/1.

Load Staples

To open the cover pivot stapler for top loading staples, only cover 28/1 and pressure member 44/1 are rotated up and back as shown in FIG. 11. The cover pivot stapler in a staple access configuration is similar to the stapler in the tacking configuration of FIG. 12, except that magazine 26/1 remain stationary, approximately parallel to base assembly 10/1. This provides access above magazine 26/1, thus allowing staple loading from the top. Top loading staple access is common in most standard staplers. Top loading staple access is desirable because of its familiarity, ease-of-use and access to jammed staples.

Use 1: Tabletop

There are two methods that users can employ to apply manual pressure when using the cover pivot stapler's compound leverage mechanism. The first has the cover pivot stapler resting on a stable, essentially horizontal, surface such as a tabletop. The sheets of material to be stapled are brought to the stapler and placed into paper slot 34/1. The palm or fingers of the hand pressed down on handle 23/1 to provide the movement and power for the stapling operation. Front foot 36/1 and back foot 38 provide the connection between platform 16/1 to the work surface. Clearance arch 40 provides clearance if the stapler is set on an uneven surface.

Use 2: Handheld

The second method for using the compound leverage mechanism is handheld. In this method, the cover pivot stapler is held with arm 22/1 in the palm of the hands and fingers running under, and around, clearance arch 40. The stapler is brought to the sheets of material to be stapled. The materials are then placed into paper slot 34/1. Squeezing action by the hand moves handle 23/1 and platform 16/1 towards each other to provide the movement and power for the stapling operation. In this method of use, clearance arch 40 provides a more ergonomic grip of platform 16/1 and makes the cover pivot stapler easier to pick up.

Leverage

The lever and cam actions can be selected to greatly improve the leverage force or power transmission ratio imparted to stapler assembly 24/1, and hence ram 42, and therefore the stapling action. The power transmission ratio is the amount of leverage increase or decrease imparted from handle 23/1 to ram 42. Or put another way, when the leverage is increased, handle 23/1 moves down faster than ram 42.

4 Variables

The power transmission ratio is controlled by four variables. The first two variables apply to arm 22/1 as a simple lever. The second two variables are aspects of a compound lever system. More specifically, they apply to contact point 31/1 as a cam, and to the distance between shaft 46 and axle 20/1.

The first variable is the length of arm 22/1, from axle 20/1 through handle 23/1. The greater the length, the greater the leverage. Second is the length of arm 22/1, between axle 20/1 and contact point 31/1. The shorter the length, the greater the leverage. The third variable is the distance between axle 20/1 and shaft 46. The greater this distance, the greater the leverage. The fourth variable, cam action, depends on the shape and angle of the cam surface. A cam surface 30/1 that allows finger 32/1 to move up during the stapling operation increases leverage. This cover pivot stapler design allows these four variables to be interchangeably chosen or altered in order to optimize performance.

Variable's Interchangeability

By changing any one of four variables or changing the variables in combination, one can choose the leverage improvement desired. It is particular to the design of the cover pivot stapler that all these variables can be chosen from a large range of possibilities, particularly the third variable. The third variable is more important because it does not just change the leverage, it changes the amount of stress placed upon the cam components finger 32/1 and cam surface 30/1. The progressively further shaft 46 is from axle 20/1, the progressively less stress less stress on the cam components and shaft 46 as well.

3$^{rd}$ Variable: Notes

Figure 14:
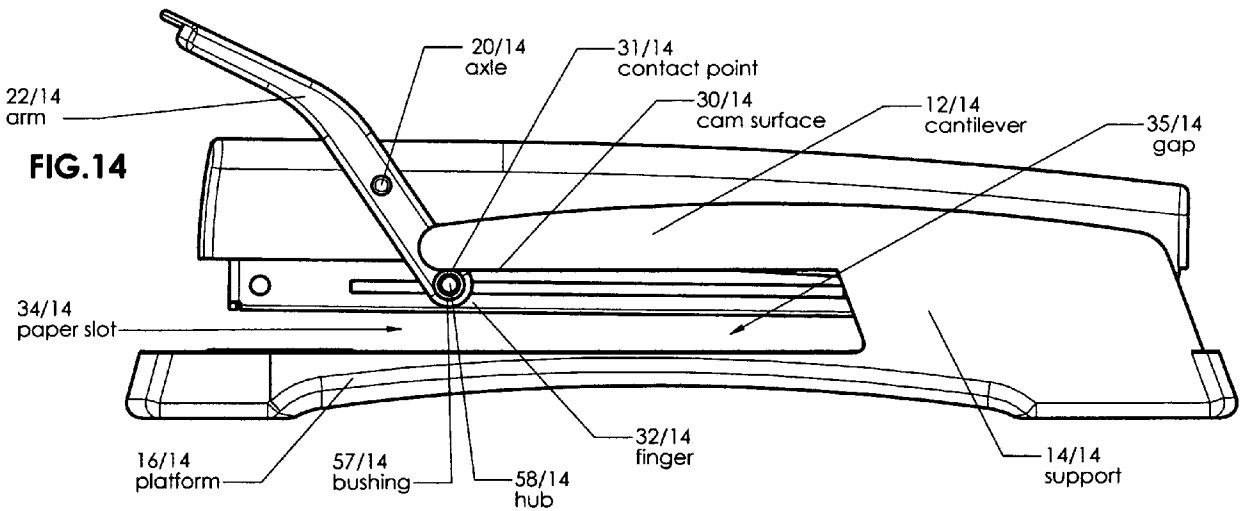
FIG. 14 shows side view of an alternate embodiment of cover pivot stapler.

As shown in FIGS. 13 and 14, being able to change the third variable, at will is the main purpose of cantilever 12/1. Increasing the third variable longitudinal distance between contact point 31/1 and shaft 46 only requires increasing the length of cantilever 12/1. It does not change the distant from the front of the stapler to the rear of gap 35/1 and/or paper slot 34/1. Accordingly, it does not limit the distance that sheets of material can be placed into the cover pivot stapler. To increase the distance between point 31/1 and shaft 46, it is helpful if shaft 46 is placed as far to the rear of the stapler has possible.

Cantilever & Gap

There is another way to state the relationship between cantilever 12/1 and gap 35/1. The cover pivot stapler allows the forward/rearward positioning of contact point 31/1, and consequently axle 20/1, to be independent of the longitudinal depth of paper slot 34/1 or gap 35/1. Also for clarity, note that the distance that the stapled items can be placed into the stapler is limited by the more longitudinally short of the two, either paper slot 34/1 or gap 35/1. The rear of paper slot 34/1 is limited by assembly holders 15/1, while the rear of gap 35/1 is limited by supports 14/1.

Cam Clarification

Because cover 28/1 and arm 22/1 pivot on different axis points, the rotation of arm 22/1 creates a cam action between finger 32/1 and cam surface 30/1. That is to say, arm 22/1's rotation causes finger 32/1 to slide along cam surface 30/1. By altering the angle of the of cam surface 30/1, the relative vertical and horizontal movements of finger 32/1 are altered, hence altering the leverage.

Cam Ratios

The fourth leverage variable, cam action, is uniquely suited to create different leverage at different phases of operation during the stapling process. During the initial phase of the stapling process, closing the gap, the bottom of magazine 26/1 is brought to the top of the items being stapled. During this phase almost no pressure is required, so generating large amounts of leverage is a waste of manual motion. In this embodiment a leverage ratio in the range of one to one is more desirable. In the second and third phases of piercing the items to be stapled and crimping the staple, a greater leverage is desirable. The cover pivot stapler has about a three to one leverage ratio during these phases. Restated, handle 23/1 is moving down three times faster than ram 42. Note: that a changing cam ratio is optional, not required.

Cam Position

The sliding distance during the cam action depends on the longitudinal placement of contact point 31/1. The further back contact point 31/1 is located, the shorter the sliding distance and hence the greater degree of precision needed to make cam surface 30/1 work well. As cam surface 30/1 becomes shorter, its shape becomes limited by the diameter or thickness of finger 32/1. At the same time, the force being imparted to finger 32/1 is increasing, making a larger diameter finger 32/1 desirable. Accordingly, contact point 31/1 is ideally near the middle of the cover pivot stapler or further forward.

Spring

Arm spring 60 maintains a forward rotational pressure on arm 22/1. This keeps cam surface 30/1 in contact with finger 32/1, unless altered by either of two catch buttons 74 and 75/1.

Catch Buttons

As shown in FIGS. 8, 9, and 10, catch button 74 performs two functions. The first limits arm 22/1 from rotating up, out of the ready configuration, towards the disengaged configuration. With sufficient manual pressure the limit is overcome, arm 22/1 can be rotated, and then it pops into the disengaged configuration. Here, catch button 74 performs its second function keeping arm 22/1 in the disengaged configuration. As shown in FIG. 12, auxiliary catch button 75/1 performs a single function of keeping arm 22/1 rotated all the way back, to get it out of the way for open stapling.

Handle Stops

As shown in FIG. 17, shortly after the stapling operation is complete, the downward rotation of cover 28/1 inherently bottoms out. The cause is cover 28/1 colliding into magazine 26/1 and/or ram 42 colliding into anvil 18/1. At this point, handle 23/1 is impeded in its downward travel, but because it's such a strong lever it may continue to be pushed further downward, bending arm 22/1 and/or destroying the other parts connected to it. To prevent this, the underside surface of handle 23/1 overlaps with, and collides into the upper surface of, cover 28/1. Accordingly, the force applied to handle 23/1 is directly transmitted to, and stopped by, the upper or outer surface of cover 28/1. This circumvents the leverage mechanism of the cover pivot stapler. Put another way, axle 20/1, arm 22/1, and cantilever 12/1 are configured and positioned such that the cover pivot stapler now bottoms out by handle 23/1 colliding into cover 28/1.

Bumper

To cushion the collision of handle 32/1 directly into cover 28/1, bumper 61 is placed between the two.

Additional Embodiments

Link Stapler, FIG. 18

Many variations of the MID-ZONE STAPLER are possible, including the types of coupling from arm 22/# to either the stapler assembly 24/# or base 11/#. This arm coupling includes three main types: pivot, cam, or link. The first two these, the pivot and cam, have been demonstrated in the cover pivot stapler. The third, the link, can replace much of the functionality of the cam. To explain the link and its function, the next embodiment of the mid-zone stapler will be the FIG. 18 stapler, which uses a link for one of its arm 22/# couplings.

As shown in FIGS. 18, 19 and 20, the FIG. 18 stapler has a different way of accommodating the generally horizontal motion generated in the cam portion at the juncture between the two levers of the compound lever system. Instead of a cam, a link 122/18 connects a proximal end of an arm 22/18 with a cantilever 12/18. Link 122/18 is similar to a link in a bicycle chain. As shown in FIG. 25, it has two sidewalls, link sides 123/18, connected to each other by two rods 124. The link sides 123/18 are parallel with each other. They are also parallel with, and adjacent to, the sides of arm side 21/18 and cantilever 12/18. One rod 124 pivotally connects one end of link 122/18 to cantilever 12/18. The other rod 122 pivotally connects the other end of link 122/18 to the proximal end of arm side 21/18.

Each sidewall of link 122/18 is a stamped sheet metal part. Rod 124 is a metal rod press fit into the holes in each sidewall of link 122/18.

What had been axle hole 19 in the cover pivot stapler is now opened into an indent 125/18 as shown in FIG. 18. By opening this hole into a notch, arm 22/18 becomes disengageable and can rotate up. Accordingly, arm 22/18 is movable from a ready position into a disengaged position.

The primary advantage of the FIG. 18 stapler is durability, because the lever action uses only pivoting action instead of sliding cam action. Because of additional parts, the FIG. 18 stapler might be more expensive to manufacture. However, because of improved durability, it's also possible that the FIG. 18 stapler would require less material and manufacturing precision and therefore be less expensive to manufacture.

As shown in FIGS. 21-33, link 122/# can be used instead of either a pivot or cam. That is, it can be substituted for axle 20/# or contact point 31/#. Furthermore, it can be used to create a fixed or releasable coupling. Additionally, the link 122/# can be used in configurations where it's in compression and other configurations where it's in tension.

FIG. 21

Compared to FIG. 18 stapler, a FIG. 21 stapler exchanges axle 20/# and link 122/# with each other. In this embodiment, arm 22/21 is connected to cantilever 12/21 by axle 20/18 instead of by a link 122/#. Or put another way, the rear coupling uses a pivot. Link 122/18 now connects arm 22/21 to stapler assembly 24/21. Or put another way, the front coupling uses link 122/18. Notice that link 122/18 is in compression. That is to say, when arm 22/21 is pushed down, it pushes down on link 122/18 to push down stapler assembly 24/21. Also note, arm 22/21 and link 122/18 are fixed, i.e., they cannot be moved up or down independently of stapler assembly 24/21.

By comparison, a FIG. 22 stapler has a releasable link 122/32. This embodiment reverts to having arm 22/22 pivotally connected to stapler assembly 24/22, but the pivoting coupling is fixed. To make arm 22/22 releasable, link 122/32 is releasable. Similar to the FIG. 21 stapler, the FIG. 22 stapler also has its link 122/32 in compression. Notice, however, that the link is releasable in two places. This is achieved by opening one end of link 122/32 to create a notch facing away from the center of link 122/32. The other release point is in cantilever 12/22, which is a notch facing platform 16/22.

This arrangement means that the link 122/32 is not fixably connected to either arm 22/22 or cantilever 12/22. As such, when arm 22/22 is disengaged, link 122/32 will fall out of place. Accordingly, it would need to be held in place by another method. On the other hand, the fully free link 122/32 could be useful allowing replacement or exchange with another link 122/#. One example of usefulness is that exchanging one size link 122/# with another could allow a change in ready or stapled positions to accommodate different sizes staples.

A FIG. 23 stapler is similar to FIG. 21 stapler in that link 122/18 is used for the front coupling and is fixed. It differs because link 122/18 is used in tension instead of compression.

FIG. 24

A FIG. 24 stapler also uses a link 122/# in tension, in this case a link 122/27. FIG. 24 stapler is similar to FIG. 22 stapler in being releasable and using link 122/# for the rear coupling. It differs because there's only one point of releasability: the coupling between arm 22/24 and link 122/27 is releasable, while the coupling between link 122/27 and cantilever 12/24 is fixed. Also note that the opening in link 122/27 that makes it releasable is facing forward.

FIGS. 51 through 54 are only a few of the possible alternative configurations using link 122/# as a means of arm 22/# coupling. There are many more alternative types of link 122/#. As shown in FIG. 26, link 122/26 has only one link side 123/18. Like link 122/18, link 122/26 is fixed. To clarify, saying that a particular link 122/# is fixed means it does not release from its own rod 124. Any fixed link 122/# can still be used in a releasable coupling, if rod 124 releases from any of three stapler components: stapler assembly 24/#, arm 22/#, and/or base 11/#. For example, in FIG. 22 the first rod 124 is fixably connected to link 122/32 and releasably connected to cantilever 12/22 because of indent 125/22. This is denoted as a releasable coupling, not a releasable link 122/#. The second rod 124 is fixably connected to arm 22/22 and releasably connected to link 122/32 because of recess 126/32. This classifies link 122/32 as a releasable link 122/#.

FIG. 27

FIGS. 27 and 28 show the same link 122/27 in different orientations, one facing forward and one facing rearward. FIG. 29 shows link 122/29, which is similar to link 122/27 in being a releasable link and a tension link. Link 122/29 differs by having both ends releasable instead of one end that is releasable and one end that is fixed. In this embodiment, both ends of link 122/29 share a common opening.

As seen in FIG. 30, link 122/30 is also a releasable style link at both ends. However, each recess 126/30 faces in opposite directions, one forward and one rearward.

As seen in FIG. 31, link 122/31 is similar to link 122/27 because it's releasable on one end and fixed on the other end. The other similarity is that the opening in the link, which makes it releasable, also opens in a sideways direction. The first difference between the two is that link 122/31 is a compression link. The second difference is that a recess 126/31 in link 122/31 is an angled recess. In link 122/27, a recess 126/27 is a right angle recess, initially horizontal at the opening and then turning 90° to vertical. What both recess 130/#'s have in common is that the vector of force from the stapling operation seats rod 124 into the bottom, and away from the opening, of recess 130/#.

For links 122/# that are tension links, the vector of force is away from the center of the link. For links 122/# that are compression links, the vector of force is towards the center of the link. Accordingly, link 122/31's recess 126/31 angles slightly above horizontal, away from the center of the link. In FIG. 32, link 122/32 has a recess 126/32 that angles completely away from the center to a full vertical orientation. As shown in FIG. 33, link 122/33 has two recesses 130/32, one at each end, ensuring double releasability.

Shown in FIG. 30, tension link 122/30 can also use an angled recess 126/30 as long as it is an angled below horizontal, towards the center of the link. Conversely, not shown, compression link 122/#s can use the right angle style of recess provided that the vertical portion runs down towards the center of the link, instead of up and away from the center as shown in recess 126/27.

Note: rod 124 can sometimes be an identical part to, and connected in the same fashion as, axle 20/# or some fingers 32/#. This is because they are all cylinders extending horizontally from stapler assembly 24/#, base 11/#, and/or arm 22/#. Also note a pivoting motion must occur between the link and the stapler component that it is connected to. However, the pivoting motion can be between rod 124 and link 122/# and/or between rod 124 and stapler assembly 24/#, base 11/#, or arm 22/#.

Cam Stapler

Just as there are many possible alternate embodiments using the link type coupling, there are also many different kinds of cam type couplings between arm 22/# and stapler body 25. There are four kinds of cams that can be used to construct alternate embodiments of the mid-zone stapler. The first uses two cam surfaces 30/#, while the remaining three use one cam surface 30/# and finger 32/#. The difference between the surface of finger 32/# and cam surface 30/# is that the curvature of finger 32/# is at least an order of magnitude smaller than the curvature of cam surface 30/#. The resulting difference is the way that contact point 31/# moves along either surface. In the case of the cover pivot stapler, contact point 31/1 moves primarily along cam surface 30/1. The movement of contact point 31/1 along the surface of finger 32/1 is infinitesimal and quite unnoticeable. The advantage of this is the simplicity of giving cam surface 30/1 primary control over the movement of contact point 31/1. Shown in FIG. 39, the two cam surfaces, 30/39A and 30/39B, interact with each other to control the movement of contact point 31/1.

3 Cams

Figure 40:
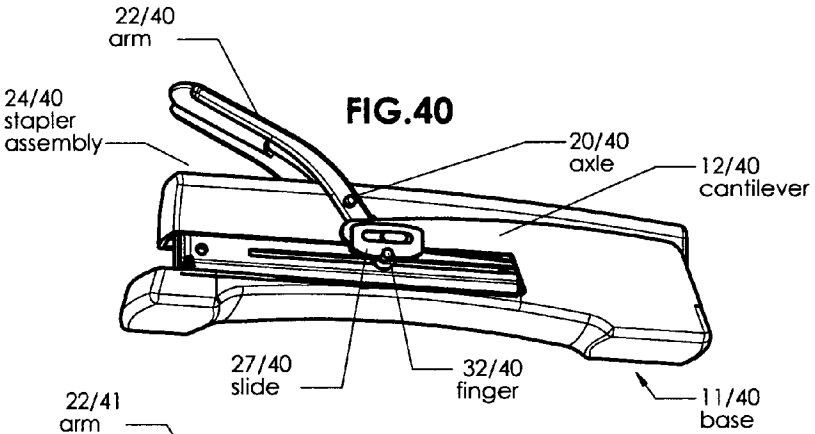
FIG. 40

The three types of cams using a combination of finger 32/# and cam surface 30/# are simple, roll, and slide cams. The cover pivot stapler is an example of the simple cam. Simple refers to the simple one part construction of cam finger 32/1. As cam finger 32/1 of the cover pivot stapler slides along cam surface 30/1, it also rotates slightly. Finger 32/1 accommodates and is involved in the combined action of cam sliding and rotation. As shown in FIG. 40, by contrast, the finger 32/40 pivotally engages a slide 27/40 so that there is only a rotational interface between the two. The slide 27/40 slides against cam surface 30/40 so that there is only a sliding interface between these last two. Restated, the pivoting and sliding cam actions are separated by slide 27/40.

Rolling Cam

The third type of cam is a roll cam. Shown in FIG. 14, finger 32/14 is a hub 58/14 with an outer concentric wheel, roller, or bushing 57/14 that is free to spin or rotate. Contact point 31/14 becomes the point of connection between bushing 57/14 and cam surface 30/14. Accordingly, finger 32/14 rolls instead of sliding along cam surface 30/14.

Shown in FIG. 14, finger 32/14 is a nylon bushing 57/14 on a metal pin. The metal pin, hub 58/14, is press fit into a hole in cover sidewall 29/14 as a means of attachment. The mid-zone staplers with roll cams shown in FIGS. 76, 77A and 77B will be discussed in greater detail in later text.

Notice that the two parts of the cam, a finger 32/# and a cam surface 30/#, are interchangeable. Functionally, it doesn't matter which side the finger 32/# is on and which side the cam surface 30/# is on. For example, when finger 32/1 is on the arm 22/1 and the cam surface 30/1 is on the cantilever 12/1, they could just as easily be reversed. The finger 32/1 could be on the cantilever 12/1, while the cam surface 30/1 contacts arm 22/1. As previously noted, the cam can have two similar cam surfaces 30/# and no finger 32/#, depending on the movement requirements and ensuing curvatures. Accordingly, a cam can be thought of as arm 22/# having one cam surface and base 11/# or stapler assembly 24/# having a second cam surface.

Also, a finger 32/# can be on the surface extending vertically or horizontally. As shown in FIG. 1, finger 32/1 is the vertical extension from the proximal end of the arm 22/1. In FIG. 35, finger 32/35 is a horizontal extension from the proximal end of arm 22/35. Accordingly, all fingers 32/# can be vertical or horizontal extensions, or become cam surfaces 30/#.

Pivot, Cam, & Link

To reiterate, there are three basic ways to connect arm 22/# to base 11/# and stapler assembly 24/#: by pivot, cam, and link. However, the different embodiments of the pivots, cams, and links and the different combinations between them lead to thousands of possible mid-zone stapler embodiments. Many of these possibilities have been organized into a matrix format called the coupling table, shown in table 1. The coupling table not only organizes the information, it also shows which combinations are possible and which are not. First, a general explanation of the coupling table, its layout, its notation, and its general use will be disclosed. More precise rules, explanation and limitations will then follow.

Coupling Table

As shown in table 1, the coupling table has seven categories of choice. The first category, category one, has three boxes: pivot, cam, and link. Pivot, cam and link represent horizontal sections creating a matrix with the six remaining vertical categories. Category two has three matrix boxes. Category three has five matrix boxes. Categories four through seven have six matrix boxes each.

Each matrix box in the coupling table represents a particular configuration, orientation, or placement of a mid-zone stapler component. A letter with a hyphen on each side followed by a word denotes the choices in each matrix box. There are anywhere from zero to four choices in each matrix box. A matrix box, or portion thereof, that has no choice is marked by a horizontal line.

Category 1

The first choice is between pivot, cam, and link. After choosing one of those, a choice is made from category two, then category three, and so on. For example, if cam is chosen in category one, then the next choice is in to between -A- protrusion and -B- surface 2. This is followed by a choice in three between -E- Simple, -F- Roll, and -G- Slide. Note: the "<" mark represents a fork in the choice path, with one choice above another.

If link is chosen instead of cam, the choices are between -D- tension and -C- compression. Next, a choice made from category three, choosing from -H-, -I-, -I2-.

If the pivot section is chosen, there is no choice between -A- and -B- in category two, as shown by a horizontal line. Nor is there a choice in category three. Accordingly, the first choice is made in category four.

Category 4

Moving to a category four introduces a new layer of complexity. In the cam section, the -H- and -I- choices are available to all possible outcomes from category three. This is represented by the two choices being generally centered within the box and no horizontal lines in the box. For the link section however, the category four choices that are available depend on the choices made in category three. For example, if -H- or -I2- were chosen, a corresponding horizontal line is found in category four, meaning there is no choice to be made. If -I- was chosen in category three, then there's a choice between -J- and -K- in category four. The choices in category four correspond horizontally to the choices in category three. Categories 5 them 6 are chosen in a similar fashion.

Front/Rear

To identify and refer to the cumulative thread of choices made in table 1, the coupling table, the term pivot, cam, or link is followed by a series of hyphens and capitalized letters. For example, the coupling table notation for the cover pivot stapler is pivot-H-J-L-cam-A-E-I-J-O. This has been marked in the coupling table by a gray highlighting to help clarify the system. Or put another way, axle 20/18 and arm 22/1 form a pivot-H-J-N. Finger 32/1 and cam surface 30/1 together constitute cam-A-E-I-J-O. Notice that "pivot" comes before "cam" in the notation. This identifies the positions of these two arm 22/# couplings. The pivot, cam, or link that's listed first is closer to the front, or first end, of the mid-zone stapler. Accordingly, this arm 22/# coupling is also referred to as the first coupling. More specifically, it's the connection between arm 22/1 and stapler assembly 24/1. The other arm 22/# coupling, listed second, is closer to the rear of the mid-zone stapler than the first coupling. Correspondingly, this coupling is also referred to as the second coupling. More specifically, the second coupling is the connection between arm 22/1 and base 11/1. The meanings of the letters will be explained in later text.

Coupling Table: Details

More precise rules, explanations and limitations of table 1, the coupling table, are as follows.

1) Of the two arm 22/# couplings, start with the frontmost one, the arm 22/# and stapler assembly 24/# coupling. Pick one of three couplings in one: pivot, cam, or link. Make the appropriate selections from category 2 then 3 etc. Next choose a pivot, cam, or link for the remaining, rearward, coupling. Note: this means both couplings can be picked from the same section, except for the pivot. For example, both couplings could be cams, but compound lever mechanics do not allow two pivots to work together. This is due to the fact that the distance between the two arm 22/# couplings changes during the stapling operation. Accordingly, the one exception to this would be an arm 22/# with arm sides 21/# that can expand and contract in the portion between the two arm 22/# couplings. A telescoping mechanism, not shown, would be one way to achieve this.

2) For the link section, note that choosing to use a compression link with a cam or another link is possible, but requires limiting the angular rotation of the compression link, from as little as about 5° up to 309 clockwise or counterclockwise.

3) While not necessary, typically, one of the two selected couplings is fixed while the other is releasable. If both are fixed, it prevents cover 28/# from opening, requiring alternate methods of opening or staple access. If both couplings are releasable, it causes the arm to be removable or requires an alternate attachment method.

4) Any change from one option to another in the above table will typically require a corresponding dimensional change in the mid-zone stapler for proper handle positioning, maintaining leverage ratios and full functionality. This includes dimensions involving cantilever 12/#, arm 22/#, and the placement of arm 22/#'s coupling points to stapler assembly 24/# and cantilever 12/#.

5) Note: in the compression link section, an asterisk follows the three letters: -I-, -J-, and -S-. This is to call attention to a limitation in choice. Any two letters can be chosen, but the combination of all three together is not an option.

The explanation of coupling table's matrix box notations and options is as follows.

Pivot

First select the pivot section in category 1. Categories 2 and 3 have no options, as represented by a horizontal line, and are skipped.

Pivot section, category 4 presents an option between a permanently connected pivot and a releasable pivot. Pivot referring to arm 22/# pivoting on axle 20/#. "-H- fix" represents a fixed or permanent pivot and "-I- release" represents a releasable pivot.

Pivot section, category 5 refers to the mid-zone stapler component that axle 20/# extends from, either arm or body. Body refers to stapler body 25, which the combination of base 11/# and stapler assembly 24/#. Restated, "-K- Body" is the entire stapler except for arm 22/#. Accordingly "-K- body" represents axle 20/# connected to either stapler assembly 24/# or base 11/#. Which one is determined by the order of the pivot-cam-link notation. If "pivot" is in the front position then the coupling is to stapler assembly 24/#. If "pivot" is in the rear position then the coupling is to base 11/#. "-J- Arm represents axle 20/# connected to arm 22/#.

To reiterate, when pivot is in the front notation position, that's saying it's listed first. When pivot is in the rear notation position, that saying it's listed second. Accordingly, these positions and types of mid-zone staplers are referred to as 1st pivot staplers and 2nd pivot staplers. However, the notation of $1^{st}$ pivot stapler and $2^{nd}$ pivot stapler are somewhat broader than this. Because there is rotational movement in all the coupling types, pivot, cam, and link, the issue of whether the coupling is fixed or releasable is more significant to the mid-zoned stapler functionality. Accordingly, a $1^{st}$ pivot stapler is any mid-zone stapler with a fixed first coupling and a releasable second coupling. Correspondingly, a $2^{nd}$ pivot stapler is any stapler with a fixed second coupling and a releasable first coupling Pivot section, category 6 refers to the transverse extension of axle 20/# from its point of connection, towards either the interior or exterior of the mid-zone stapler. "-N- in" represents inward extension, "-M- mid" represents inward and outward extension, and "-L- out" represents outward extension. "-M- mid" also represents axle 20/# extension between two points of connection. Note: this category 6 choice controls the transverse position of the arm side 21/# relative to the component it's connected to, either cantilever 12/#, support 14/#, or cover sidewall 29/#.

Cam

First select cam section in category 1. The table shows the cam section, category 2 presenting a choice between a protrusion and a second surface. In this case, the cam has a first surface in every instance and it is the addition of the protrusion or the second surface that is chosen. The interaction and connection between the first surface and the protrusion or second surface constitutes the cam. "-A- protrusion" represents finger 32/# and "-B- surface 2" represents cam surface 30/#.

Cam section, category 3: "-E- simple" represents a finger 32/# that slides and rotates along cam surface 1. "-F- roll" represents a finger 32/# as a bushing 57/# and hub 58/# that rolls along cam surface 30/#. "-G- slide" represents a finger 32/# rotating in slide 27/# while slide 27/# slides along cam surface 30/#.

Cam section, categories 4 and 5 have the same meanings as outlined in the pivot sections. The only difference is they refer to the protrusion or surface 2 instead of to axle 20/#.

Cam section, category 6 is similar to the pivot section's category 6 in referencing the orientation of extension from the point of connection. One difference is it refers to the protrusion, finger 32/#, instead of axle 20/#. Again, there are three transverse orientations, but the difference is that there is also a vertical orientation. "-N- in" represents inward extension, "-M- mid" represents inward and outward extension, and "-L- out" represents outward extension. "-O-vertical" represents vertical extension. Again, "-M- mid" also represents finger 32/#'s extension between two points of connection. As an example, see FIG. 77B. Again, note that these choices control the transverse position of the arm side 21/# relative to cantilever 12/#, support 14/#, or cover sidewall 29/#.

Cam section, category 6 has a different set of choices for the -G-slide selection from category 3. The issue here is whether finger 32/# is an extension of slide 27/# or an extension of a stapler component. "-P- Slide" represents finger 32/# as an extension of slide 27/#. "-Q- Stapler" represents finger 32/# as an extension of a stapler component: either arm 22/#, stapler assembly 24/# or base 11/#.

Link

First, select link section in category 1. The table shows the link section, category 2 presenting a choice between a tension type link and a compression style link. "-D- tension" represents the tension link and "-C- compression" represents the compression link Link section, category 3 presents a choice between a fixed link and two types of releasable links. "-H- fix" represents the fixed link. "-I- free-1" represents a releasable link that is releasable on one end, and fixed on the other end. "-I2- Free-2" represents a link that is releasable on both ends. Link section, category 4, similar to the pivot category 5, refers to the mid-zone stapler component, either arm or body, that link 122/# is fixably connected to. "-J-arm" represents link 122/# fixably connected to arm 22/#. "-K- body" represents link 122/# fixably connected to either stapler assembly 24/# or base 11/#. Note: if "-I2- Free-2" was selected in category 3 there is no choice available here, because link 122/# releases from both "-J-arm" and "-K- body".

Link section, category 5: When link 122/# is releasably connected to a given mid-zone stapler component, it is specifically rod 124 that is released. The choice in category 5 is whether rod 124 is released from link 122/# or from a stapler component other than link 122/#. "Link" refers to link 122/# and "stapler" is any of three mid-zone stapler components: arm 22/#, stapler assembly 24/#, and base 11/#. "-R-R-link" and "-S-S-stapler" refer to the stapler component that releases from either single end of link 122/#. This applies to both the free-1 and free-2 choices from category 3. However, for the free-2 choice from category 3, a second selection for release of the other end of link 122/# must be made. To do this the same "-R-R-link" and "-S-S-stapler" choices are made again. Thus, there can be two "R" or two "S" choices, or one "R" with one "S" choice. Accordingly, the table shows "-R-R-link" and "-S-S-stapler" to represent the potential redundant use of letters in the event that free-2 has been chosen. An example of this, FIG. 22, will be discussed in later text. Note: recess 130/# and indent 125/# provide mechanisms of releasable coupling to rod 124.

Link, Category 6

Link section, category 6 refers only to recess 130/# in link 122/#, not to indent 125/# in any of the other mid-zone stapler components. More specifically, category 6 refers to the orientation of recess 130/#'s opening. "-T-T-forward" refers to the opening facing forward towards the front of the stapler. "-U-U- rearward" refers to the opening facing rearward towards the rear of the stapler. "-V-V- away" refers to the opening facing more vertically, away from the vector of compression. Note: "-V-V- away" only applies to the compression link, not the tension link. Similar to category 5, and for the same reasons, two sets of letters are shown. When "-I- free-1" of category 3 is chosen, there is one choice in category 6. When "-I2- free-2" of category 3 is chosen and "-R-R- link" of category 5 is chosen twice, there is a second choice to be made in category 6. Stated differently, if link 122/# has two recesses 130/#, the orientation of each of them must be specified. The existence of two recesses 130/# is specified by "-R-R-". Their orientation is then specified by two letters from the set or group of letters: T, U, or V. Note: indent 125/# denoted by "-S-S-stapler", does not have an orientation choice in category 6, because a vertical opening cannot work with a tension vector.

While most of the different options in table 1's coupling table result in significantly different mid-zone staplers, it's worth noting that some options are nearly identical to each other. For example, pivot-H-J-N- appears to be nearly identical to pivot-H-K-L-. The -J-N- notation means axle 20/# is connected to, and extends outwardly from, arm 22/#. The -K-L- notation means axle 20/# is connected to, and extends inwardly from, cantilever 12/#. In both instances most of the cylindrical extension of axle 20/# is in the same place and looks very similar. The difference is when arm 22/# rotates, the -J-N- axle 20/# rotates with it and the -K-L- axle 20/# does not.

Full Notation

A more detailed example the coupling table's notation of the mid-zone staplers is as follows. The cover pivot stapler is a pivot-H-J-L-cam-A-E-I-J-O stapler. The pivot part of pivot-H-J-L means that one of the two arm 22/1 couplings is pivotable. Pivot being listed first, in front of cam, means that the pivot is the coupling between arm 22/1 and stapler assembly 24/1. The -H-notation means the pivot is fixed, not releasable. The -J- notation means the pivot's axle 20/# is connected to arm 22/1. The -N- notation means that axle 20/# extends inwards towards the center of the stapler from arm 22/1.

Cam portion cam-A-E-I-J-O, of pivot-H-J-L-cam-A-E-I-J-O, means the other arm 22/1 coupling is a cam. The cam being listed second, after the pivot, means arm 22/1 is connected to base 11/1. More specifically, the coupling is between finger 32/1 and cam surface 30/1. The meaning of the -A-E-I-J-O notation is as follows. The -A- notation means finger 32/1 is a protrusion, not a second surface, which interfaces with cam surface 30/1. The -E- notation means finger 32/1 is a simple, typically single, part that both rotates and slides along cam surface 30/1 during the cam's motion. The -I- notation means that finger 32/1 is releasable from its coupling to cam surface 30/1. The -J- notation means finger 32/1 is connected to arm 22/1, not stapler body 25. The -O- notation means the direction of finger 32/1's extension is vertical.

Additional Clarification

For additional clarification of the table 1's coupling table, the previous alternate embodiments will be stated in coupling table notation, as follows. The FIG. 18 stapler is a pivot-I-K-L-link-D-H stapler. FIG. 21 stapler is a link-C-H-pivot-H-K-L stapler. FIG. 22 stapler is a pivot-H-J-N-link-C-I2-R-S-V stapler. FIG. 23 stapler is a link-D-H-pivot-H-K-L stapler. FIG. 24 stapler is a pivot-H-J-N-link-D-I-K-R-T stapler. Note that the I2-R-S-V- portion of the notation for FIG. 22 is worth revisiting because it is somewhat more complicated. The -I2- notation means link 122/32 is disengageable at both ends. The -R-notation means rod 124 releases from one end of link 122/32. The -S- notation means the other end of link 122/32 releases from rod 124. The -V- notation means that the recess 126/# that allows the -R- type release, is a recess 126/32 facing away from the vector of compression. Note that the opening of indent 125/22's direction is not specified. Also note that indent 125/18 is considered essentially the same as indent 125/22, even though one is part of arm 22/18 and the other is part of cantilever 12/22. This is because both are similar in shape and function, ultimately providing releasable and pivotable coupling for arm 22/#.

$1^{st}$ & $2^{nd}$ Pivot Staplers

Note that while a considerable array of cams, pivots, and links can be used to connect arm 22/# to base 11/# and stapler assembly 24/#, typically one of the two couplings will be a pivot coupling. Accordingly, it's worthwhile creating a specific notation for these two kinds of couplings and therefore two categories of mid-zone staplers: 1st pivot staplers and 2nd pivot staplers. For example, the FIG. 18 stapler, which is a pivot-I-K-L-link-D-H stapler, lists pivot before link and thus would be categorized as a $1^{st}$ pivot stapler. The cover pivot stapler is also a $1^{st}$-pivot stapler. Shown together on the same page are two $1^{st}$-pivot staplers and two $2^{nd}$ pivot-staplers. The FIG. 22 and the FIG. 24 staplers are both $1^{st}$-pivot staplers, while the FIG. 21 and FIG. 23 staplers are both $2^{nd}$ pivot staplers.

FIG. 25

Some portions of the compression table notation can also be used to label the individual parts; for example, links 122/#. Also note that many design and configuration options are not covered in the coupling table. FIG. 25, 26 are both links-H. Note that the distinction between them is not in the coupling table. FIG. 27 is a link-D-I-R-U. FIG. 28 is a link-D-I-R-T. FIG. 29 is a link-D-I2-R-R-T-T. FIG. 30 is a link-D-I2-R-R-T-U. FIG. 31 is a link-C-I-R-T. FIG. 32 is a link-C-I-R-V. FIG. 33 is a link-C-I2-R-R-V-V.

The following six alternative mid-zone stapler embodiments are staplers with cams. FIG. 34 stapler is an example of a cam-A-E-I-J-O-pivot-H-K-L stapler. This stapler is an example of a vertically extending, -O- type, finger 32/34 on an arm 22/34. Notice that finger 32/34 is an integral part of arm 22/34, extending downward towards platform 16/34. Cam surface 30/34 extends from the surface of cover 28/34, creating a point of mutual engagement, a contact point 31/34.

FIG. 35

FIG. 35 stapler is an example of a pivot-H-K-L-cam-A-F-I-J-L stapler. This stapler is an example of a horizontal outwardly extending, -L- type, finger. It has a finger 32/35, which differs from 32/34 by being an essentially cylindrical structure transversely extending from the exterior surface of an arm side 21/35. Finger 32/35 is a metal rod surrounded by a nylon bushing. The metal rod connects to arm side 21/35 through a hole in arm side 21/35 and is secured by a spot weld. The metal rod can also be a continuous part of arm side 21/35.

FIG. 36 stapler is an example of a cam-A-F-H-K-L-pivot-H-K-L stapler. This stapler is an example of a fixed, -H- type, cam. However, is also an example of a base 11/36 with no cantilever 12/#. Another change from the FIG. 34 stapler is that a finger 32/36 is connected to a cover sidewall 29/36 of the stapler. One other change is that arm 22/36 has a cam slot 120/36 in it, opening horizontally and extending along part of the length of arm 22/36. A cam surface 30/36 is on the upper surface of cam slot 120/36, facing generally downwards towards platform 16/36 when arm 22/36 is in the stapled position. Finger 32/36 extends through cam slot 120/36, limiting both arm 22/36's clockwise and counterclockwise rotation. Finger 32/36 is a metal pin surrounded by a cylindrical nylon bushing. Finger 32/36 connects to a cover 28/36 through a hole in cover sidewall 29/36 and is secured by a spot weld.

FIG. 37

FIG. 37 stapler is an example of a pivot-H-K-L-cam-A-F-I-K-L stapler. This stapler is an example of a cam surface 30/37 on the proximal end of arm 22/37, providing an upward facing surface. Cam surface 30/37 is a molded or machined continuous portion of arm 22/37. This stapler also has a roll cam -F- that is similar to the roll cam in FIG. 76, except that a finger 32/37 is supported on only one side and is connected to a cantilever 12/37. To prevent interference from cantilever 12/37, finger 32/37 extends below it to engage a cam surface 30/37. Note: is finger 32/37 extended inwardly, -N-, instead of outwardly, -L-, it wouldn't have to extend below cantilever 12/37. Also note that not every effect from the coupling table is explicitly specified in the notation. For example, the fact that cam surface 30/37 is connected to arm 22/37 is not specified in the notation. However, it is implied and required as a consequence of FIG. 37 stapler's notation, primarily the cam's "-K-" notation, indicating finger 32/37 is attached to base 11/37.

FIG. 38 stapler is an example of a cam-A-E-I-K-L-cam-A-E-I-J-L. This stapler is an example of a mid-zone stapler with two cams. As a result of the two cams, there are two fingers 32/38A and 32/38B. Finger 32/38A is connected to a cover 28/38 and finger 32/38B is connected to an arm 22/38. Correspondingly, there are two inset cams surfaces 30/38A and 30/38B, one in arm 22/38 and the other in cantilever 12/38. The cam surfaces 30/# are inset to limit the finger 32/38's travel. With their open insets, these cams provide the stapler with two releasable couplings. This means arm 22/38 can be removed by simply lifting handle 23/36 up and back. Making arm 22/38, a removable arm means that it can be removed, replaced, and/or exchanged. This can provide better storage or prevent unauthorized use. It also would allow changing arms 22/#. Additionally, the same arm 22/# with multiple connection points could be used in different configurations. The last two points, not shown, would allow a change of leverage or adjustment for different size staples. One way to more securely attach arm 22/38, but maintain releasability, could employ a magnetic means of securement.

FIG. 39 stapler is an example of a pivot-H-K-L-cam-B-I stapler. This stapler is an example of a single cam with a second cam surface: a -B- type cam. One cam surface 30/39A, somewhat similar to the cover pivot stapler's cam surface 30/1, is on the downward facing surface of cantilever 12/39. The other, cam surface 30/39B, being on the proximal end of arm 22/39, is somewhat similar to the cam surface 30/37. This stapler has no finger 32/#.

FIG. 40

Figure 43:
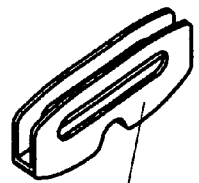
FIG. 43 is a perspective view of a slide.

An example of pivot-H-K-L-cam-A-G-I-J-L is shown in FIG. 40. This FIG. 40 stapler is an example of a slide cam, -G-type, stapler. In this embodiment, axle 20/40 creates the same pivot as the cover pivot stapler. Finger 32/40, however, differs from 32/1 by being an essentially cylindrical structure transversely extending from the exterior surface of an arm side 21/40. Finger 32/40 is a metal rod that attaches to arm side 21/40 through a hole in arm side 21/40 and is secured by a spot weld. Note: the metal rod could molded or machined as an integral part of arm side 21/40. Finger 32/40 is releasably connected to a slide 27/40. As shown in FIGS. 43 and 40, slide 27/40 is an injection molded nylon part that is slidably attached to cantilever 12/40. A channel in slide 27/40 accommodates the width of cantilever 12/40. A slot in slide 27/40 fits over a short horizontal extension in the cantilever l2/40 as a means of slidable attachment.

Figure 41B:
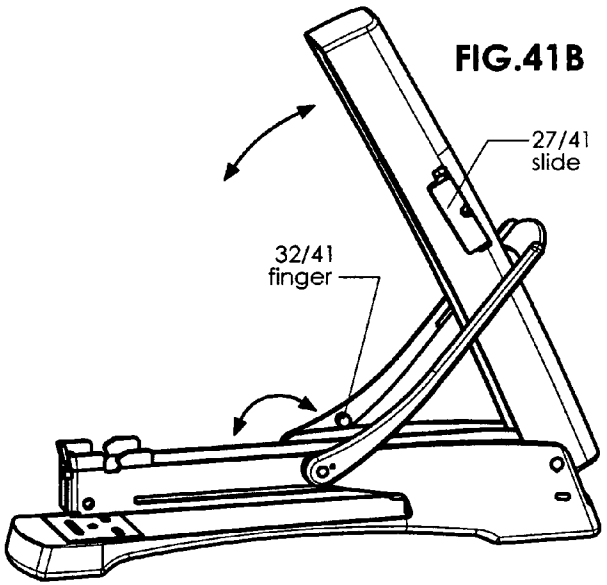
FIG. 41B is a perspective view of an alternate embodiment of a cam slide type stapler, shown in a open configuration.
Figure 44:
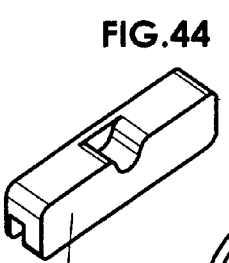
FIG. 44 is a perspective view of a slide.
Figure 41A:
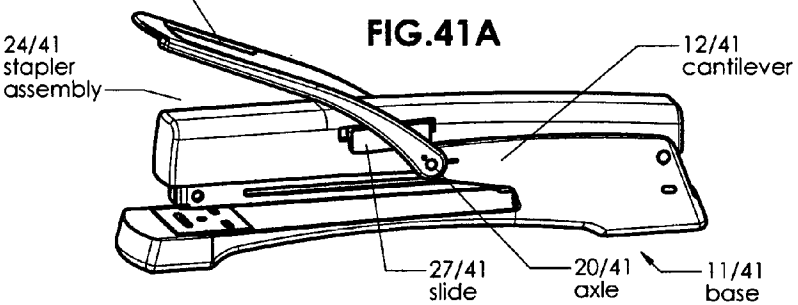
FIG. 41A is a perspective view of an alternate embodiment of a cam slide type stapler, shown in a ready configuration.

An example of cam-A-G-I-J-N-pivot-H-K-L is shown in FIGS. 41A and 41B. This FIG. 41A stapler is an example of a slide cam stapler with slide 27/41 connected to cover 28/41. It has a slide 27/41 with a channel that accommodates the width of cover 28/41. Slide 27/41 is slidably connected to cover 28/41 and placed into an opening in cover 28/41. Arm 22/41 has a finger 32/41 that releasably connects to slide 27/41. As shown in FIG. 44, slide 27/41 is an asymmetric part with a thicker portion on one side. The thicker portion is placed between cover 28/41 and arm 22/41. This allows finger 32/41 to engage slide 27/41 without hitting cover 28/41. Notice in FIG. 41B that finger 32/41 hits cantilever 12/41 when arm 22/41 is rotated backward. This limits the amount that cover 28/41 can open. One solution to this would be to make the cantilever 12/41 placement wide enough to be outside of arm 22/41. In this case, the coupling table notation would change from pivot-H-K-L to pivot-H-K-N.

FIG. 42

Figure 45:
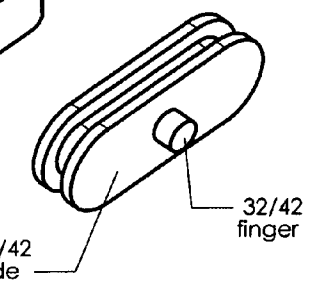
FIG. 45 is a perspective view of a slide.
Figure 42:
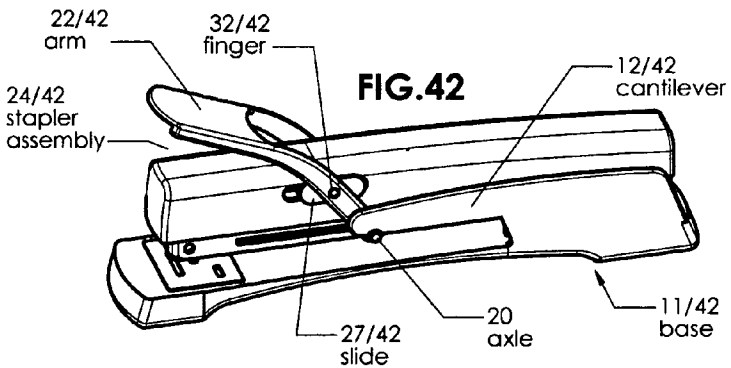
FIG. 42 is a perspective view of an alternate embodiment of a cam slide type stapler, shown in a ready configuration.

An example of cam-A-G-H-K-L-pivot-I-J-L is shown in FIG. 42. In this embodiment, a slide 27/42 is slidably connected to cover 28/42 in a manner similar to FIG. 41A stapler. The difference, shown in FIG. 45, is finger 32/42 extending from slide 27/42 instead of from arm 22/41. Note that slide 27/42 is symmetric except for finger 32/42.

A slide 27/40, shown in FIG. 43, can be categorized as a slide-H-J. A slide 27/41, shown in FIG. 44, can be categorized as a slide-I-J. A slide 27/42, shown in FIG. 45, can be categorized as a slide-H-K-LN. The -LN notation means finger 32/42 is horizontally oriented, allowing either -N- or -L-configurations, but not allowing a vertical -O- configuration. In other words, the part prohibits an -O- configuration, but choice between the -N- or -L- configurations can only be determined when the part is used in the assembled mid-zone stapler.

Base Pivot Stapler

Figure 46:
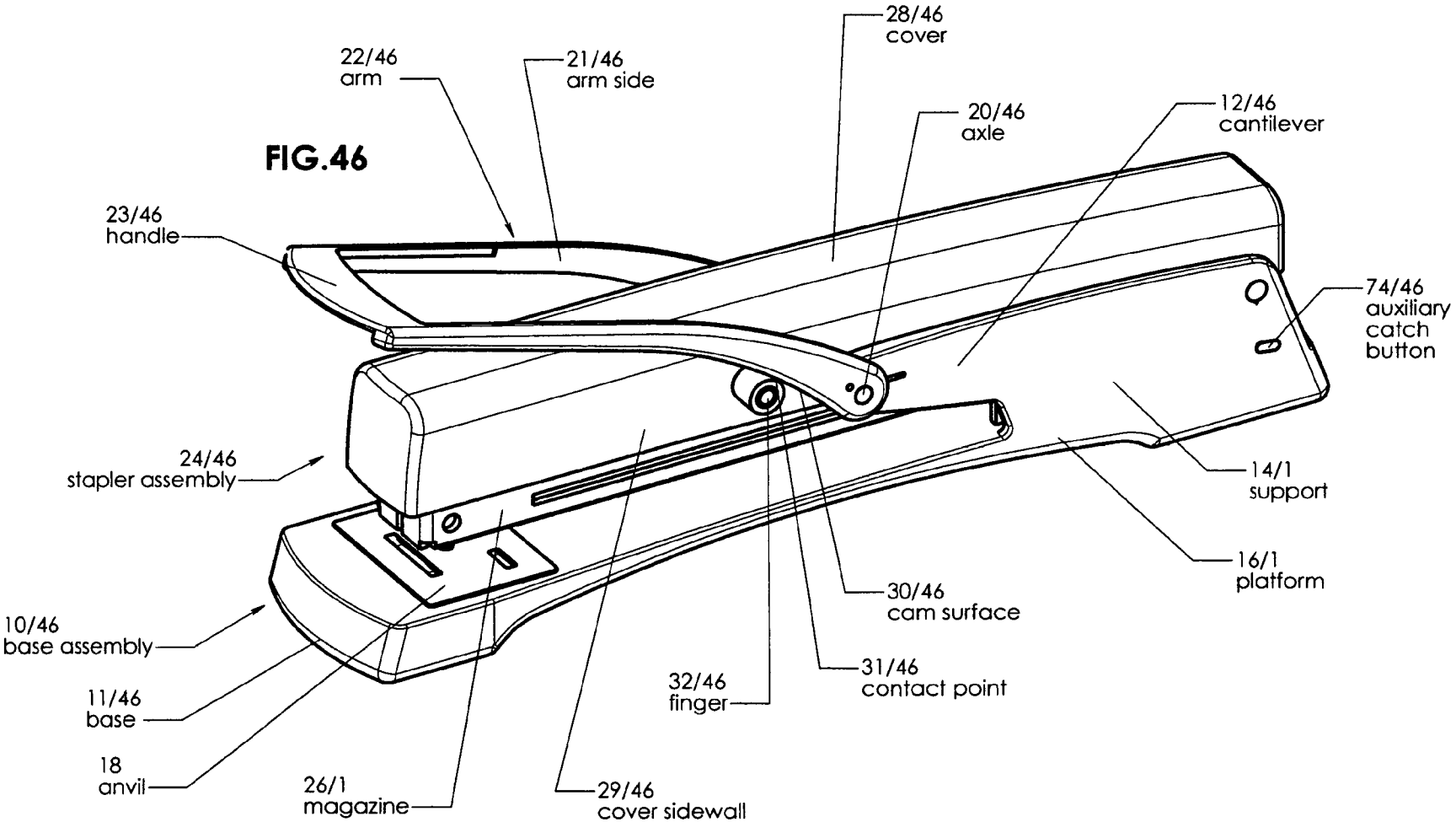
FIG. 46 shows high-angle perspective view of base pivot stapler.

An alternate embodiment of the mid-zone stapler is a base pivot stapler, which could also be called a FIG. 46 stapler. As shown in FIG. 46, it has the same compound leverage system as the cover pivot stapler. However, the placement of the axle 20/46 and cam surfaces are different. The base pivot stapler's arm 22/46 is pivotally connected to a cantilever 12/46 instead of to stapler assembly 24/16. A cam surface 30/46 is on an arm 22/46, not cantilever 12/46. A finger 32/46 is connected to a stapler assembly 24/46 instead of arm 22/46. The table 1, coupling table's notation for the base pivot stapler is cam-A-F-I-K-L-pivot-H-K-L stapler.

Arm 22/46 rotates on the pair of axles 20/46. However, as shown in FIG. 46, each axle 20/46 is located at the proximal end of an arm side 21/46. Each axle 20/46 connects its respective arm side 21/46, to its respective cantilever 12/46. As a method of attachment, each axle 20/46 is placed into a hole in its respective cantilever 12/46 and is then spot-welded in place.

Finger

Figure 47:
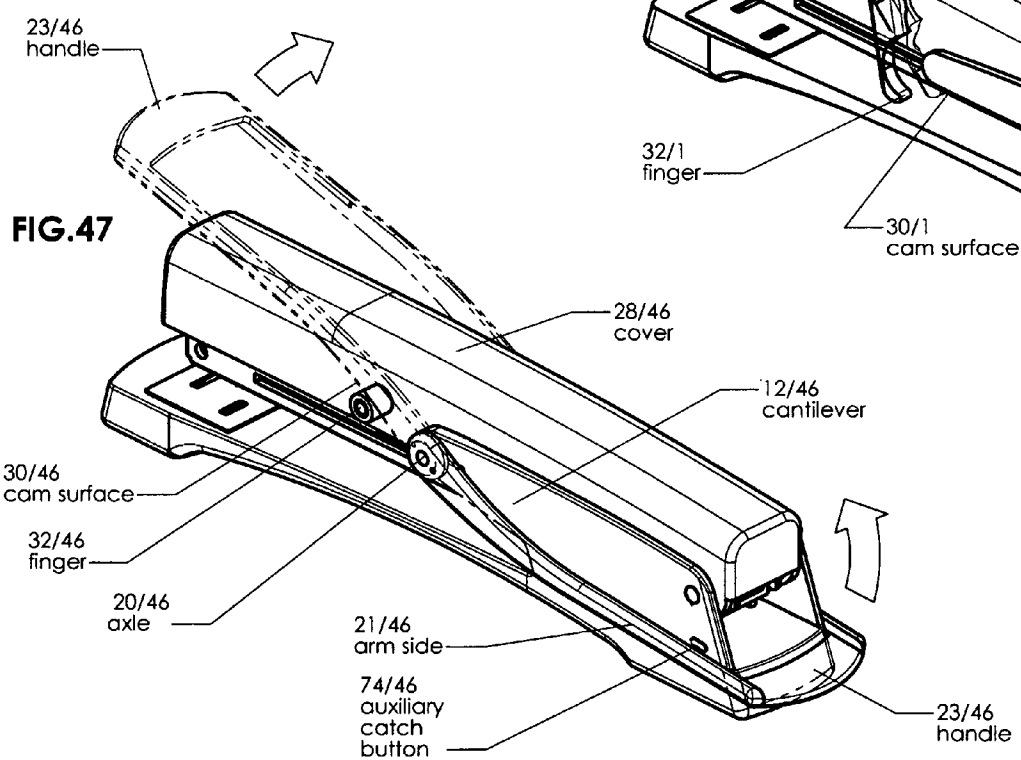
FIG. 47 base pivot stapler moving from a ready configuration to a disengaged configuration.
Figures 49A, 49B, 49C:
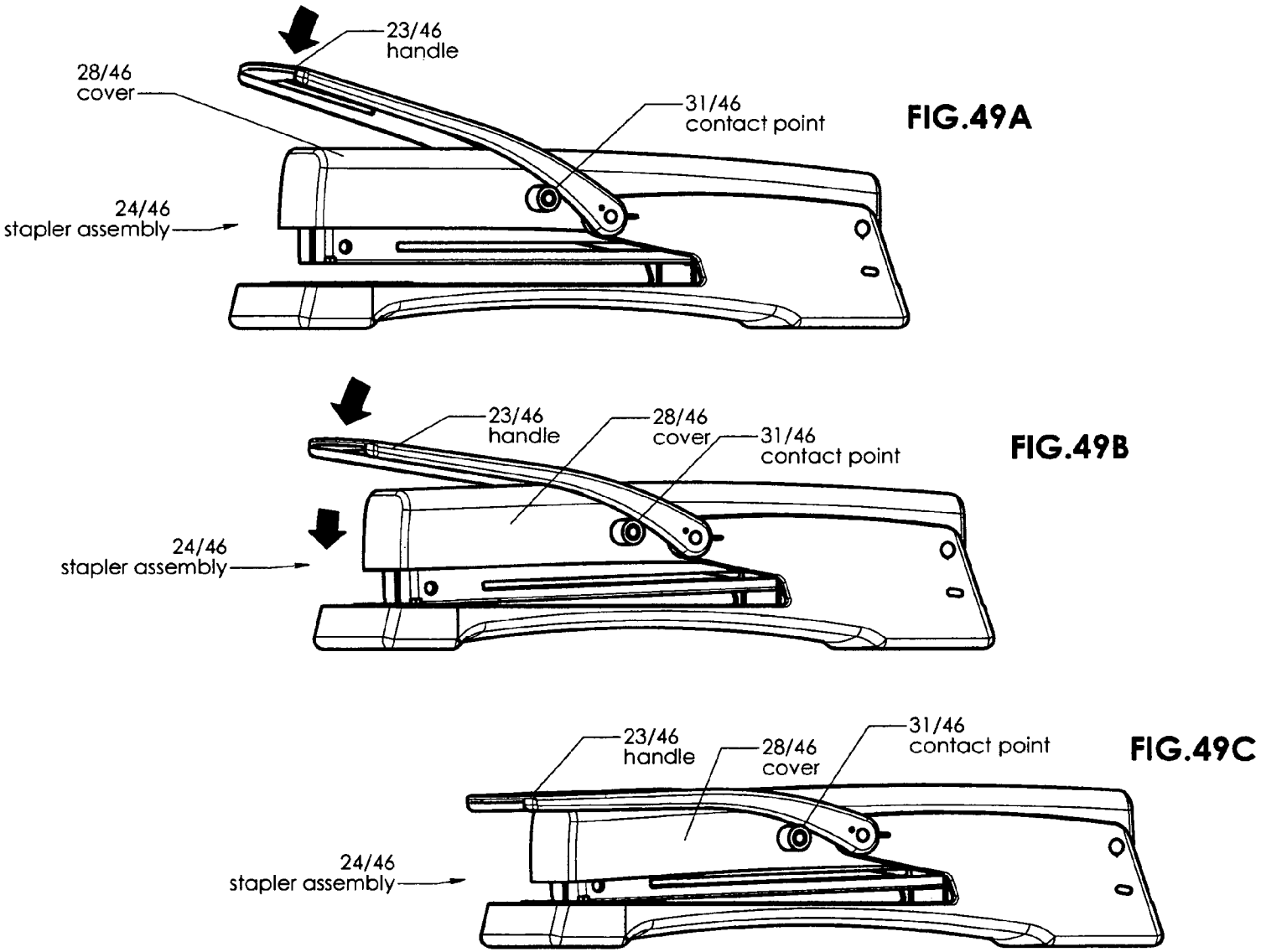
FIG. 49A base pivot stapler in a ready configuration.
FIG. 49B base pivot stapler in a stapling configuration.
FIG. 49C base pivot stapler in a stapled configuration.
Figures 50A, 50B, 50C:
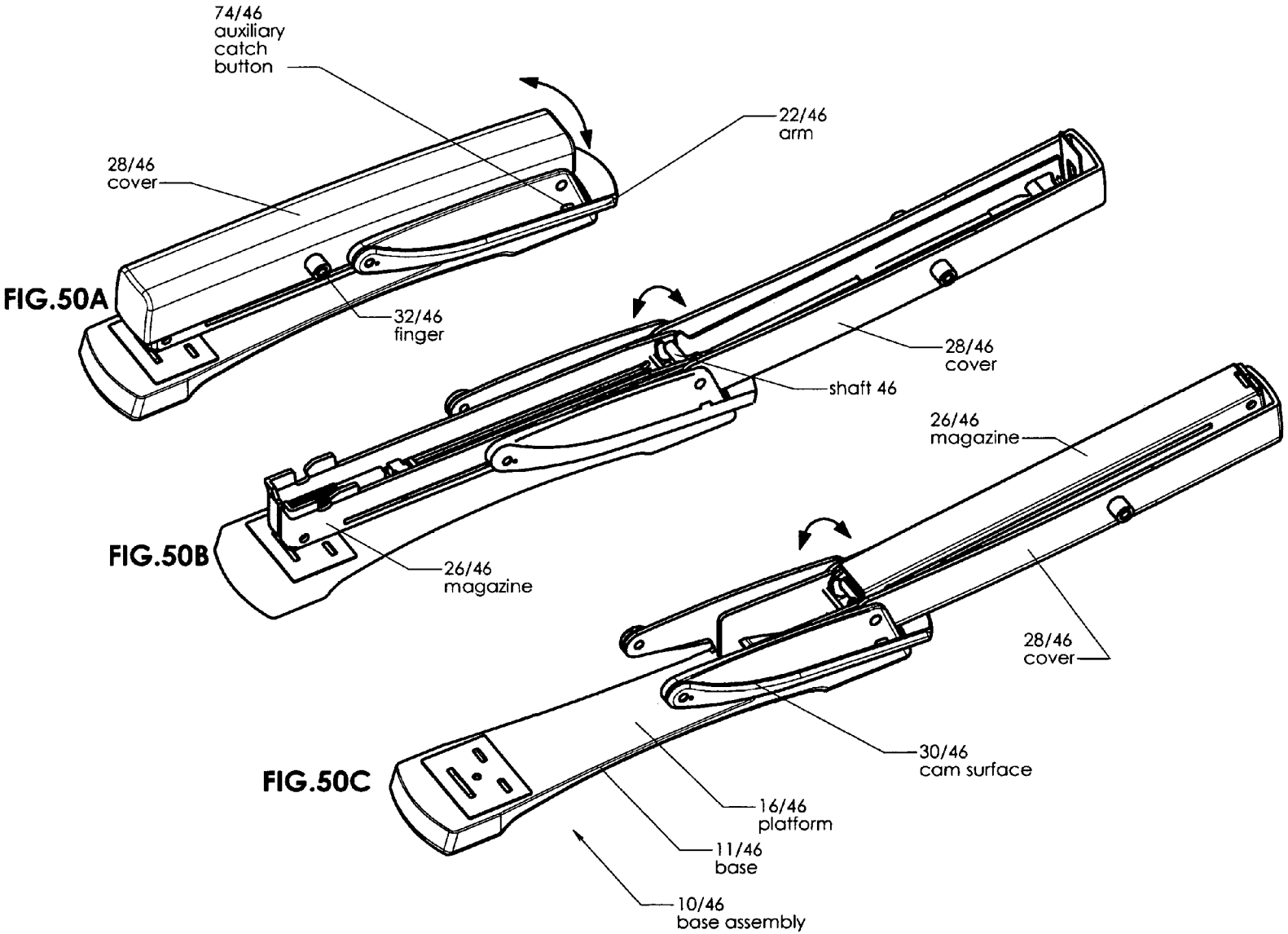
FIG. 50A base pivot stapler in a disengaged configuration.
FIG. 50B base pivot stapler in a staple access configuration.
FIG. 50C base pivot stapler in a tacking configuration.

As shown in FIGS. 46, 47, and 50A, finger 32/46 is similar to finger 32/36. Accordingly, it extends outwardly from its connection to a cover sidewall 29/46 of the base pivot stapler. Correspondingly, a cam surface 30/46 is the surface on the underside of an arm side 21/46, in the mid-arm portion of arm side 21/46. When arm 22/46 is in the stapled position, cam surface 30/46 faces platform 16/46. As shown in FIG. 46, finger 32/46 is a metal pin surrounded by a cylindrical nylon bushing. Finger 32/46 attaches to a cover 28/46 through a hole in cover sidewall 29/46 and is secured by a spot weld. Axle 20/46 is a metal pin secured to cover 28/46 by spot weld or press fit.

An arm 22/46 is a cast metal part. Shown in FIG. 47, arm 22/46 has a handle 23/46 and arm sides 21/46, which together are sized to allow handle 23/46 to clear cover 28/46 as arm 22/46 rotates forward or backward. Notice how this provides clearance, unlike handle 23/18 seen in FIG. 18.

As shown in FIG. 47, the base pivot stapler, like the cover pivot stapler, has an arm spring 60 that rotates arm 22/46 forward to maintain pressure against finger 32/46. An additional similarity is that base pivot stapler has a catch button 74/46 that holds arm 22/46 back in the disengaged configuration despite the forward rotational spring pressure from arm spring 60. However, note that catch button 74B is a part of base assembly 10/16 and that handle 23/46 is rotated all the way back behind the stapler when it's in a disengaged configuration.

Figure 48:
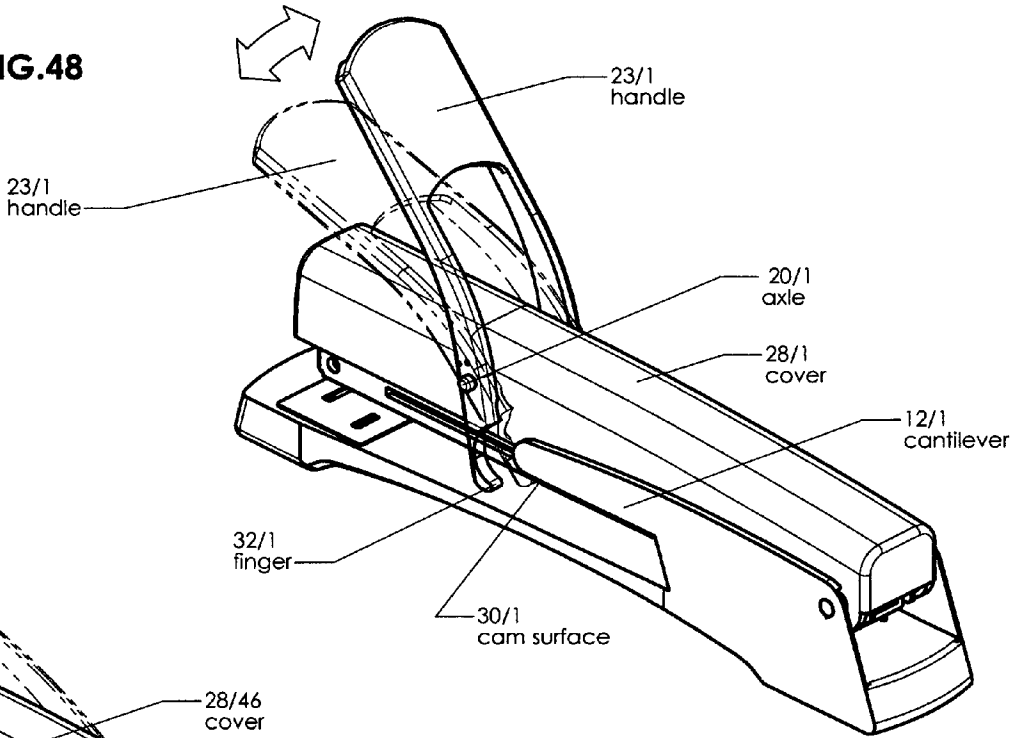
FIG. 48 cover pivot stapler moving from a ready configuration to a disengaged configuration.

Note FIG. 47 shows arm 22/46 in a see-through phantom style to show arm 22/46 in both the ready configuration, rotated towards the front, and the disengaged configuration, rotated towards the rear of FIG. 46 stapler. For comparison, FIG. 48 shows the cover pivot stapler's arm 22/1 in the same see-through style, in the same ready and disengaged configurations.

Operation of the Base Pivot Stapler

From the user point of view, the base pivot stapler's stapling operation is the same as the cover pivot stapler. As seen in FIGS. 47 and 48, handle 23/46 starts in essentially the same place. To staple, users push handle 23/46 down in the same way, moving the stapler assembly 24/16 down with a similar increase in leverage. Also, handle 23/46 must rotate up to allow staple access and open stapling. As previously stated, the difference between the two mid-zone staplers is not the general way the cam surfaces and axle 20/46 work, but where they are positioned.

Difference from Cover Pivot Stapler

Functionally, the biggest difference between the cover pivot stapler and the base pivot stapler is the way cover 28/46 is pivoted back into the staple access configuration shown in FIG. 50B. Or similarly, cover 28/46's position shown in FIG. 50C, with the base pivot stapler in the tacking configuration shown in FIG. 50C. Compared with the cover pivot stapler's handle 23/1, handle 23/46 must rotate much further up and back, nearly 180 degrees, to move into the disengaged configuration as shown in FIG. 50A. This process is reversed to bring a base pivot stapler back into the ready configuration.

For handle 23/46 to rotate behind the stapler, axle 20/46 must be placed at or behind the middle of the base pivot stapler. The exception to this is if arm 22/46 is made longer. Then axle 20/46 can move forward, but handle 23/46 will extend, by the same amount, beyond the front of the stapler.

Additional Embodiments of $2^{nd}$ Pivot Staplers

FIG. 51

The following alternate embodiments of the mid-zone stapler apply $2^{nd}$ pivot type stapler.

Figure 51:
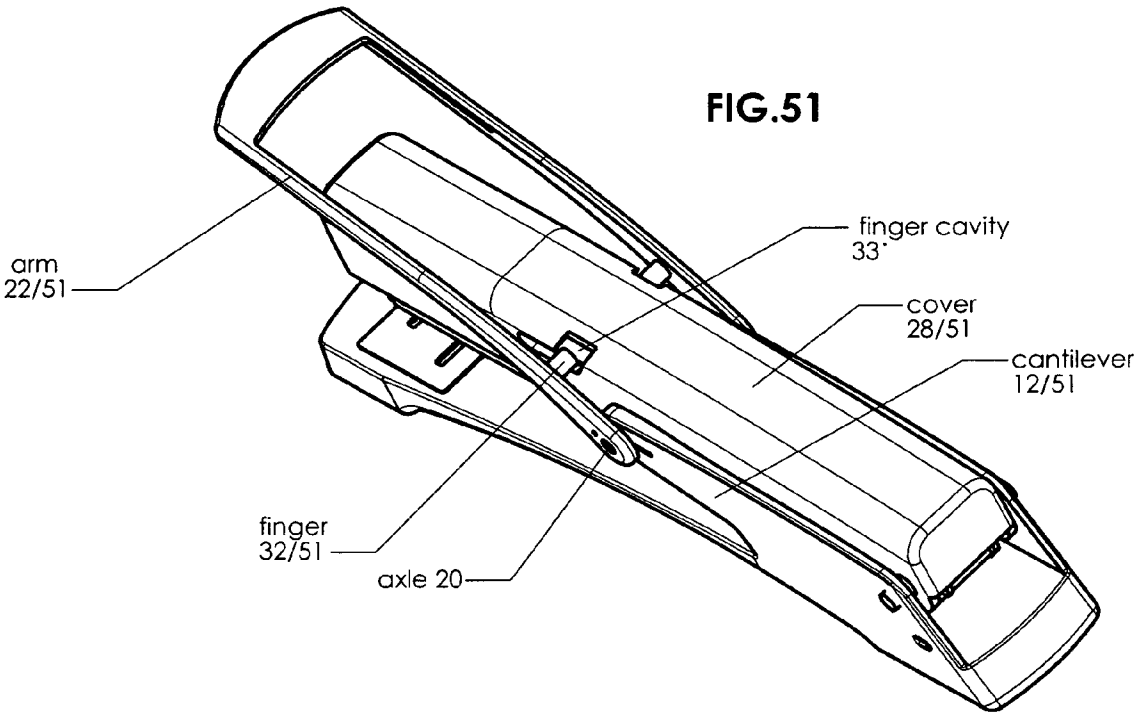
FIG. 51 is a perspective view of FIG. 51 stapler.
Figure 52:
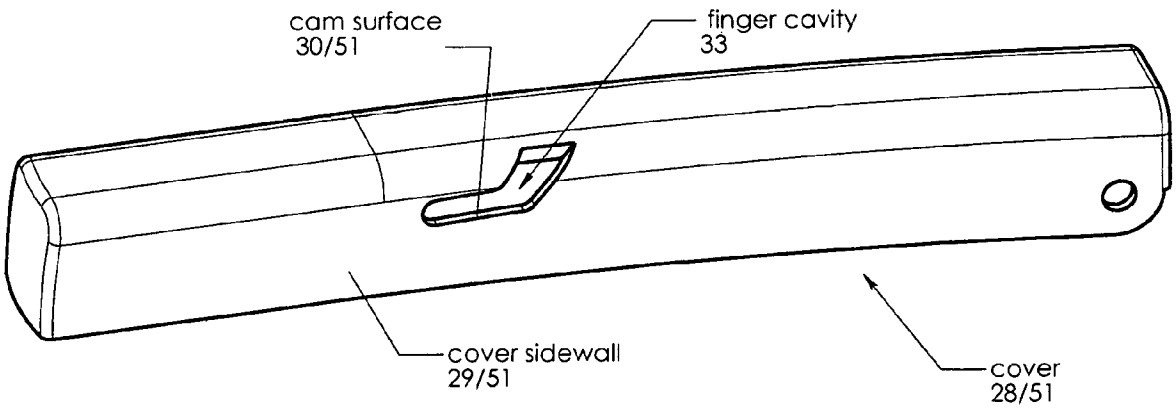
FIG. 52 is a perspective view of FIG. 51 stapler's cover 28.

As shown in FIGS. 51 and 52, a variation of the 2nd pivot type stapler is a FIG. 51 stapler with a cam-A-E-I-J-N-pivot-H-K-L notation. This embodiment has a finger 32/51 connected to an arm 22/51, extending transversely inwards, and has a cam surface 30/51 as an upward facing surface of a slot in a cover sidewall 29/51. Note that cam surface 30/51 could also be an upward facing surface of a protrusion extending transversely from the exterior surface of cover sidewall 29/51.

Figure 53:
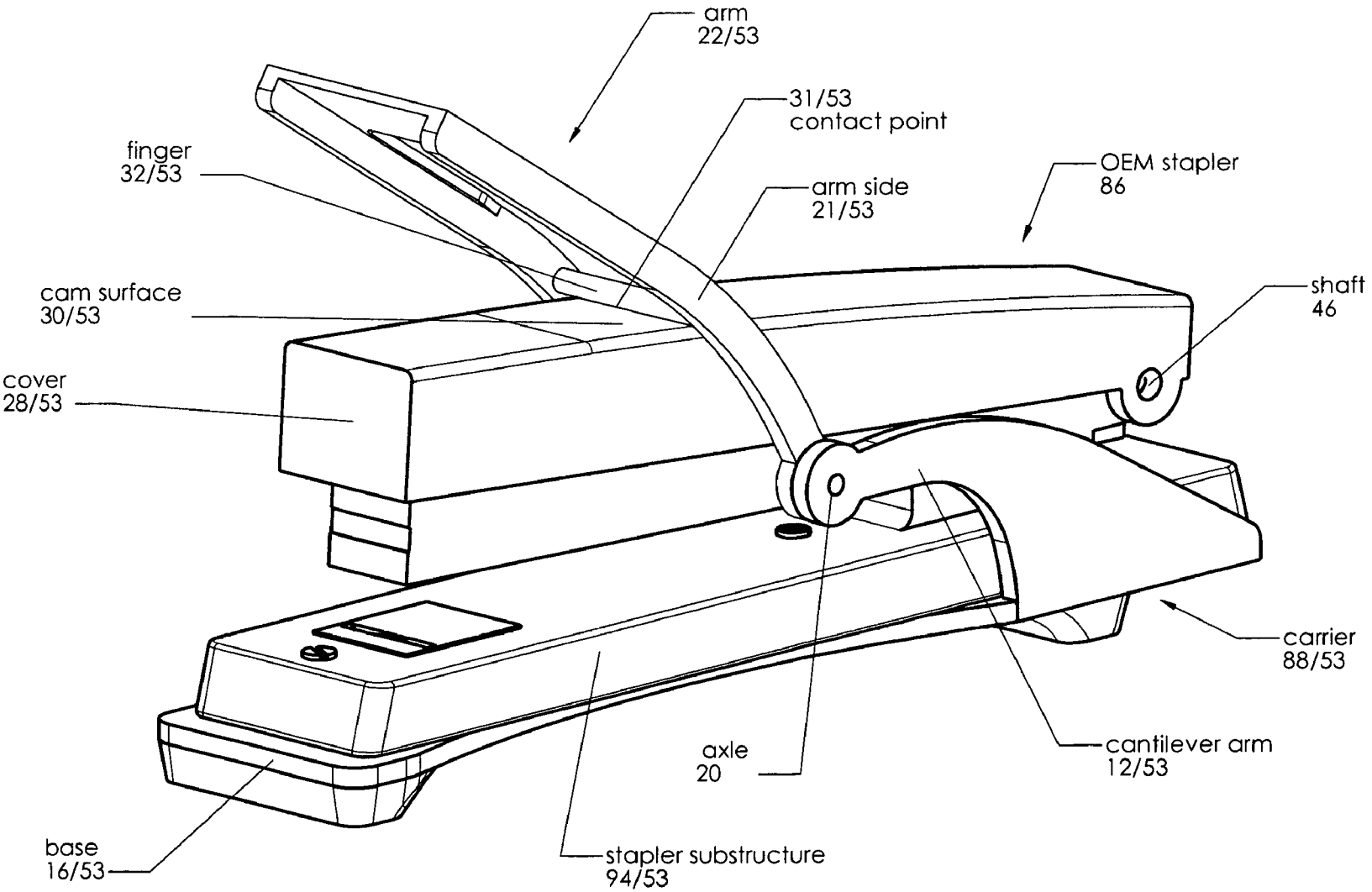
FIG. 53 is a perspective view of an OEM stapler in a carrier 88/54.

Carrier—FIG. 53

As shown in FIG. 53, a FIG. 53 stapler is a variation of the base pivot type stapler. FIG. 53 stapler is an OEM stapler 86 in a carrier 88/53, which together form a cam-A-F-I-J-M-pivot-H-J-L stapler. This design allows the use of an OEM, i.e. a pre-existing, stapler or one made especially for this purpose to be placed inside a carrier 88/53. This combination provides a functionality similar to the base pivot stapler. Note that cam surface 30/53 is the top of OEM stapler 86. A finger 32/53 is a metal rod running between each arm side 21/53 and attached by spot welding. A nylon bushing surrounds the metal rod. Two holes are drilled into a stapler substructure 94/53 of OEM stapler 86, which correspond to the two holes in a platform 16/53 of carrier 88/53. Stapler substructure 94/53 is then removably attached to platform 16/53 by two bolts. Note, however, finger 32/53 prevents cover 28/53 from opening fully. To allow cover 28/53 to open fully, OEM stapler 86 could be made to slide forward in carrier 88/53. Alternatively, staples could be loaded into FIG. 53 stapler from the front, rear or some other method that does not require opening cover 28/53.

FIG. 54

Figure 54:
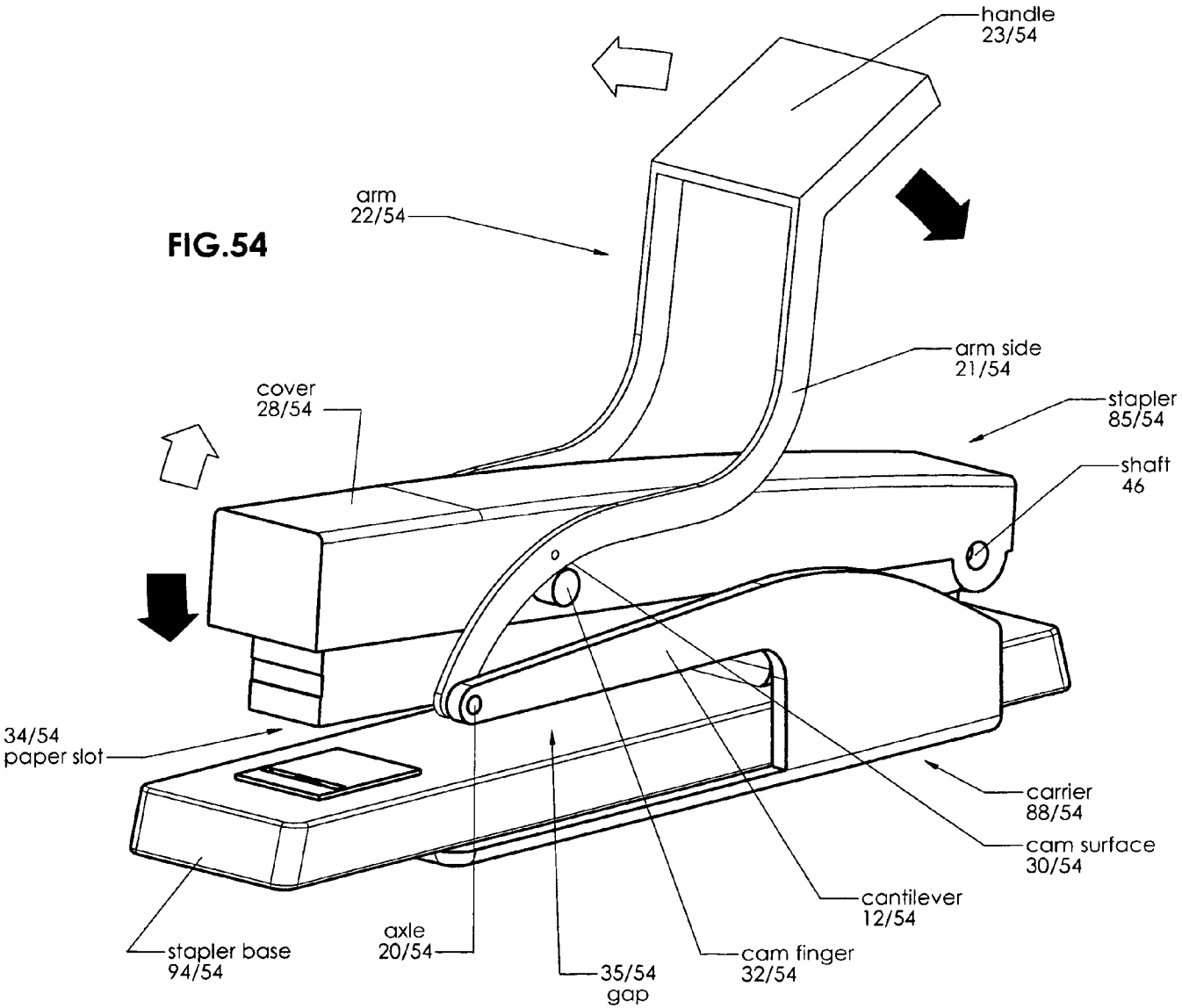
FIG. 54 is a perspective view of a stapler 85 in a carrier 88, collectively in a ready configuration.

As shown in FIG. 54, a variation of the 2nd pivot type stapler is FIG. 54 stapler, which has a handle 23/54 that is pushed backwards. In this configuration, axle 20/54 is in front of finger 32/54. In the ready configuration, handle 23/54 is at the back of the FIG. 54 stapler. The FIG. 54 stapler is a cam-A-E-I-K-L-pivot-H-J-L stapler. Note: this is the one drawing showing an alternate embodiment of the mid-zone stapler that has axle 20/# in front of cam finger 32/54. It's also the one that has the most forward axle 20/#. Accordingly, it has the potential advantage of placing the least stress on axle 20/#. Another advantage of this embodiment is that an arm 22/54 easily swings forward to allow cover 28/46 to rotate up and back. Also note that this example of the FIG. 54 stapler is shown as a stapler 85/54 in a carrier 88/54, but it would more likely be made as one unit. Additionally, note that an OEM stapler 86 can be used if it has a finger 32/# similar to finger 32/53.

Additional Embodiments of 1st Pivot Stapler

Figure 55:
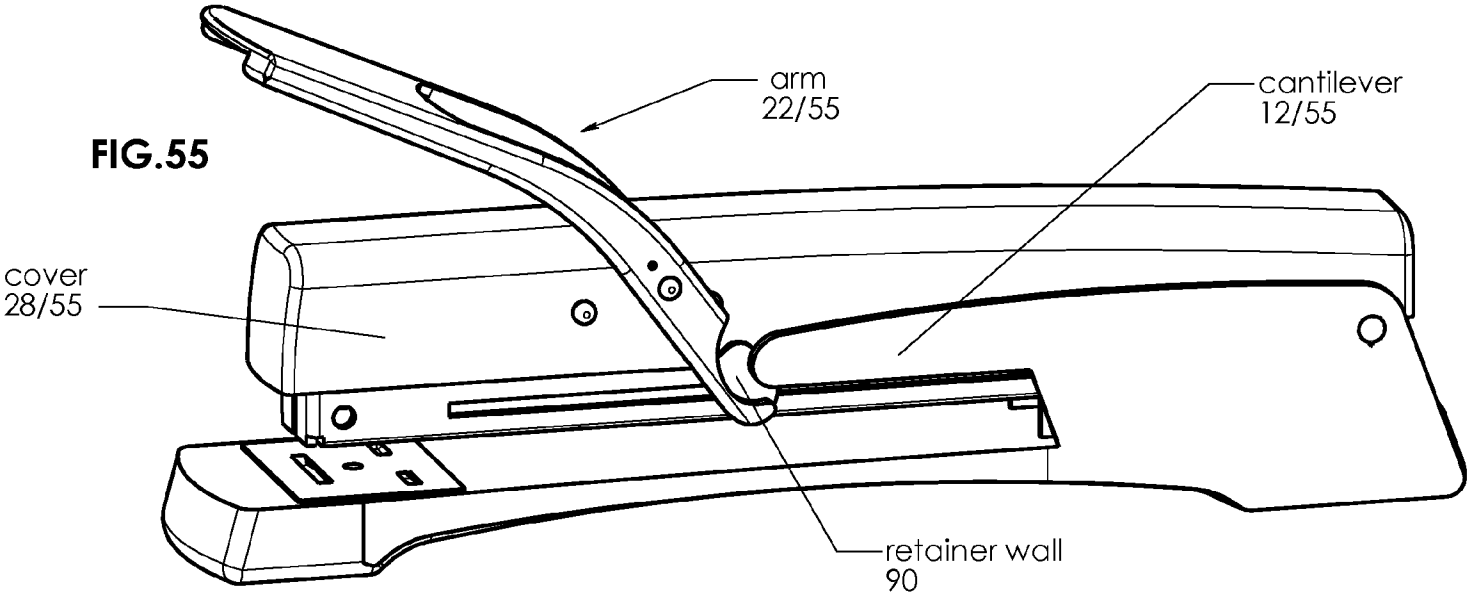
FIG. 55 is a perspective view of an alternate embodiment of a mid-zone stapler with retainer wall 90 in finger cavity 33B.
Figure 56:
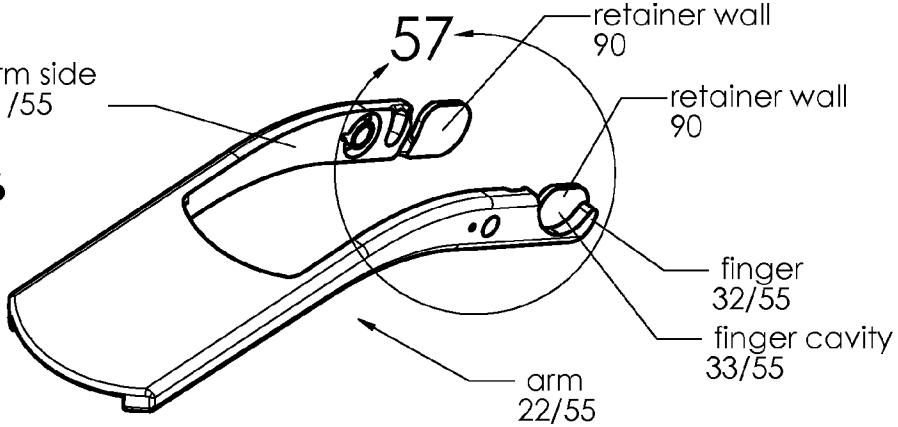
FIG. 56 is a perspective view of arm with retainer wall 90.

FIGS. 55 and 56

The following alternate embodiments of the mid-zone stapler apply best to a 1st pivot type stapler.

FIGS. 55 and 56 show a FIG. 55 stapler as an example of a pivot-H-K-L-cam-A-E-I-J-O stapler with an alternate embodiment of a finger cavity 33/55. Finger cavity 33/55 differs from 33/1 because it has the addition of a retainer wall 90. Retainer wall 90 is a flat wall of material extending across much of the interior portion of finger cavity 33/55. The transversely innermost surfaces of an arm side 21/55 and retainer wall 90 are in the same plane with each other. The two largest surfaces of retainer wall 90 are parallel with each other. The outer shaped portion of retainer wall 90 is generally a continuation of the shape of arm 22/55.

The retainer wall 90 reduces the transverse depth of finger cavity 33/55, but with sufficient room to provide clearance for the end of cantilever 12/55. Retainer wall 90 eliminates lateral or transverse misalignment between finger 32/55 and cam surface 30/55 by hindering the transverse motion of finger 32/55.

Additional Embodiments of Both 1st and 2nd Pivot Type Staplers

The following alternate embodiments of the mid-zone stapler apply equally well to 1st pivot or 2nd pivot type staplers.

Another alternate embodiment of the 1st pivot or 2nd pivot stapler is a single spring stapler, not shown. This stapler has one arm spring 60 instead of two. The asymmetry of the spring action is fairly inconsequential, with the advantage that the single spring stapler is somewhat less expensive, because it has one less part.

FIG. 58

FIG. 58 shows a FIG. 58 stapler as a variation of the cover pivot stapler with an asymmetric arm 22/#. In this case, an arm 22/58 has one arm side 21/58 instead of two bilaterally symmetric arm sides 21/1 in the cover pivot stapler. Handle 23/1 is asymmetrically supported on one side by one arm side 21/58, such that it is a cantilever. The FIG. 58 stapler also has one finger 32/58, one axle 20/58, and one cantilever 12/58. The advantage of this embodiment is that it provides an interesting and distinctive design. It also reduces somewhat the amount material and space required.

FIG. 59

FIGS. 59 and 60 show a FIG. 59 stapler as a variation of a cover pivot stapler with an alternative resting position, a FIG. 59 stapler. Resting horizontally, as seen in FIG. 60, the front portion of a platform 16/59 extends transversely on each side creating a pair of approximately symmetric and identical extensions, braces, feet, or struts called vertical feet 80. An inward curving negative space on the front edge in between them, a vertical clearance arch 82, provides clearance. Restated, the vertical foot 80 is fundamentally a widening of a front foot 36/59. The front-most surface of a handle 23/59 has a flattened plane, which is a handle foot 84. The frontmost surface of each of the vertical feet 80 and handle foot 84 are generally in the same plane as each other.

As seen in FIG. 59, when the FIG. 59 stapler is rotated 90°, these 3 feet or struts create a tripod or stand allowing the stapler to rest in a vertical position, with its front end resting on a generally horizontal surface. In other words, the tripod creates an auxiliary 90° base. This makes it easier and faster for users to grasp when picking up the FIG. 59 stapler for use in the handheld method.

Note that the weight of the FIG. 59 stapler in the vertical position creates a rotational pressure on an arm 22/59 from the ready configuration towards the disengaged configuration. To prevent this, the FIG. 59 stapler uses catch button 74 and catch groove 78 to releasably keep arm 22/59 from rotating up and back. However, this catch button 74 can be overcome by sufficient manual force, allowing arm 22/59 to rotate into the disengaged configuration when desired.

FIG. 61

FIGS. 61 and 62 show a FIG. 61 stapler as a variation of a cover pivot stapler with a hood 92 to create a FIG. 61 stapler. A hood 92 pivots on shaft 46. Hood 92 removably covers cantilever 12/1 and stapler assembly 24/1. Having an open-box, rectangular form, hood's 92 rough geometry consists of a top, two sides and a front, with a hollowed out interior. Not having a backside allows hood 92 to rotate open, allowing the stapler to be moved into the staple access configuration or tacking configuration. To operate the FIG. 61 stapler, the manual force usually applied to top of handle 23/# of the mid-zone stapler is applied to the top of hood 92. The force is then transferred directly to the top of handle 23/61, which in turn transfers the force to cover 28/61 in the same ways typical of mid-zone staplers.

The purpose of the FIG. 61 stapler is to make a stapler with a solid looking form that's more similar to standard staplers, rather than presenting users with an arm sticking out. This would make the FIG. 61 stapler more familiar to some users. Another possible advantage to this embodiment is that a point of sliding contact between handle 23/1 and hood 92 creates a cam surface. Thus, there could be a second cam surface on the inside upper surface of hood 92 as well as the previously existing one, cam surface 30/1.

FIG. 63

FIGS. 63-68 show a FIG. 63 stapler as a variation of a cover pivot stapler with an add-on hole punch 96 to create a FIG. 63 stapler. Platform 16/63 differs from platform 16/1 by having a hole 109/63 in its top surface. Hole 109/63 is placed in front of anvil 18/63, and its axis is vertically oriented. A metal cylinder, called a cylinder 100/63, rests in-line above hole 109/63 and is sized to the same diameter. When the FIG. 63 stapler is in the ready configuration, the bottom surface of cylinder 100/63 is vertically dimensioned to allow sufficient clearance for multiple sheets of material between it and the top surface of platform 16/63.

As shown in FIG. 65, cylinder 100/63 is a part of hole punch 96 and extends vertically from the center of the upper surface of a rectilinear block, a punch body 98. A smaller rectilinear block, a bridge 102, extends longitudinally from the center of the rear surface of punch body 98. A somewhat larger rectilinear form, a backer 104, extends a relatively short distance, longitudinally, from the rearward surface of bridge 102. The resulting space between the rear surface of punch body 98 and the front surface of backer 104 is a slot 106. A somewhat smaller rectilinear form, a punch block 110, extends longitudinally from one side of the rearward face of backer 104. The hole punch 96 is one piece of cast metal except for cylinder 100/63, which is a metal rod pressed into a hole in punch body 98.

As shown in FIG. 66, the lower portion of the front wall of a cover 28/63 has a notch 108. Notch 108 is a transversely centered, downward opening, rectilinear cut out. Notch 108 is sized to accommodate bridge 102. Slot 106 is sized to accommodate the thickness of the front wall of cover 28/63. The front and back surfaces of the front wall of cover 28/63 are flat and parallel. All this allows hole punch 96 to slidably attach, with the vertical motion, to the front wall of cover 28/63.

As shown in FIGS. 63 and 64, hole punch 96 can be attached with cylinder 100/63 facing either up or down. When cylinder 100/63 is facing down, the FIG. 63 stapler can punch a hole into a sheet of material. When cylinder 100/63 is facing up, the FIG. 63 stapler works only as a stapler and not as a hole punch.

Preventing the FIG. 63 stapler from both stapling and hole punching when cylinder 100/63 is in the downward position is the purpose of punch block 110 and a staple block 112. As shown in FIG. 68, the staple block 112 is a small rectilinear form that extends longitudinally from the front face of a magazine 26/63. As shown in FIG. 67, staple block 112 is positioned to interfere with the upward movement of punch block 110 when cylinder 100/63 is in the downward position. In so doing, hole punch 96 moves magazine 26/63 up as it slides into position on front of cover 28/63. Thus, magazine 26/63 remains up, preventing staples from moving forward and thereby preventing stapling.

FIG. 69

FIGS. 69 and 70 show a FIG. 69 stapler as a variation of a cover pivot stapler with a built-in hole punch to create a FIG. 69 stapler. As shown in FIG. 69, relative to the cover pivot stapler, the two main components that have changed are a cover 28/69 and a base 11/69. The exterior side surface of a cantilever 12/69 and, to some extent, support 14/69, has a transversely extending convex form called a side base 116. Its top and bottom surfaces are essentially flat and horizontal. A hole 109/69 is a hole with a vertical axis that cuts through the approximate middle of side base 116.

A side body punch 114 is nearly identical in form to side base 116 and is directly above it. Side body 114 extends transversely from the exterior sidewall of cover 28/69. A metal cylinder, cylinder 100, extends downward from the lower surface of side body 114, matching the position and diameter of hole 109/69. As shown in FIG. 69, when the FIG. 69 stapler is in the ready configuration, the bottom surface of cylinder 100/69 is vertically dimensioned to allow sufficient clearance for multiple sheets of material between it and side base 116. As shown in FIG. 70, when the FIG. 69 stapler is in the stapled configuration, the bottom surface of side body 114 is vertically dimensioned to allow sufficient clearance for multiple sheets of material between it and side base 116.

The side body 114 is part of the same cast metal part as cover 28/69. Side base 116 is a part of the same cast metal part as base 11/69. Cylinder 100/69 is a metal rod press fit into a receiving hole in the bottom side of side body 114.

As shown in FIG. 70, the FIG. 69 stapler operates in the same fashion as the cover pivot stapler, but additionally and simultaneously it pushes cylinder 100/69 through hole 109/69 to allow it to punch a hole into a sheet, or sheets of material.

FIG. 71

FIGS. 71 and 72 show a FIG. 71 stapler, which is a variation of the FIG. 35 stapler. However, it has a cam-E- notation rather than a cam-F- notation. Or in full notation, it has a pivot-H-K-L-cam-A-E-HI-J-L notation rather than a pivot-H-K-L-cam-A-F-I-J-L notation. FIG. 71 stapler has a partially enclosed cam slot 120/71. The FIG. 71 stapler has a finger retainer 118, which is an extension of a cantilever 12/71. Finger retainer 118 is a downward and then rearward extension of the distal portion of cantilever 12/71. Cam slot 120/71 is the resulting cavity defined on three of four sides by cantilever 12/71 above and by finger retainer 118 in front and below. The fourth side is a rearward opening of cam slot 120/71 that allows the entrance and exit of finger 32/71.

The FIG. 71 stapler's cam slot 120/71 allows handle 23/71 to selectively be prevented from, or allowed to, rotate up and back. This allows finger 32/71 to selectively pivot into and out of engagement with cam surface 30/71. As shown in FIG. 71, cam slot 120/71 limits the downward and/or forward movement of finger 32/71 while cam surface 30/71 limits the upward movement of finger 32/71.

Accordingly, handle 23/71 can be rotated upward and rearward only after it has been pushed downward and forward into the stapled configuration. In this position, as show in FIG. 72, finger 32/71 will have exited cam slot 120/71 and still be resting against cam surface 30/71. By keeping cover 28/71 pushed down in the stapled configuration, finger 32/71 stays clear of finger retainer 118. Consequently, finger 32/71 can release down from contact point 31/71, and rotate below and then beyond finger retainer 118. This allows handle 23/71 to rotate up and back, which in turn allows cover 28/71 to rotate up and back, allowing the FIG. 71 stapler to open. The process is reversed to place finger 32/71 into finger retainer 118. Accordingly, this cam is a position-dependent releasable cam. It is either fixed or releasable depending on its position, hence the -HI- fixed/free coupling table notation found in table 1.

The cam slot 120/71 confers several advantages to the FIG. 71 stapler. The first is that it could eliminate the need for catch button 74 by replacing its function to limit the upward and rearward rotation of handle 23/71. Additionally, cam slot 120/71 provides a more secure mechanism of limiting the upward and rearward rotation of handle 23/71. This is particularly useful for staplers such as the FIG. 59 stapler.

FIG. 73

FIGS. 73, 74 and 75 show an example of a cam-A-E-I-K-L-pivot-H-J-N stapler with a cantilevered arm 22/73 to create a FIG. 73 stapler. This stapler does not have a cantilever 12/# in its base 11/73. Instead, the cantilever is in an arm 22/73. This is an alternative method of preserving the longitudinal depth and integrity of paper slot 34/#. The detailed description is as follows.

The preferred and alternate embodiments so far have shown axle 20/# above paper slot 34/#. Axle 20/# can be placed lower, but it interferes with paper slot 34/#. As shown in FIG. 73, the FIG. 73 stapler has axle 20/73 in a platform 16/73 below paper slot 34/73. Arm 22/73 includes a pair of arm sides 21/73 symmetrically placed on each side. As shown in FIG. 75, each arm side 21/73 is generally flat, transversely thin, and comprised of three segments. A lower segment 127 connects to axle 20/73 and extends rearwards. From there, a vertical segment 128 extends upwards and from there, an upper segment 129 extends forwards such that a portion of the upper segment 129 is directly above axle 20/73. These three segments define three sides of a handle space 130. Handle space 130 is open towards the front.

At a minimum, as shown in FIGS. 73 and 74, the base of the stapler 85/73 has to be thick enough to accommodate both the axle 20/73 and the lower segment 127 of arm side 21/73. Additionally, the base has to be thick enough to accommodate the changing angle of the lower segment 127 as arm 22/73 moves from the ready to the stapled position.

With two exceptions, the FIG. 73 stapler has functionality and performance characteristics similar to the base pivot stapler. The first exception is that the minimum distance between axle 20/73 and finger 32/73 is not as short. Inherently, the vertical distance must span paper slot 34/73 and magazine 26/1. Secondly, the FIG. 73 stapler must be picked up in order to rotate arm 22/73 all the way up and back so that the cover 28/73 can open.

Possible advantages include using the movement of the lower segment 127 relative to the lower portions of the FIG. 71 stapler for some other function, such as shearing, staple removing, hole punching, etc. The thicker base also can be used for staple storage or other storage of other small items. FIG. 76

FIGS. 76, 77A and 77B show a FIG. 76 stapler as a variation of the 1st pivot stapler. The FIG. 76 stapler is similar to the FIG. 14 stapler in having a bushing 57/76 on a hub 58/76 to create a finger 32/76. However, hub 58/76 is supported on both sides and an arm side 21/76 is in the same plane as a cantilever 12/76 shown in FIG. 76.

Shown in FIG. 77B, the FIG. 76 stapler has a finger cavity 33/76 somewhat similar to finger cavity 33/55, shown in FIG. 55. Similarly, cavity 33/76 accommodates a cantilever 12/76, but differs because its boundary is not limited by finger 32/55. Finger wall 91A, of FIG. 77B, is very similar to retainer wall 90, of FIG. 55. However, the FIG. 76 stapler also has a second finger wall 91/#, a finger wall 91B creating a boundary to cavity 33/76. Finger wall 91B is similar to finger wall 91A, except its placement is transversely on the outside portion of arm 22/55, instead of the inside. Finger 32/76 is placed in finger cavity 33/76, with its metal pin pressure fit, on each side, into a hole in each of finger walls 91A and 91B. Being held on each side gives the finger 32/76 an -M- coupling table notation.

There are three advantages to this arrangement. Finger 32/76's metal pin is supported on both sides, as opposed to one side, as shown in FIG. 77B. This allows the two finger walls 91A and 91B to be thinner than the portion of arm side 21/35 supporting finger 32/76 in FIG. 77A. This in turn allows for a narrower overall stapler profile. A second advantage is that finger 32/76's metal pin can have a smaller diameter. Thirdly, as shown in FIG. 76, the two finger walls 91A and 91B surround cantilever 12/76. This limits transverse movement, thereby ensuring said finger 32/76 tracks along cam surface 30/76.

Additional Embodiment

Insert

Shown in FIG. 78, a FIG. 78 stapler is an alternate embodiment of the 2nd pivot stapler. FIG. 78 stapler is part of a class of staplers called tool staplers. Tool staplers take advantage of a heretofore unused portion of arm 22/#'s rotation. When an arm 22/78 is rotated rearward instead of forward, it can engage and power a pressing tool called an insert 132/79. Insert 132/79's utility can include such functions as a hole punch, an embossing tool, or a stamping tool.

Insert 132/79 is so named because it is removably insertable into the FIG. 78 stapler, as shown in FIG. 78. Note that platform 16/78 is modified to accommodate insert 132/79, longitudinally rearward of axle 20/78. It has a receptacle 150/78 that is a cavity, shaped so that insert 132/79 can drop into it. The lower portion of receptacle 150/78 also extends in a circular fashion beyond the sidewalls of platform 16/78.

Note that vertically accommodating insert 132/79 requires an increase in the vertical dimensions of paper slot 34/78 and gap 35/78. This creates a problem of increasing the dimension between the anvil 18/78 and magazine 26/1. To solve this, the top surface of anvil 18/78 is raised up towards magazine 26/1. The forward portion of what was formerly paper slot 34/#, the area between the top surface of anvil 18/78 and the bottom of surface magazine 26/1, is called interstice 152. It is necessary to name this because this area is no longer the same dimension as paper slot 34/78.

Another new feature seen in FIG. 78 is deflector 140. The purpose of deflector 140 is to guide the sheets or the sheets of material down and into the opening in insert 132/79. This is necessary because of the raised top surface of anvil 18/78.

Insert: Details

As seen in FIG. 79, insert 132/79 has two round subcomponents: a top 142/78 and a bottom 144/78. These two subcomponents are separated by a separation 147, with top 142/78 positioned over bottom 144/78. In this embodiment, both top 142/78 and bottom 144/78 are both short, wide cylinders, made of cast aluminum alloy. A connector 146 connects these two subcomponents to each other. Connector 146 is a bent piece of spring steel with one end cast into top 142/78 and the other end cast into bottom 144/78. Connector 146 holds top 142/78 and bottom 144/78 apart, creating a sufficiently large gap to allow sheets of material to enter.

The top surface of top 142/78 has two bilateral protrusions or ridges, called a pair of ridges 136/78, extending vertically from it. As seen in FIG. 78, these are laterally positioned to provide clearance for the width of magazine 26/1 and cover 28/1. This lateral or transverse centered clearance space between ridges 136/78 is called a clearance void 137. The lateral positioning of ridges 136/78 also matches the width of arm 22/78. This allows arm 22/78 to make contact with cam inserts 136/78. An approximately right angle extension of a portion of each arm side 21/78 called insert an insert finger 134/78 is the portion of arm 22/78 that makes contact with the ridges 136/78. Measured along arm side 21/78, insert finger 134/78 is about the same distance from axle 20/78 as cam surface 30/78. Or to restate, insert finger 134/78 is located on the opposite side of arm side 21/78 from cam surface 30/78. The top surface of ridges 136/78 where contact is actually made are called ridge surface 138/78

Insert: Positioner

To control orientation and help connect insert 132/78 to platform 16/78, bottom 144/78 has two positioners 145/78. In this embodiment, positioner 148/78 is a rectilinear shape extending longitudinally from the curved side of bottom 144/78. There are two positioners 145/78, one extending from the front portion of bottom 144/78 and one extending from the rear portion. Receptacle 150/78's sidewalls are shaped to match the sidewall perimeter of bottom 144/78 such that bottom 144/78 drops into receptacle 150/78 like a piece of a jigsaw puzzle. Reciprocal bumps and detents in the sidewalls of bottom 144/78 and receptacle 150/78 allow the two parts to snap together providing releasable connection between the two.

Accordingly, positioner 148/#'s function is to limit the longitudinal, transverse, and rotational movement of positioner 148/# relative to base 11/#. Note that some aspects of this function can be performed by bottom 144/#. For example, bottom 144/78 is round and fits into a round receptacle 150/78. As such, bottom 144/78 limits in the longitudinal and transverse movement of bottom 144/78. Positioner 148/78 is only needed to limit the rotational movement.

If bottom 144/# is a square shape then longitudinal and rotational movement are prevented. If the square shape extends transversely beyond receptacle 150/# then positioner 148/# is needed to limit the transverse movement. If the square shape of bottom 144/#does not extend beyond receptacle 150/#, then no positioner 148/# is needed. In this case either bottom 144/# and positioner 148/# can been considered the same part, or positioner 148/# can be considered nonexistent.

Note, connector 146 can be used as a positioner 148/#. Also because the side walls of both bottom 144/# and positioner 148/# are similar, either can be used to hold the snap bumps or detents.

Accordingly, positioner(s) 148/# can vary considerably in number, size, and shape. So long as the combination of bottom 144/# and positioner 148/# provide the appropriate geometry to the limit longitudinal, transverse and rotational movement, the function of positioner 148/# is satisfied. Correspondingly, there must be a reciprocal shape in receptacle 150/# or platform 16/#. Note that positioner 148/# can also be a negative space, hole or dent in bottom 144/#. The positioning function requires a reciprocal positive shape in receptacle 150/# or platform 16/#.

In addition to mechanical retention methods, adhesive, Velcro, or magnetic retention methods can be used. Also note that insert 132/# doesn't have to be removable. It could be permanently attached to the mid-zone stapler, or be a portion of existing parts of the mid-zone stapler.

Operation of Insert

FIG. 80 shows the FIG. 78 stapler in an initiating configuration. This shows that the operational use of insert 132/79 in the FIG. 78 stapler is initiated by rotating arm 22/78 rearward. This brings insert finger 134/78 into contact with cam surface 138/78. As arm 22/78 rotates further rearward, top 142/78 is pressed down into contact with bottom 144/78. It is this pressing action that causes insert 132/79 to function as a pressing tool. When top 142/78 contacts bottom 144/78, as shown in FIG. 81, the FIG. 78 stapler is in a pressed configuration. The manual pressure providing the downward and rearward rotation of arm 22/78 is also called second end input. The resulting downward movement of insert finger 134/78 and top 142/78 is also referred to as insert output.

Note that the use of ridge 136 is optional; the design can utilize two, one or none. Insert finger 134/78 could contact the top surface of top 142/78 instead. This would make inset cam surface 138 the same surface has the top surface of top 142/78. Conversely, taller ridges 136 could be used such that their laterally outer surfaces could match the laterally inner surfaces of cantilever 12/78. These parallel and adjacent surfaces could limit the transverse and torsional movement of top 142/78 during the pressing operation. Note: if ridge 136 is taller, then insert finger 134/78 can be shorter, and vice versa.

FIG. 82

As shown in FIG. 81, arm 22/78 rotates into a position where a handle 23/78 is behind a cover 28/78, although handle 23/78 is shown more clearly in FIG. 80. As shown in FIG. 81, axle 20/78 is very close to the longitudinal center of the FIG. 78 stapler. To move axle 20/78 further forward would require lengthening arm 22/78 so that handle 23/78 can still pass behind cover 28/78. As shown in FIG. 82, if arm 28/78 remains the same length, one solution to maintaining a top loading stapler is to create a lid 154. Lid 154 is a separate piece from a cover 28/82, but covers most of the top area formerly covered by cover 28/78. Each side of the rearward portion of lid 154 has rearward extensions to allow lid 154 to be pivotally attached by a pole 156 to cover 28/82. A pressure member 44/83 is also attached to pole 156, allowing it to rotate up with lid 154. This allows access to the staples through the top of a stapler assembly 24/82. One reason to move axle 20/78 forward is to create more room for insert 132/79. As shown in FIG. 83, another way to create more room for insert 132/79 is to increase gap 35/83.

FIG. 84

As shown in FIG. 84, there's another way to keep arm 22/78's length constant while moving axle 20/# forward. This involves cutting away an upper and somewhat rearward portion of a cover 28/84, creating a cut 158. As shown in FIG. 85, this provides clearance for a portion of handle 23/78, thereby allowing cover 28/34 to rotate into a vertical position for staple access. Notice that unlike the FIGS. 80 and 83 staplers, the FIG. 84 stapler's arm 22/78 is in the initiating configuration when cover 28/84 is opened. For FIGS. 80 and 83 staplers, arm 22/78 is in the pressed configuration. Also notice an insert 132/84 operates as a hole punch. This is achieved by having a bottom hole 149/84 in a bottom 144/84, shown in FIG. 84, and a peg 168 extending downward from the bottom surface of a top 142/84, shown in FIG. 85.

Retainer 162

To releasably retain arm 22/78 in the initiating configuration shown in FIG. 85, an alternate method of arm 22/# position control has been created. As shown in FIG. 86, the end of a retainer 162 springs into an scallop 160, causing an axle 20/84 to resist rotation. Axle 20/84 can be rotated when enough manual pressure is applied to arm 21/78 to bend retainer 162, allowing scallop 160 to disengage with the end of retainer 162. There are two scallop 160s. Shown in FIG. 84, they allow the same retainer 162 to hold arm 22/78 in the ready configuration as well as the initiating configuration.

Note that retainer 162 also serves a second purpose. As shown in FIGS. 85 and 86, it releasably attaches axle 20/84 to cantilever 12/84. Axle 20/84 fits into an indent 125/84. Indent 125/84 is a slot in the distal end of cantilever 12/84. This differs from many of the other mid-zone stapler configurations where axle 20/# fits into a hole in the distal end of cantilever 12/84, creating a more permanent connection. Accordingly, retainer 162 keeps axle 20/84 from falling out of indent 125/84. Yet because retainer 162 is a spring, it gives way when sufficient manual pressure pushes down on axle 20/84, releasing axle 20/84 and thereby arm 22/84.

Retainer 162 is a piece of spring steel bent approximately 270° on one end. The other end is attached to a cantilever 12/84 by a retainer block 164. Retainer block 164 is a transverse extension of cantilever 12/84 and made of the same material. This method of controlling the position of arm 22/84 has two advantages. The first is that it's very simple. The second is that one moving part, retainer 162, can be used to hold arm 22/78 in multiple positions by having multiple scallops 160.

FIG. 87

As shown in FIG. 87, the FIG. 87 stapler can have a second pressing tool function in its front portion, forward of axle 20/87. To enable the tool function, a die 168 is releasably attached to the front portion of the FIG. 87 stapler. More specifically, there are two points of attachment. First, the lower portion of die 168, a lower die 170, is releasably attached to the front portion of platform 16/87. An anvil 18/87 can also releasably attached to the same front portion of platform 16/87, allowing the two parts to be interchangeable. Using a FIG. 87 stapler for a stapling function requires anvil 18/87 to be in place.

The upper portion of die 168, an upper die 172, is releasably attached to the front portion of a cover 28/87. In this embodiment, this is accomplished by a pair of planer structures extend upwardly from upper die 172 called die extensions 174. Die extension 174 attaches upper die 172 to cover 28/87. When upper die 172 is attached, it holds magazine 26/87 up against cover 28/87, in a position similar to its stapled configuration. This prevents the stapler function of the FIG. 87 stapler from operating during die 168's use.

Notice that while die 168 and insert 132/# are both powered by arm 22/#, only insert 132/#is powered by direct contact with arm 22/#. Die 168, on the other hand, is powered indirectly. The operational force from arm 22/#is transmitted to cover 28/# and then from cover 28/# to die 168.

Note: in an alternate embodiment of the FIG. 87 stapler, another insert 132/# could be used instead of die 168, depending on their particular embodiments. Conversely, in an alternate embodiment of FIG. 87 stapler, another die 168 could be used in place of insert 132/#. In each case there would be two identical inserts, reducing manufacturing costs. To clarify, the pressing surfaces of the two identical inserts would be different while everything else is the same. For example, one insert is an embossing tool while the other another is an ink-stamping tool, or an embossing tool with a different embossed pattern. Also note that die 168 can be a permanent fixture transforming the FIG. 87 stapler into a pressing tool. That is to say, the pressing tool would not operate as a stapler, but would have two pressing functions, one behind axle 20/87 and one in front of it.

Insert 132/79 is shown as a round shape typical of embossing tools. However, it could be square or any number of other shapes. For example, as an ink stamping tool, rectangular would a very workable in shape. If insert 132/# were a double hole punch, it would need to extend further transversely. As such, either an oval or rectilinear form would be more appropriate than circular.

Handle Exclusivity

Note that the first and second input in the tool staplers are mutually exclusive. For example, FIG. 78 stapler's arm 22/78 cannot make contact with finger 32/78 and ridge 136 at the same time. When handle 23/78 is proximate, the first end it contacts finger 32/78. When handle 23/78 is proximate, the second end it contacts ridge 136. Handle 23/78 is not in contact with either when it's in transition between them. The advantage of this is that one cannot accidentally engage the stapling operation when using the cam and vice versa.

There is an exception to the mutual exclusivity of the first and second inputs. A tool stapler can be made with two arms 22/#. One arm 22/# providing the first input while the other provides the second input simultaneously. No example of this is shown.

Additional Embodiment

Rack and Pinion

Another embodiment of the mid-zone stapler is the rack and pinion stapler. As shown in FIGS. 89 and 89A, the rack and pinion stapler, or FIG. 89 stapler, uses a pinion gear and rack to achieve functionality similar to the cam or the link staplers. Put another way, it provides a coupling mechanism that allows the downward movement of an arm 22/89 to move a cover 28/89 downwards. FIG. 89 shows a rack 180/89 attached to the sidewall of cover 28/89. Rack 180/89 is a cast metal part formed as part of cover 28/89. A pinion 182/89 is a pinion gear, which is made with an axle 20/89 as a single cast metal part. Axle 20/89 is then press fit into arm 22/89, after it has passed through the hole in a cantilever 12/89. The portion of axle 20/89 that is fit into pinion 182/89 has a flat chamfer in it. The hole in pinion 182/89 also has a corresponding flat. These prevent pinion 182/89 from freely rotating relative to arm 22/89. Note, rack 180/89 is curved such that its center matches, or is close to, shaft 46. This prevents the distance between rack 180/89 and pinion 182/89 from changing during the stapling operation.

Operation

As mentioned, the stapling operation of the FIG. 89 rack and pinion stapler is similar to any mid-zone stapler. To be more specific, it fits into the of a $2^{nd}$ pivot stapler with a cam type first coupling. The rack and pinion, in many ways, act as a series of cams with the connecting surfaces of the gear teeth sliding and rotating against each other. The main difference is there are multiple teeth instead of a single cam. The multiple teeth change the way the FIG. 89 stapler is moved into the disengaged configuration. As shown in FIG. 90, arm 22/89 cannot be rotated up into the disengaged configuration without cover 28/89 also moving up at the same time. From that initial disengagement configuration, the two can operate independently. Accordingly, arm 22/89 can then be rotated backwards into the disengaged configuration, and cover 28/89 can then rotate rearwards into either a staple access or tacking configuration.

FIG. 91

As shown in FIGS. 91 and 91A, rack 180/91 can also be a series of posts, each one called a rack post 184/91 and extending from cover 28/91. Each rack post 184/91 is placed in a similar orientation and spacing, effectively replacing each tooth of rack 180/89. As a result, the teeth in pinion 182/91 can catch at least one rack post 184/91 and thereby force cover 28/91 downward during the stapling operation. Each rack post 184/91 is a cylindrical metal rod pressure fit into a hole in the sidewall of cover 28/91.

$1^{st}$ Pivot Stapler

As shown in FIGS. 91 and 91A, the rack 180/# and pinion 182/# positions can be reversed with each other to create a $1^{st}$ pivot rack and pinion stapler. In this FIG. 92 stapler, a rack 180/92 is a part of a base 11/92. To be more specific, rack 180/92 is attached to the distal end of a cantilever 12/92. Rack 180/92 is made of cast metal and is formed as part of cantilever 12/92. A pinion 182/92 is similar to pinions 182/89 and 182/91. The difference is that pinion 182/92 is made as a single cast metal part with a square hole in the center and is shown with fewer teeth. A protrusion, a finger post 186 extends from the distal and of arm 22/92, which is similar in size and position to finger 32/71 of FIG. 71, but a square instead of round. Pinion 182/92 is then press fit onto finger post 186. Accordingly, pinion 182/92 does not rotate relative to arm 22/92.

Coupling Table

The rack and pinion mechanism is not shown in the coupling table of table 1. If it were, it would be categorized under the cam section, not the pivot or link sections. As mentioned, this is because the gear teeth on both the rack and pinion in many ways act as serial cams. Like the "-E- Simple" cam, the connecting surfaces of the gear teeth also slide and rotate against each other. In a similar fashion to the cam, the ends of one set of teeth could have rollers in them, making it more of a "-F-Roll" style rack and pinion. Clearly, rack 180/91's series of posts could have rotating sleeves or rollers on them as well, providing an "-F-Roll" style rack.

Accordingly, if the rack and pinion stapler were in the coupling table, it would be a fourth item, along with "-E-Simple", "-F-Roll", and "-G-Slide" in category 3. In category 4, the "-H-Fixed" and "-I-Free" choices would still be available.

Category 5 and 6

In category 5, there would be no choice for the $2^{nd}$ pivot style stapler, because axle 20/# must be attached to arm 22/#, eliminating the "-K-Body" choice. However, both choices, "-J-Arm" and "-K-Body", would be available in category five for the $1^{st}$ pivot stapler as exemplified by the FIG. 92 stapler. In category 6 two new possibilities would be available: a "rack" type rack as exemplified by racks 180/89 and 180/92, or a "post" type rack as exemplified by rack 180/91.

Advantages, Scope, Ramifications, and Conclusion of Invention

Additional Advantage Staple Jamming

An additional advantage of the mid-zone stapler is that staples don't jam as easily as a standard stapler. The reason is that stapler assembly 24/# is isolated from transverse movement during its downward rotation. When a standard stapler jams, it's because the front of a standard stapler doesn't just move straight down, it moves slightly diagonally. This causes the staple to collapse and then jam. This is a response to the common slightly diagonal vector of the manual pressure. The compound lever system in the mid-zone stapler does not transmit much, if any, horizontal force when transmitting vertical force to the stapler assembly 24/#.

Scope: FIG. 88

For every embodiment shown, there are many possible variations with the same function but different appearance. As shown in FIG. 88, the FIG. 88 stapler has a cantilever 12/88 similar in function to the base pivot stapler's cantilever 12/46. However, its appearance is quite different. Notice that arm 22/88 and cantilever 12/88, together, create a single arcing form. That is to say, the arcing form of cantilever 12/88 is continued by arm 22/88 when the FIG. 88 stapler is in the resting position. While the reason for this is mostly aesthetic, notice the advantageous depth of paper slot 34/88.

Scope: Reverse Components

For any mid-zone stapler subcomponent-A acting on any subcomponent-B, the acting and receiving subcomponents can generally be reversed: I.e., subcomponent-B acting on subcomponent-A. For example, any stapler subcomponent pivoting on an axle can rotate relative to the axle, or be attached to the axle and therefore rotate with the axle. When either or both stapler subcomponents are capable of acting on each other, one is chosen to simplify the description. This should not be taken to limit the mid-zone stapler's subcomponent design, configuration, or action.

Scope: Axis Orientations

The terms describing axis orientations should not be taken as absolutes, but rather as being relative to the mid-zone stapler. Accordingly, when the mid-zone stapler's front foot 36/# and back foot 38 are placed on a horizontal surface such as a tabletop, the longitudinal, or z-axis, and the transverse, or x-axis, are parallel to the tabletop. The y-axis is orthogonal to the tabletop. If the mid-zone stapler is tipped over 90° onto its side, the longitudinal, or is z-axis, and the vertical, or y-axis, are parallel to the tabletop while the transverse, or x-axis, is orthogonal to the tabletop.

Scope: Coupling Table

Note: the coupling table of table 1 shows many possible permutations of mid-zone stapler designs. Because there are so many, only a handful have been shown. For example, a link in combination with a cam has not been shown, but is definitely an option.

Scope: Staples

Note: the mid-zone stapler is not designed for a specific size staple. For example, different mid-zone staplers could accommodate different size staples. Additionally, one stapler could accommodate different size staples. Staples wouldn't have to be top loaded; they could be loaded from the rear or in some other fashion. Note: if the stapler is rear loading, cam slot 120/71 could fully enclose finger 32/71.

Scope: Measurement

Note: the longitudinal position of a cam is measured at the point of rotatable contact. For a simple or roll cam this means the point of contact between finger 32/# and cam surface 30/#, which is contact point 31/#. For slide 27/# this is the center of the cam finger 32/#or the closest equivalent.

Scope: Mid-Zone and Mid-Base Ranges.

As previously stated, the mid-zone or mid-base covers from 12.5% to 99% of assembly 24/1's length from the rear end of stapler assembly 24/1 towards the front. In this the maximum range of the mid-zone or mid-base. Many other more limited ranges are possible. A majority of the mid-zone staplers have the second coupling very close to the center stapler assembly 24/#. Accordingly, a mid-base range of 40% to 60% of assembly 24/1's length from the rear end of stapler assembly 24/1 towards the front is sufficient.

The $2^{nd}$ pivot stapler, as stated, needs to be close to the center so that its handle 23/# can't have it past the rear end stapler assembly 24/#. As such, and mid-base range of 45% to 55% is sufficient. However, having a larger range of mid-zone or mid-base ranges allows for more design options. A mid-base range of 34% to 65% would allow a large range of options and still keep the mid-zone stapler's compound lever system within a good operating range. And mid-base range of 26% to 76% provides a still larger range of options, allowing the second coupling's longitudinal position to range within the center one half of stapler assembly 24/#'s length. A mid-base range of 26% to 86% provides a still larger range of design options.

Scope: Optional

Optional items in the mid-zone stapler include a changing cam ratio, an overlapping handle 23/1, bumper 61, spring 60, catch button 74, and auxiliary catch button 75/1. That is, the mid-zone stapler can function without them.

Scope: Tools Other than a Stapler

The functionality of insert 132/# and die 168 can be applied to any tool that functions using a pressing action. In particular, any tool that would benefit from the mechanical advantage, compact size, or reasonable manufacturing costs of the mid-zone stapler's compound lever mechanism. Examples include bending, cutting, forming, shearing, stamping, marking, labeling, printing, punching, coining, crimping, pumping, hole punching, multiple hole punching, nailing, and stapling tools. Additionally, there are tools that would have a non-pressing tool portion, often motorized, combined with a pressing portion. The pressing tool portion, using the compound leverage system of the mid-zone stapler, moves the non-pressing tool portion towards or away from its work surface. For example: the compound leverage mechanism moving a drill bit or circular saw blade down into a piece of wood while the rotary motion is provided by an electric motor Other examples include boring, broaching, drilling, facing, grinding, lathe, milling, planing, press drill, sawing, shaper, tapping, and threading machines.

To reiterate, there are two categories of pressing tools. The first one has a single source of motion coming exclusively from the compound lever mechanism. The second category has a second, or multiple, sources of motion in addition to the compound lever mechanism. Because the compound lever mechanism operates in the y-axis, pressing tools in the first category can be called single y-axis tools. Accordingly, the input that pushes downward on handle 23/a# can be called a single y-axis input and its output can be called a single y-axis output. The tools in the second category are referred to as multiple axis tools.

Extra Features

The mid-zone stapler and its variations could be combined with other features such as a staple remover, staple storage, or other office and desk related items. No examples are shown.

For portability, a latch could hold the handle down in the stapled position. No examples are shown.

Anvil 18/# could be modified or removed to allow the staple to pass through and not be crimped. Additionally, by modifying the platform 16/# or using an extra attachment, platform 16/# could be attached to a large surfaced element that is at least as thick as the depth a staple can penetrate. The mid-zone stapler's compound leverage mechanism could then staple sheets of material to the element, such that the ends of the staple are buried into the element uncrimped. No examples are shown.

Ramifications

A disclosure of this size will inevitably have some typos. These should not be taken to limit the intended meaning of the disclosure. Because voice recognition software was used to create most of this document, the reader should consider words and phrases that sound similar to the text when trying to decipher a typo. Also, the order of disclosure, the amount of detail, or the number of drawings given to a particular disclosure should not be taken to limit any other disclosure. For example, more detailed designs should not be taken as a limitation to the less detailed works. The details of any disclosed design should be taken as a concept that can be applied to any other design. In many cases, applying a concept from the original, or first, design to the other, or second, design will require some accommodating modifications. However, many of these modifications would fall within the category of obvious to a person practiced in the arts, and accordingly all such possibilities should be considered disclosed.

CONCLUSION

The significance of the mid-zone stapler is that it provides a substantial improvement in utility. That is to say, it achieves a considerable increase in leverage without a considerable increased in cost and without losing any features of the standard stapler. This isn't just a design that is possible to construct, it's a real world solution that's viable from all perspectives: mechanical, ergonomic, manufacturing, and commercial. The option of adding insert 132/#'s functionality further increases utility and adds commercial aftermarket possibilities.

The invention claimed is:

1. A stapler comprising:

a base;

a stapler assembly further comprising a ram, a first end, and a second end;

wherein said base pivotally securing to said stapler assembly proximate said second end;

an arm further comprising a distal end;

said distal end disposed such that said first end being between said base and said distal end when said stapler assembly is in a ready configuration;

a first coupling;

a second coupling;

said first coupling, providing connection between said arm and said stapler assembly;

said second coupling providing a fulcrum between said arm and said base;

wherein said arm and said stapler assembly are levers;

a first end input;

a stapling assembly output;

wherein said first end input, being transferred by said first coupling from said arm to said stapler assembly, and said stapler assembly transfering said first end input to said ram, resulting in said stapling assembly output; and wherein, when said stapler assembly is in said ready configuration, the placement of said second coupling is more than 26 percent of said stapler assembly length, from said second end, and less than 76 percent of said stapler assembly length, from said second end.

2. The stapler of claim 1, wherein said first coupling comprising a fixed pivot.

3. The stapler of claim 2, wherein said stapler comprising a disengaged configuration; and said second coupling being releasable by said arm's disengagement from said base, thereby transforming said stapler from said ready configuration to said disengaged configuration.

4. The stapler of claim 1, wherein, when said stapler assembly is in a ready configuration, the placement of said first coupling is more than 26 percent of said stapler assembly length, from said second end, and less than 76 percent of said stapler assembly length, from said second end.

5. The stapler of claim 1, comprising a staple access configuration and a tacking configuration;

wherein said stapler assembly comprising a cover and a magazine; and wherein said stapler opens from said disengaged configuration to one of said staple access configuration and said tacking configuration by pivotting, respectively, one of said cover relative to said magazine and said stapler assembly relative to said base.

6. The stapler of claim 1, wherein one of said first coupling and said second coupling comprising a roll cam.

7. The stapler of claim 1, wherein said stapler comprising a disengaged configuration; and one of said couplings being releasable by said arm's disengagement from one of said base and said stapler assembly, thereby transforming said stapler from said ready configuration to said disengaged configuration.

8. The stapler of claim 1, wherein when said stapler assembly is in a ready configuration, the placement of said second coupling is more than 34 percent of said stapler assembly length, from said second end, and said second coupling is less than 65 percent of said stapler assembly length, from said second end.

9. The stapler of claim 1, wherein said base further comprising a cantilever; and said second coupling providing a fulcrum between said arm and said cantilever.

10. The stapler of claim 1, wherein said distal end of said arm comprising a handle; and said first end input being manual force directly on said handle.

11. The stapler of claim 1, comprising staples;

wherein said stapler assembly has a top, a front, and a rear; and wherein said staples are loaded into said stapler assembly from one of three sides:

said top, said front, and said rear.

12. The stapler of claim 1, wherein said second coupling comprising a fixed pivot.

13. The stapler of claim 12, wherein a stapler assembly further comprising a cover;

said cover further comprising cover sidewalls;

said first coupling providing a cam connection between said arm and said cover sidewalls.

14. The stapler of claim 1, wherein one of said first coupling and said second coupling comprise a rack and pinion.

15. The stapler of claim 1, wherein one of said first coupling and said second coupling comprise a slide cam.

16. A stapler comprising:

a base;

a stapler assembly further comprising a cover, a first end, and a second end;

wherein said base pivotally securing to said stapler assembly proximate said second end;

said cover further comprising a ram;

an arm further comprising a distal end;

said distal end disposed such that said first end being between said base and said distal end when said stapler assembly is in a ready configuration;

a first coupling;

a second coupling;

said first coupling, providing connection between said arm and said cover;

said second coupling providing a fulcrum between said arm and said base;

wherein said arm and said cover are levers;

a first end input;

a stapling assembly output;

wherein said first end input, being transmitted by said first coupling from said arm to said cover, and said cover transfering said first end input to said ram, resulting in said stapling assembly output; and wherein the placement of said second coupling is more than 26 percent of said cover length, from said second end, when said cover is in a ready configuration.

17. A stapler comprising a base and a shaft;

a stapler assembly further comprising a cover, a magazine, a first end, and a second end;

wherein said base pivotally securing, by said shaft, to said stapler assembly proximate said second end;

said cover further comprising a ram;

said magazine further comprising an exit proximate to said first end;

an arm further comprising a distal end;

said distal end disposed such that said first end being between said base and said distal end when said stapler assembly is in a ready configuration;

a first coupling;

a second coupling;

said first coupling, providing connection between said arm and said cover;

said second coupling providing a fulcrum between said arm and said base;

wherein said arm and said cover are levers;

a first end input;

a stapling assembly output;

wherein said first end input, being transmitted by said first coupling from said arm to said cover, and said cover transferring said first end input to said ram, resulting in said stapling assembly output; and wherein the distance between said second coupling and said shaft being more than 12.5 percent of the distance between said shaft and said exit, when said stapler assembly is in a ready configuration.

18. The stapler of claim 17, wherein said distal end of said arm comprising a handle; and said first end input being manual force directly on said handle.

19. The stapler of claim 17, wherein said stapler comprising a disengaged configuration; and wherein one of said first coupling and said second coupling being releasable by said arm's disengagement from one of said base and said cover thereby transforming said stapler from said ready configuration to said disengaged configuration.

20. The stapler of claim 17, wherein said first coupling comprising a fixed pivot.

21. The stapler of claim 17, wherein said base further comprising a cantilever; and said second coupling providing a fulcrum between said arm and said cantilever.

22. The stapler of claim 17, wherein, when said stapler assembly is in a ready configuration, the distance between said second coupling and said shaft being more than 20 percent of the distance between said shaft and said exit.

23. The stapler of claim 17, wherein, when said stapler assembly is in a ready configuration, the distance between said second coupling, and said shaft being more than 26 percent of the distance between said shaft and said exit and less than 76 percent of said distance between said shaft and said exit.

* * * * *